US007946103B2

(12) United States Patent
So et al.

(10) Patent No.: US 7,946,103 B2
(45) Date of Patent: May 24, 2011

(54) ELONGATE BAND, WRISTWATCH COMPRISING SAME AND WATCHCASE

(75) Inventors: Chin Hung Eddy So, New Territories (CN); Chin Plng So, New Territories (CN)

(73) Assignee: Wing Hon Metal Manufactory Limited, Kwai Fung, New Territories (HK)

( * ) Notice: Subject to any disclaimer, the term of this patent is extended or adjusted under 35 U.S.C. 154(b) by 1174 days.

(21) Appl. No.: 11/519,710

(22) Filed: Sep. 12, 2006

(65) Prior Publication Data

US 2007/0113534 A1 May 24, 2007

(30) Foreign Application Priority Data

Nov. 10, 2005 (GB) ..... 0522984.4

(51) Int. Cl.
*A44C 5/00* (2006.01)
*F16G 15/04* (2006.01)

(52) U.S. Cl. ..... 59/80; 59/82; 59/85; 59/93; 63/4; D11/13; 24/265 B

(58) Field of Classification Search ..... 24/163 R, 24/175, 265 B; 59/78, 80, 82, 85, 93; 63/4; D11/13
See application file for complete search history.

(56) References Cited

U.S. PATENT DOCUMENTS

| | | | | |
|---|---|---|---|---|
| 3,036,353 | A | 5/1962 | Minutoli | |
| 3,237,395 | A | 3/1966 | Bennett | |
| 3,726,083 | A | 4/1973 | Pompeo | |
| 3,965,670 | A | 6/1976 | Ihringer | |
| 4,269,026 | A | 5/1981 | Bulle et al. | |
| 4,546,522 | A | 10/1985 | Gygax | |
| 4,564,308 | A * | 1/1986 | Ikegami et al. | 24/265 B |
| 5,483,505 | A * | 1/1996 | Cartier | 224/164 |
| 5,991,978 | A | 11/1999 | Nussbaum | |
| 6,014,793 | A * | 1/2000 | Howald | 24/265 B |
| 6,237,319 | B1 * | 5/2001 | Amundsen et al. | 59/82 |
| 6,272,836 | B1 * | 8/2001 | Fat | 59/80 |
| 6,328,188 | B1 * | 12/2001 | Boznos et al. | 224/175 |
| 7,480,967 | B2 * | 1/2009 | Kojoori et al. | 24/163 R |
| 2004/0050032 | A1 | 3/2004 | Kwan | |
| 2004/0120224 | A1 | 6/2004 | Meylan | |

FOREIGN PATENT DOCUMENTS

| | | | |
|---|---|---|---|
| CH | 664663 | A | 3/1988 |
| DE | 9203248 | U1 | 8/1992 |
| FR | 785981 | A | 8/1935 |
| FR | 2597626 | A | 10/1987 |
| GB | 821182 | | 9/1959 |
| GB | 841384 | | 7/1960 |

(Continued)

OTHER PUBLICATIONS

European Search Report. UK Search Report.

*Primary Examiner* — David B Jones
(74) *Attorney, Agent, or Firm* — William J. Sapone; Coleman Sudol Sapone P.C.

(57) ABSTRACT

A band wearable by a user connectable or connected to a watchcase or a decorative item, comprising a plurality of separable units and means for releasably connecting at least some of the units together to form the band, wherein two adjacent said units are releasably lockable together, and wherein the releasable connection means comprises operable means manually actuable or depressible by a finger of the user to disconnect said adjacent units from each other.

21 Claims, 76 Drawing Sheets

FOREIGN PATENT DOCUMENTS

| | | | |
|---|---|---|---|
| GB | 1142403 | | 2/1969 |
| GB | 1187750 | | 4/1970 |
| GB | 2125993 | A | 3/1984 |
| GB | 2264628 | A | 9/1993 |
| GB | 2297236 | A1 | 7/1996 |
| JP | 2002-233405 | A | 8/2002 |
| WO | 90/12346 | A | 10/1990 |
| WO | 01/32045 | A | 5/2001 |

* cited by examiner 168
188
196
176
180
a
a
b
c
184

194
197
160
193
190
164
192
170
162
197
194
182
a
a
b
c
174
178
186
166
196
172
118
170
168a a
166a
172

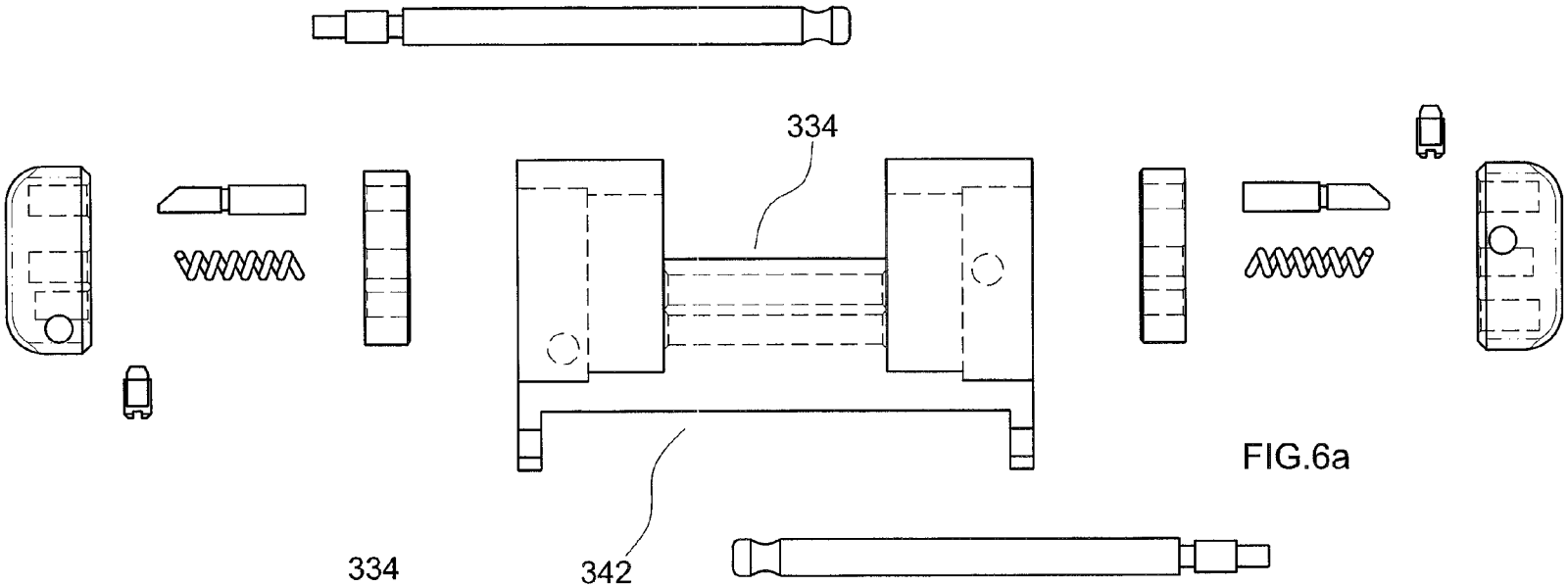
FIG.6a
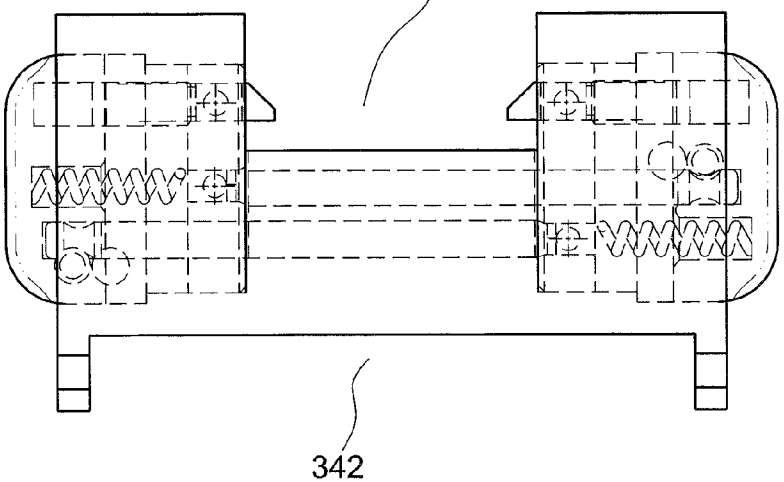
FIG.6b
FIG.6

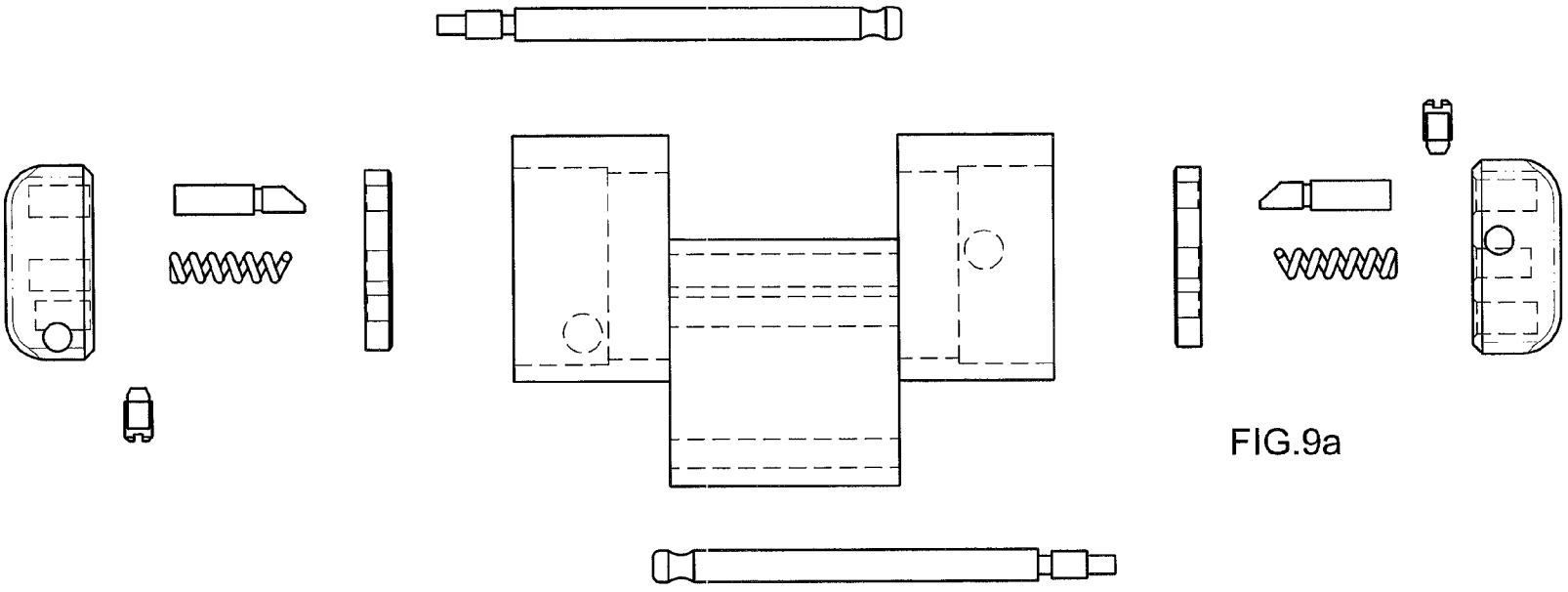
FIG.9a
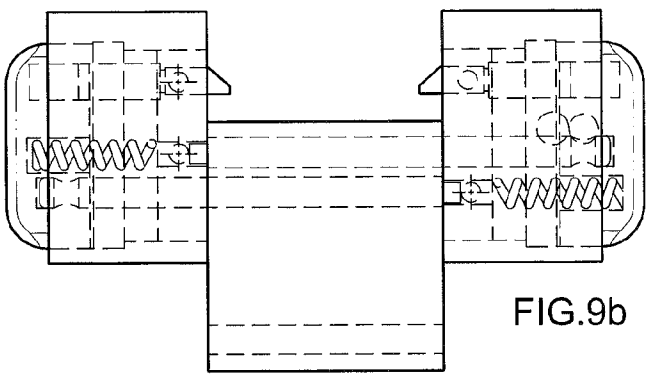
FIG.9b
FIG.9

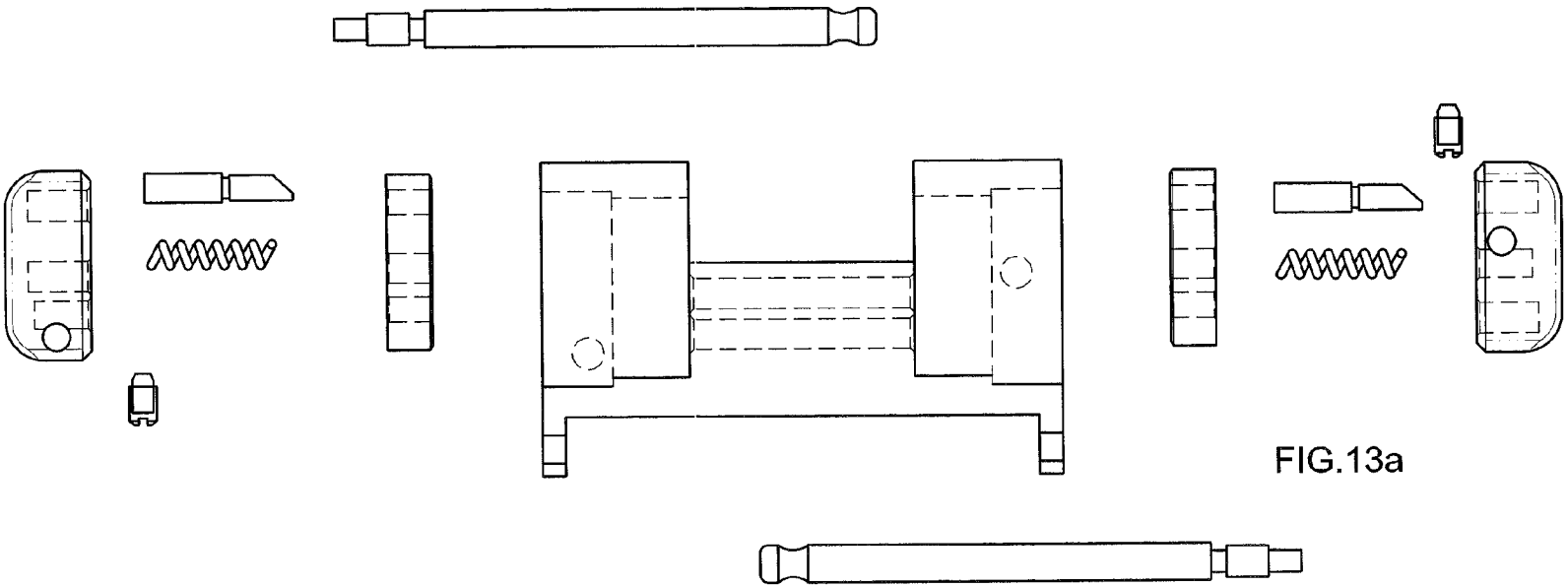
FIG.13a
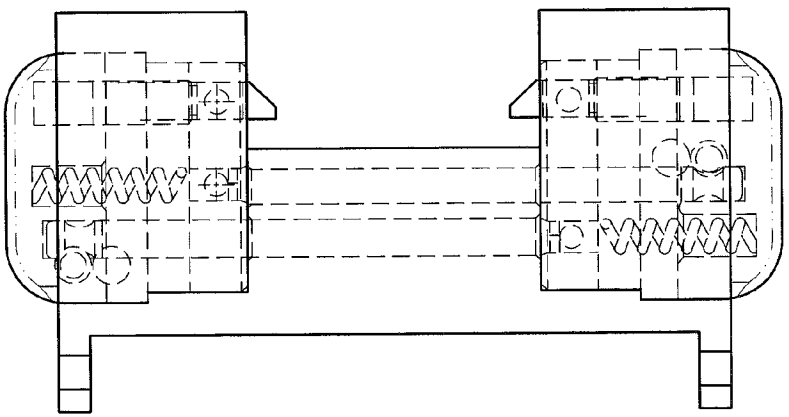
FIG.13b
FIG.13

ELONGATE BAND, WRISTWATCH COMPRISING SAME AND WATCHCASE

FIELD OF THE INVENTION

The present invention is concerned with an elongate band wearable by a user, a wristband, a wristwatch comprising same, and/or a watchcase.

BACKGROUND OF THE INVENTION

There are a variety of decorative items wearable by a user and these items include wristwatches, bracelets and necklaces. One common construction of these items is that they comprise a band portion connected to a decorating portion which may be a watchcase, a medal, a precious stone or a crystal. The band portion may be in the form of a chain with a number of small loops fixedly connected together forming the band. Due to this specific construction, there is often limited design freedom on such a chain-type band. Alternatively, in the case of a typical metallic band of a wristwatch, the band may be formed of a plurality of links generally fixedly secured to each other and connected to the wristwatch in that they would not be accidentally or easily separable. Adjusting the length of the band of such a wristwatch is often rather cumbersome and would normally require at least the use of a specialty screwdriver and a hammer. Further, there is also limited design freedom on this type of metallic wristwatch band.

The present invention seeks to address the problems associated with adjusting the length of a band, provide an alternative band which may be conveniently connectable with or connected to a decorating item such as a watchcase, provide a type of connection means for use in decorative bands which provides more design freedom to designers or are easily adjustable, or at least to provide an alternative to the public.

SUMMARY OF THE INVENTION

According to a first aspect of the present invention, there is provided a band wearable by a user connectable or connected to a watchcase or a decorating item, comprising a plurality of separable units and means for releasably connecting at least some of the units together to form the band, wherein at least one of the units is a link of the band, wherein two adjacently arranged units are releasably lockable together, and wherein the releasable connection means comprises operable means manually actuable or depressible by a finger of the user to disconnect the adjacent units from each other. When the band is connected to for example a watchcase, the watchcase may be considered as one of the units. The operation of the releasable connection means, or connection or disconnection of the units typically does not require the use of any tool.

Particularly, the adjacent units may be releasably connected together by a connection member of the releasable connection means. In one embodiment, the connection member may comprise only one actuator or at least one actuator residing on a lateral end across the width of the two adjacent units of the band and on actuation of the actuator the adjacent units are dis-connectable from each other. In a different embodiment, the connection member may comprise two actuators residing on opposite sides of the adjacent units and on actuation of the actuators the adjacent units are dis-connectable from each other. The use of actuator(s) is preferable because the operation thereof typically does not require any tool and they are easily operable even by lay users.

Preferably, at least part of the releasable connection means may be protruded from the units. The protruded part may be the actuator(s) and this arrangement allows more convenient operation of the connection means. Alternatively, the actuator(s) or part of the actuator(s) may be surrounded by a flange such that it or they would not be accidentally actuated.

In the band, one of the two units in the adjacent units may be provided with a protrusion for engagement with a complementary recess provided by the other unit. This arrangement provides an interlocking structure which is advantageous for both structural and aesthetic reasons. Specifically, one of the two units in the adjacent units may be provided with one or more pins for engagement with a corresponding recess or corresponding recesses on the other unit of the adjacent units for releasably locking the adjacent units together. The use of such pin-type structures is preferred because they are relatively compact but reliable and are suitable for locking the adjacent units together. The releasable connection means may comprise spring means for biasing the pin or pins to a default locked position.

One characteristic of the band is that when connecting or engaging the adjacent units they may be movable or moved towards each other on a horizontal plane. This is advantageous because their connection or engagement is achieved by simply moving them together in a very simple manner and does not require maneuvering the relatively small units in any other way.

Other characteristics of the band are that one or more of the units may be re-positionable, re-orientable and/or reversible within the band. Further, the length of the band may be adjustable by adding thereto or removing therefrom one or more of the units. These at least allow more design freedom on this type of bands.

Preferably, the connection means may be free of any groove means on the units, and the connection of the units does not require the passing of the pins via any groove means.

Suitably, the units or parts thereof may be formed by stamping on a relatively thick metal plate. Alternatively, the units or parts thereof may be in the form of a coil or tubular structure.

Advantageously, the units may be identical or different in size, shape, length, material and/or color. Further, at least one of the units may be provided with an upwardly facing surface and a downwardly facing surface, the surfaces may carry different decorating patterns or objects, and at least one of the units or a part thereof may be made of a metallic material.

The band may be a wristband, a watch wristband or a ring band.

According to a second aspect of the present invention, there is provided a watch comprising a watchcase connected to a band as described above.

According to a third aspect of the invention, there is provided a watchcase comprising at least two sub-units and releasably connectable means for releasably connecting the sub-units together, wherein the releasable connection means comprises operable means manually actuable or depressible by a finger of the user to disconnect said adjacent units from each other. The releasable connection means in this aspect of the present invention is generally similar to that in the first aspect of the present invention described above.

According to a fourth aspect of the present invention, there is provided a watch comprising a watchcase as described above in the third aspect of the invention and the watchcase is connected to a band as described above in the first aspect of the invention. Preferably, at least one of the units or sub-units may be re-positionable, re-orientable and/or reversible within said band.

BRIEF DESCRIPTION OF THE DRAWINGS

Some embodiments of the present invention will now be described by way of example and with reference to the accompanying drawings, in which:—

FIGS. 6*a* and 6*b* show components of one of the links of FIG. 5*b* in greater detail;

FIGS. 9*a* and 9*b* show components of one of the links of FIG. 8*b* in greater detail;

FIGS. 13*a* and 13*b* show components of one of the links of FIG. 12*b* in greater detail;

FIGS. 50 to 52 are schematic views showing the actuators of the links of FIG. 40 and FIG. 42;

DETAILED DESCRIPTION OF PREFERRED EMBODIMENTS OF THE PRESENT INVENTION

Figure 1:
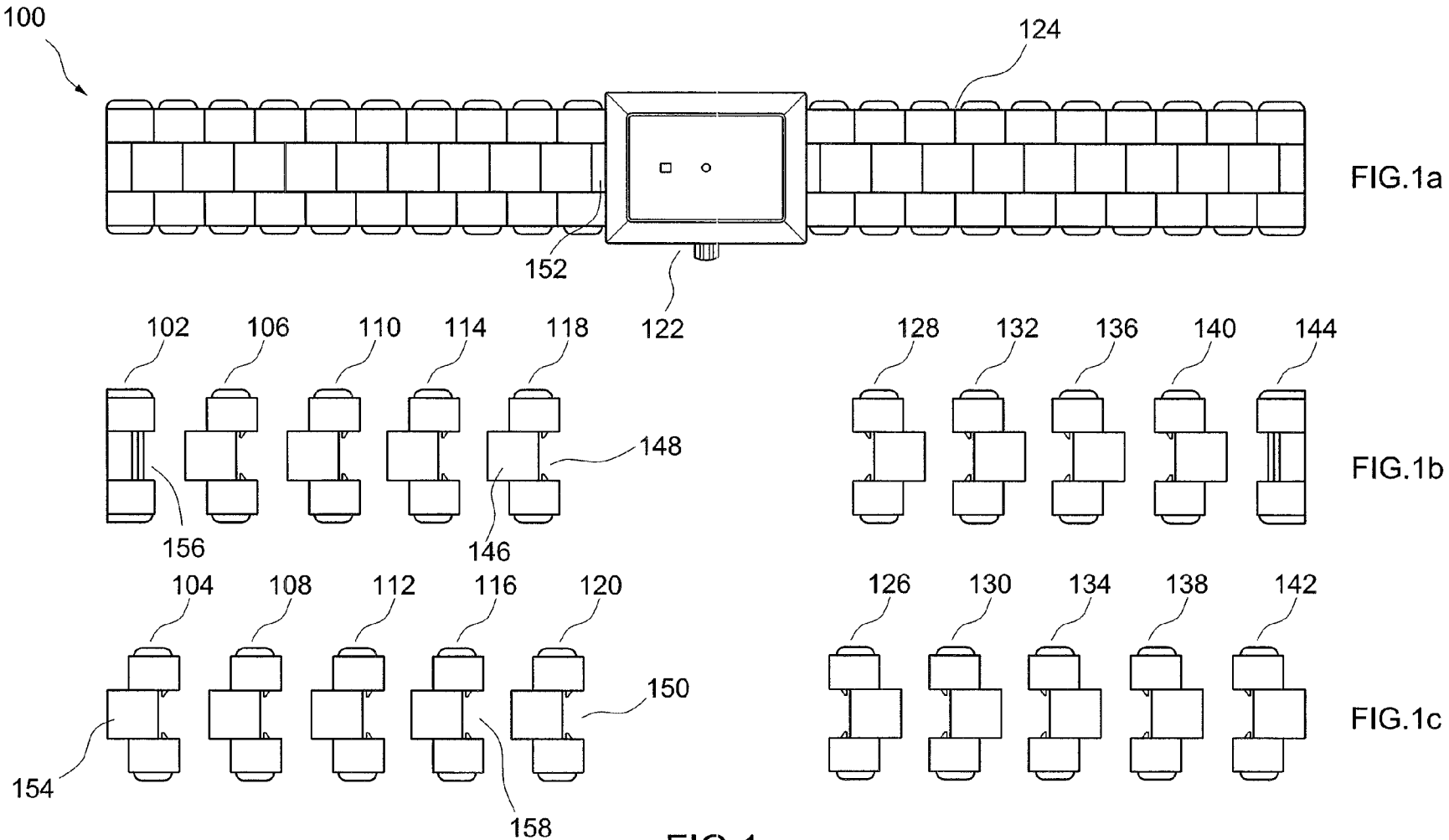
FIG. 1*a* shows a wristwatch according to a first embodiment of the present invention the wristwatch comprises a number of units including a band having a plurality of links and a rectangular watchcase.
FIGS. 1*b* and 1*c* show the links of the wristwatch of FIG. 1*a;*

The present invention is now explained in detail as follows with reference to the accompanying figures.

FIGS. 1*a* to 2*b* are concerned with a wristwatch in accordance with a first embodiment of the present invention. This embodiment relates to a wristwatch generally designated 100 comprising a plurality of discrete units 102, 104, 106, 108, 110, 112, 114, 116, 118, 120, 122, 126, 128, 130, 132, 134, 136, 138, 140, 142, 144 including a watchcase 122 connected to a band 124 having a number of inter-connected links 102-120, 126-144. FIGS. 1*b* and 1*c* show the links 102-120, 126-144 of the band 124 separated. In this embodiment, the links 102-120, 126-144, except the two end links 102, 144, are identical in shape and configuration. For example, the link 118 has a protrusion 146 and a recess 148, the protrusion 146 is sized and shaped to fit within a recess 158 of the adjacent link 116. Likewise, the link 120 has a recess 150 which is sized and shaped to accommodate a protrusion 152 of the watchcase 122. Similarly, the link 104 has a protrusion 154 which is sized and shaped to fit into a complementary recess 156 of the end link 102.

Figures 2, 2A, 2B:
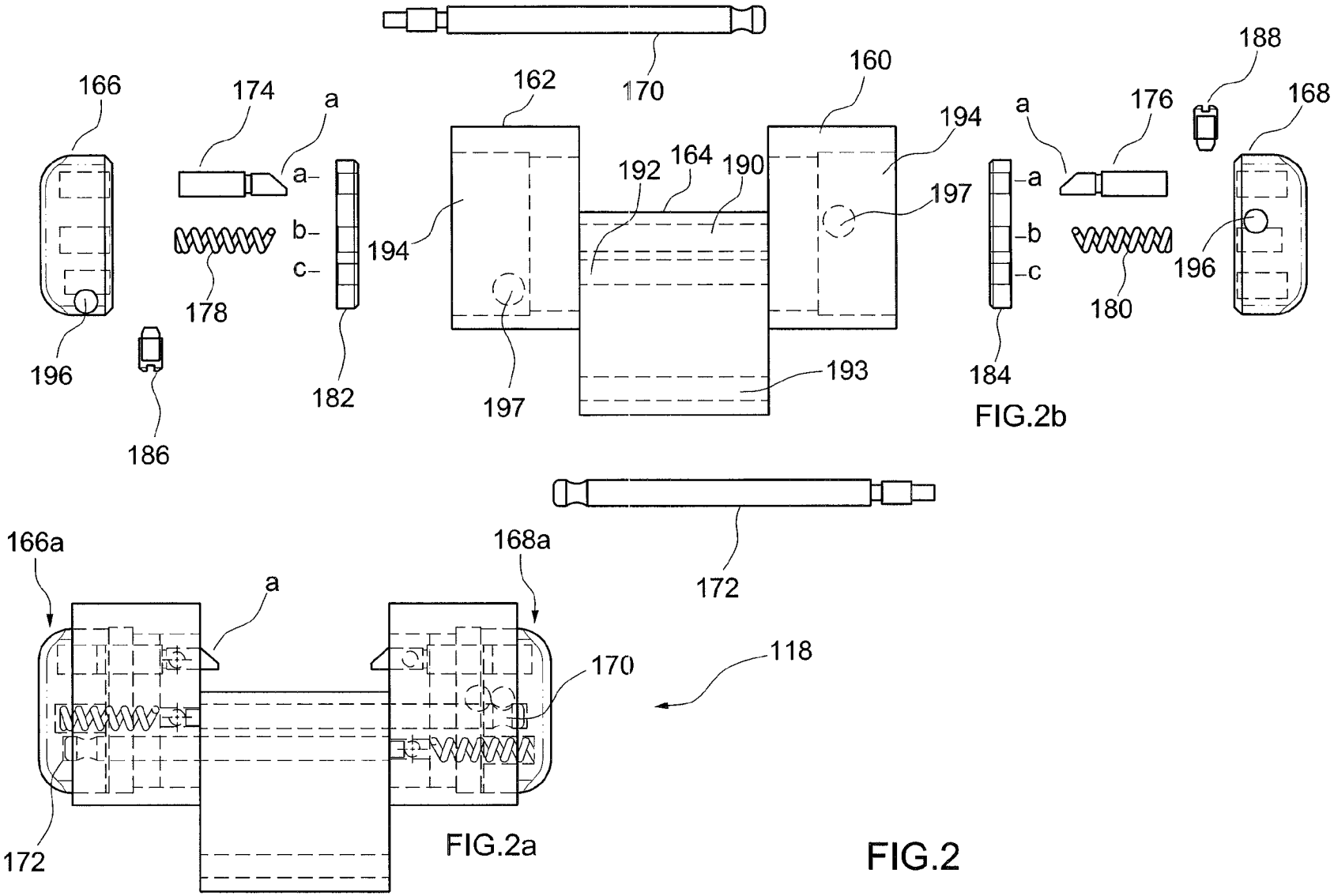
FIGS. 2*a* to 2*b* show components of one of the links of FIG. 1*c* in greater detail.
Figure 3:
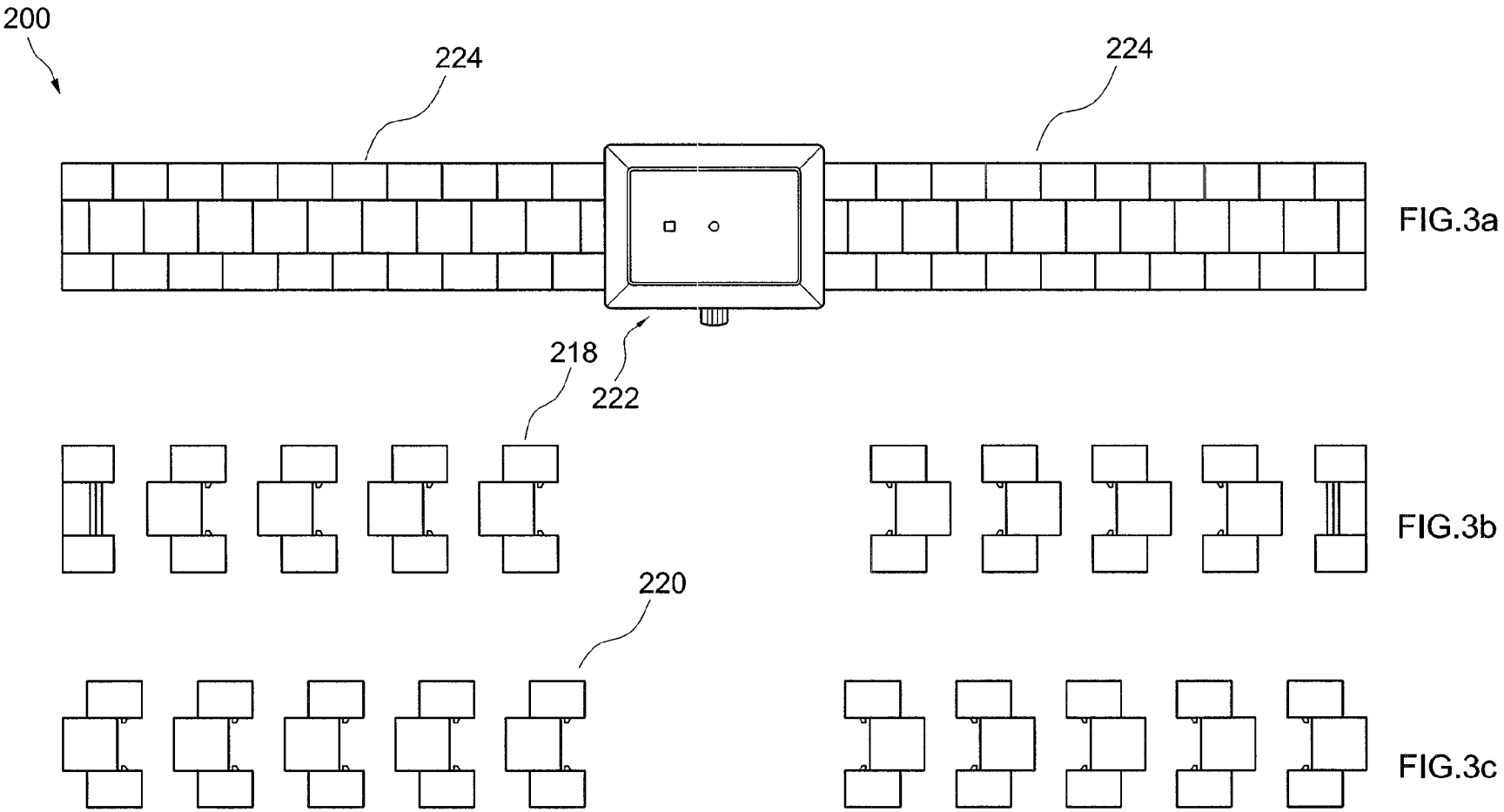
FIG. 3*a* shows a wristwatch according to a second embodiment of the present invention, the wristwatch comprises a number of units including a band having a plurality of links and a rectangular watchcase.
FIGS. 3*b* and 3*c* show the links of the wristwatch of FIG. 3*a;*
Figures 4, 4A, 4B:
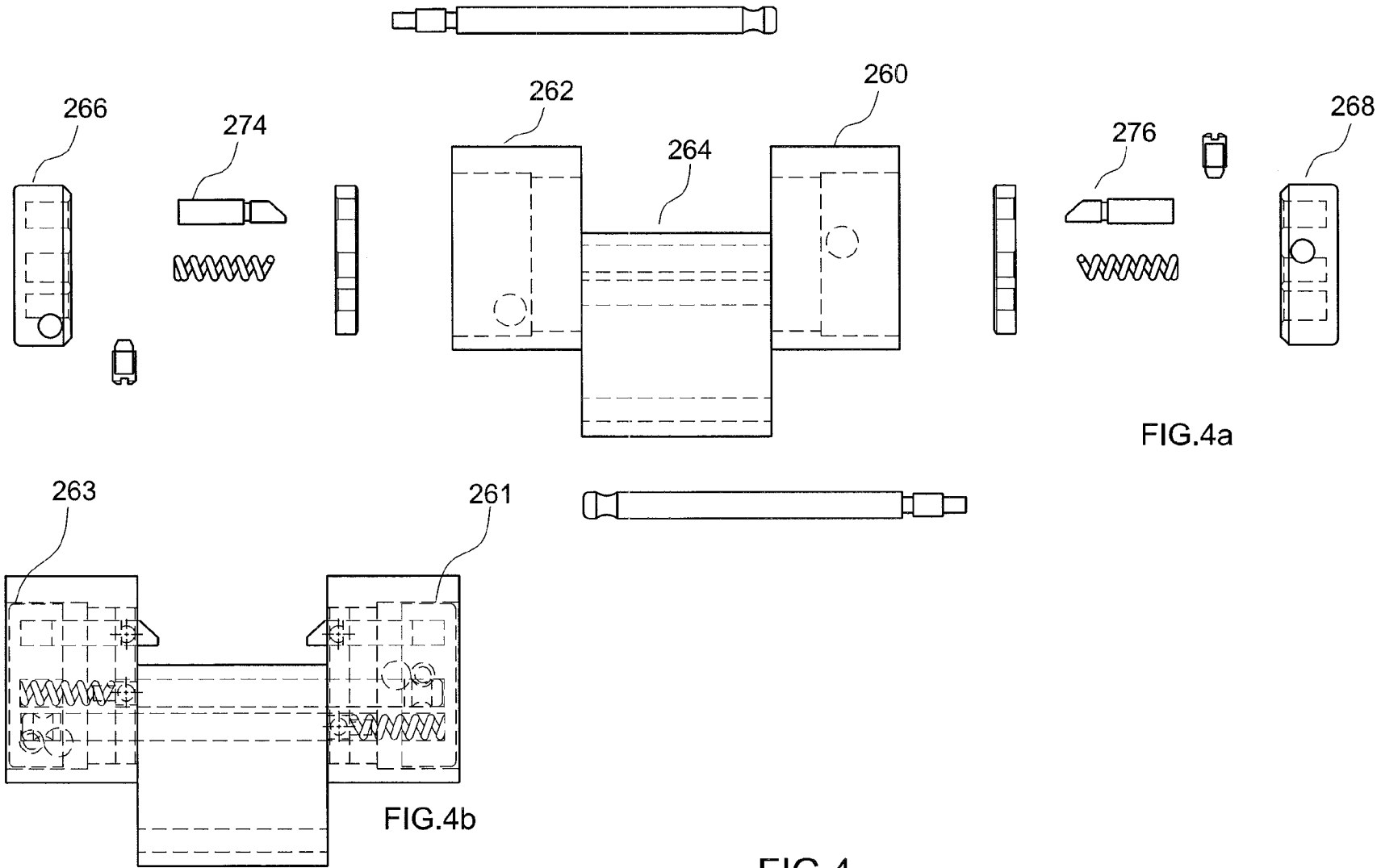
FIGS. 4*a* to 4*b* show components of one of the links of FIG. 3*c* in greater detail.
Figure 5:
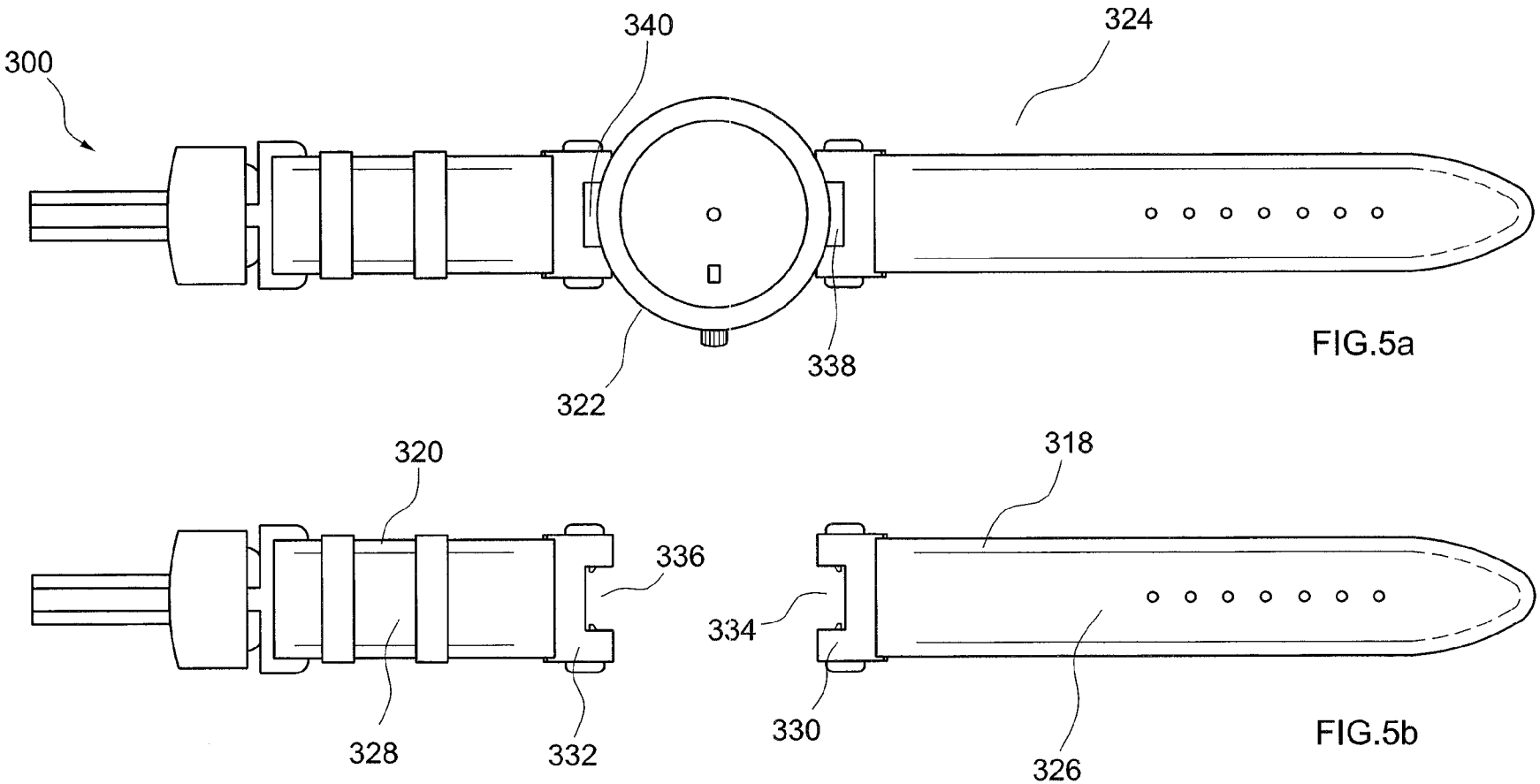
FIG. 5*a* shows a wristwatch according to a third embodiment of the present invention, the wristwatch comprises a number of units including a band having a plurality of links and a round watchcase.
FIG. 5*b* shows the links of the wristwatch of FIG. 5*a;*

The units 102-144 are releasably connectable by using a connection system to be explained as follows. FIG. 2*a* and FIG. 2*b* show one of the links 104-120, 126-142 (e.g. the link 118) in more detail. The link 118 comprises a right side member 160, a left side member 162, a middle member 164, a left actuator 166, a right actuator 168 and two long pin members 170, 172 for connecting the members 160, 162, 164 together. The link 118 also comprises a left short pin member 174, a right short pin member 176, a left spring 178, a right spring 180, a left adapter 182, a right adapter 184 and a pair of rivets 186, 188, all of which are for positioning and securing the actuators 166, 168 to the side members 160, 162.

The middle member 164 is provided with two channels 190, 192 arranged close to and adjacent to each other at one end (the top end) thereof. The channels 190, 192 are sized and shaped to tightly accommodate the middle portion of the long pin members 170, 172. Each of the side members 160, 162 is provided with a cavity 194 for housing the short pin members 174, 176, the ends of the long pin members 170, 172, the springs 178, 180 and the adapters 182, 184 such that when the side members 160, 162 are arranged at the predetermined location sandwiching the middle member 164, they are connectable by the two long pins members 170, 172 passing through the channels 190, 192 and the cavity 194. In particular, the channels 190, 192 have a diameter slightly greater than the diameter of the long pin members 170, 172 such that the pin members reside reasonably securely in the channels 190, 192. The cavity 194 of the side members 160, 162 are relatively large in which the adapters 182, 184 are tightly fitted. Each of the adapters 182, 184 is provided with three bores 182*a*, 182*b*, 182*c*, 184*a*, 184*b*, 184*c* along its length with, for example, the first bore 182*a* through which the short pin member 174 passes, the second bore 182*b* through which the left spring 178 passes and the third bore 182*c* for accommodating an end of the long pin member 172. The cavity 194 is also large enough such that at least part of the actuator 166, 168 is fitted therein. As shown in FIGS. 2*a* and 2*b*, there is provided an opening 196 in each of the actuators 166, 168. There is also provided a small circular region 197 at each of the side members 160, 162. When the link 118 is assembled, the region 197 is the location where the opening 196 meets and joins together with the pin member 170 (172), the adapter 182 (184), the pin member 174 (176) and the side member 166 (168). When assembled, the actuators 166, 168 are biased towards an outer position by the springs 178, 180 while the short pin members 174, 176 are biased towards an inner position and the middle member 164.

FIG. 2*a* is a transparent view of the assembled link 118. Starting from the left side of the link 118, it is shown that the long pin member 172 connects the left actuator 166, the left side member 162 fitted with the left adapter 182, and the middle member 164. Starting from the right side of the link 118, the long pin member 170 connects the right actuator 168, the right side member 160 fitted with the right adapter 184, the middle member 164 and the left side member 162. As a result, the three members 160, 162, 164 are connected together with each of the side members 160, 162 fitted with the actuator 166, 168. In this embodiment, part of the actuators 166*a*, 168*a* protrudes from the side members 160, 162. It is to be noted that on actuation of, for example, the left actuator 166, the left spring 178 is pushed towards the right and in turn pushes the upper top long pin member 170 located adjacent its end. The upper long pin member 170 then moves towards the right moving the right adapter 184 slightly towards the right within the cavity 194 and in turn also moving the right short pin member 176 towards the right away from its default inner position. It is envisaged that on actuation of for example both the actuators 166, 168, following the same mechanism, both the short pin members 174, 176 move away from their inner default position. As a result, the short pin members 174, 176 originally engaged with the middle member of the adjacent link 150 at the channel (e.g. 193) becomes disengaged therefrom (see FIGS. 1*b* and 1*c*). The adjacent links 118, 120 thus become dis-connectable from each other. The channel of the link 150 is similar to the channel 193 of the link 118 as shown in FIG. 2*b*, and their opposite ends serve as recesses with which the short pin members may engage.

Each of the pin members 174, 176 of the link 118 has a tapered end 174*a*, 176*a* with a tapered surface facing the adjacent link 120 with which the link 118 is to be connected. The tapered ends 174*a*, 176*a* are the portions of the pin members 174, 176 that protrude from the side members 160, 162 at default. It is envisaged that when the protrusion of the adjacent link 120 engages with the recess 148 of the link 118, the link 120 may be moved on a horizontal place and pushes the pins 174, 176 towards opposite directions before the links 118, 120 are locked together by the pins 174, 176 at the recesses at the opposite ends of the channel of the link 120.

It is envisaged that in use when the length of the band 124 is longer than what is needed by a user, the user may remove one or more of the links 104-120, 126-142 by simply pressing on the actuators (e.g. 166, 168 of the relevant links) with a finger to disconnect the links from each other and for removing the link(s), and then reconnecting the rest of the links together. While in this embodiment the links 104-120, 126-142 are identical, the links may in fact be made with different color or pattern thereon such that the user could create a unique arrangement or combination of the links by re-positioning them within the band 124. This is done by disconnecting them and then re-connecting them at the desired position of color or pattern combination. It is to be noted that the links function equally when it is positioned up side down such that they may also be used reversibly. For example, one side of all the links may be silver in color and the other side of the link may be golden in color. In use, they could easily be rearranged such that the silver side of all the links faces outwardly and form a silver-looking watchband. Alternatively, they could easily be arranged such that the golden side of all the links faces outwardly and form a golden-looking watchband. Yet alternatively, the links could be rearranged in such a way that the links of the band exhibit an alternate silver and golden pattern thereon.

FIGS. 3*a* to 4*b* are concerned with a wristwatch 200 in accordance with a second embodiment of the present invention. This wristwatch 200 is generally identical to the wristwatch 100 and comprises a watchcase 222 and a band 224 comprising a number of links 218, each having a middle member 264 and two side members 260, 262. Each side member 260, 262 similarly is provided with an actuator 266, 268. However, unlike the actuators 166, 168, the actuators 266, 268 are situated within the side members 260, 262 and are surrounded by flanges 261, 263 at opposite outer ends of the link 218. In use, the actuators 266, 268 are inwardly pressed towards the middle member 264 to move pins 274, 276 away from their inner position and disconnect, for example, the link 218 from the adjacent link 220.

FIGS. 5*a* to 6*b* are concerned with a wristwatch 300 in accordance with a third embodiment of the present invention. This wristwatch 300 is different from the wristwatch 100 in that it comprises three units including a round watchcase 322 and a band 324 having two links 318, 320, each of which includes a soft portion 326, 328 connected to a metallic end portion 330, 332. Each of the end portions 330, 332 is provided with a recess 334, 336 within which a protrusion 338, 340 of the watchcase 322 is fitted. The other end of the metallic portion 330, 332 is connected to the soft portion 326, 328 made of a strip of soft material (e.g. leather). The links 318, 320 and the watchcase 322 are connected together using the connection system as illustrated above. In particular, FIGS. 6*a* and 6*b* show the structure of the metallic portion 330, 332. One main difference is that the lower end of the end portion is provided with a slot 342 at which the soft portion may be attached in a conventional manner. It is envisaged that a number of the links of different color or pattern may be available as accessories and a user may replace the links easily to match a particular fashion need.

Figure 7:
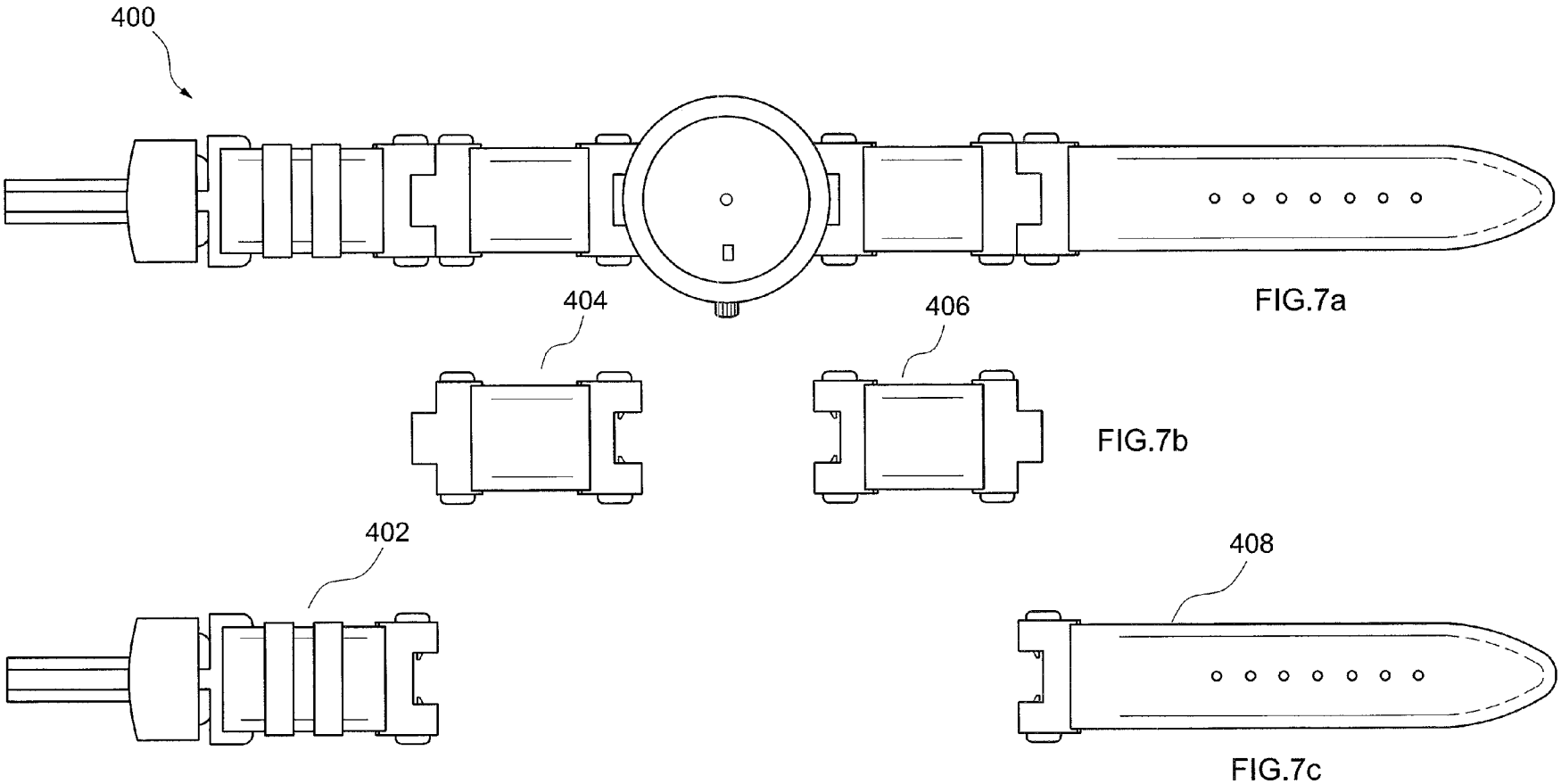
FIG. 7*a* shows a wristwatch according to a fourth embodiment of the present invention, the wristwatch comprises a number of units including a band having a plurality of links and a round watchcase.
FIGS. 7*b* and 7*c* show the links of the wristwatch of FIG. 7*a;*
Figure 8:
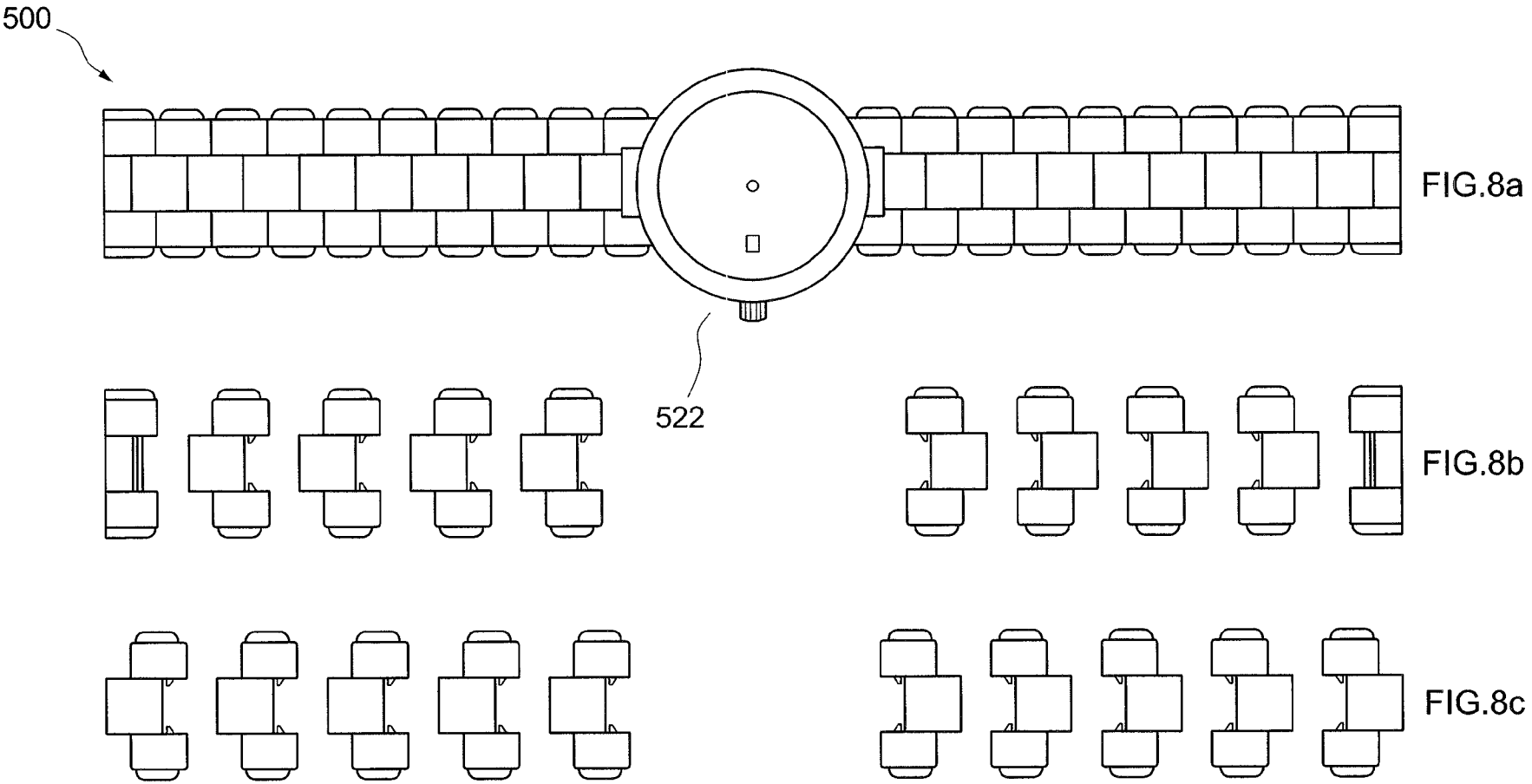
FIG. 8*a* shows a wristwatch according to a fifth embodiment of the present invention, the wristwatch comprises a number of units including a band having a plurality of links and a round watchcase.
FIGS. 8*b* and 8*c* show the links of the wristwatch of FIG. 8*a;*
Figures 10, 10A, 10B, 10C:
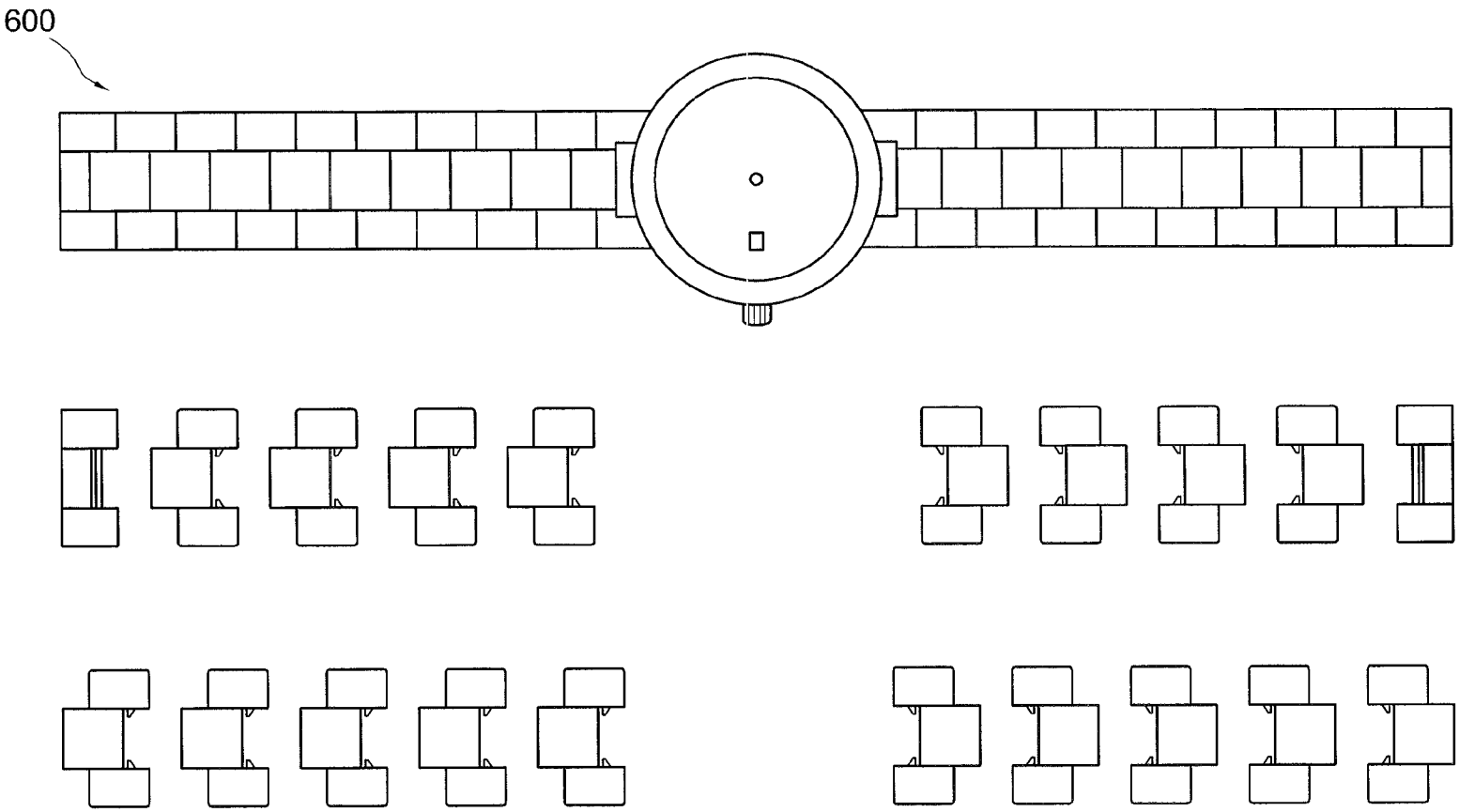
FIG. 10*a* shows a wristwatch according to a sixth embodiment of the present invention, the wristwatch comprises a number of units including a band having a plurality of links and a round watchcase.
FIGS. 10*b* and 10*c* show the links of the wristwatch of FIG. 10*a;*
Figures 11, 11A, 11B:
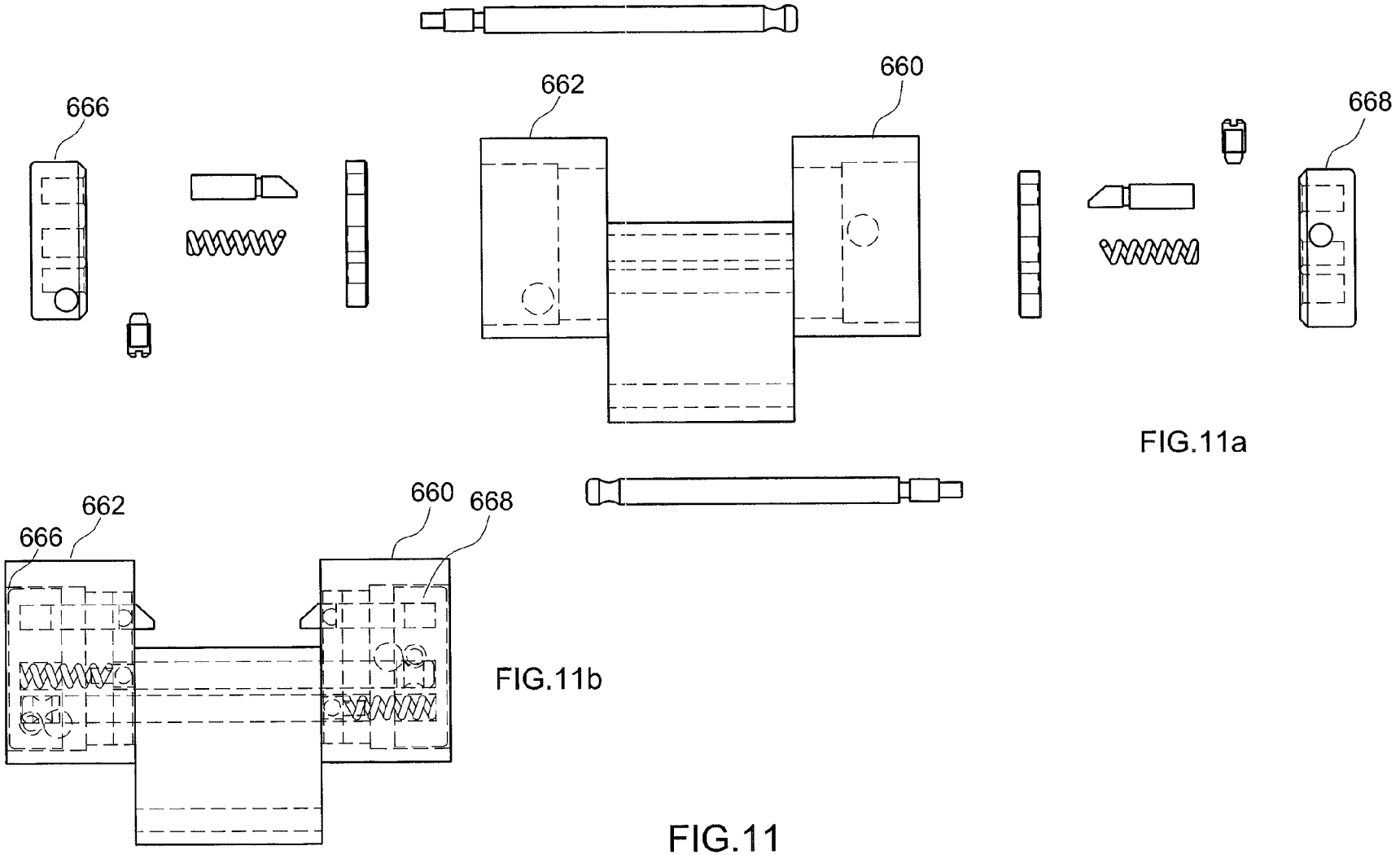
FIGS. 11*a* and 11*b* show components of one of the links of FIG. 10*c* in greater detail.
Figures 12, 12A, 12B:
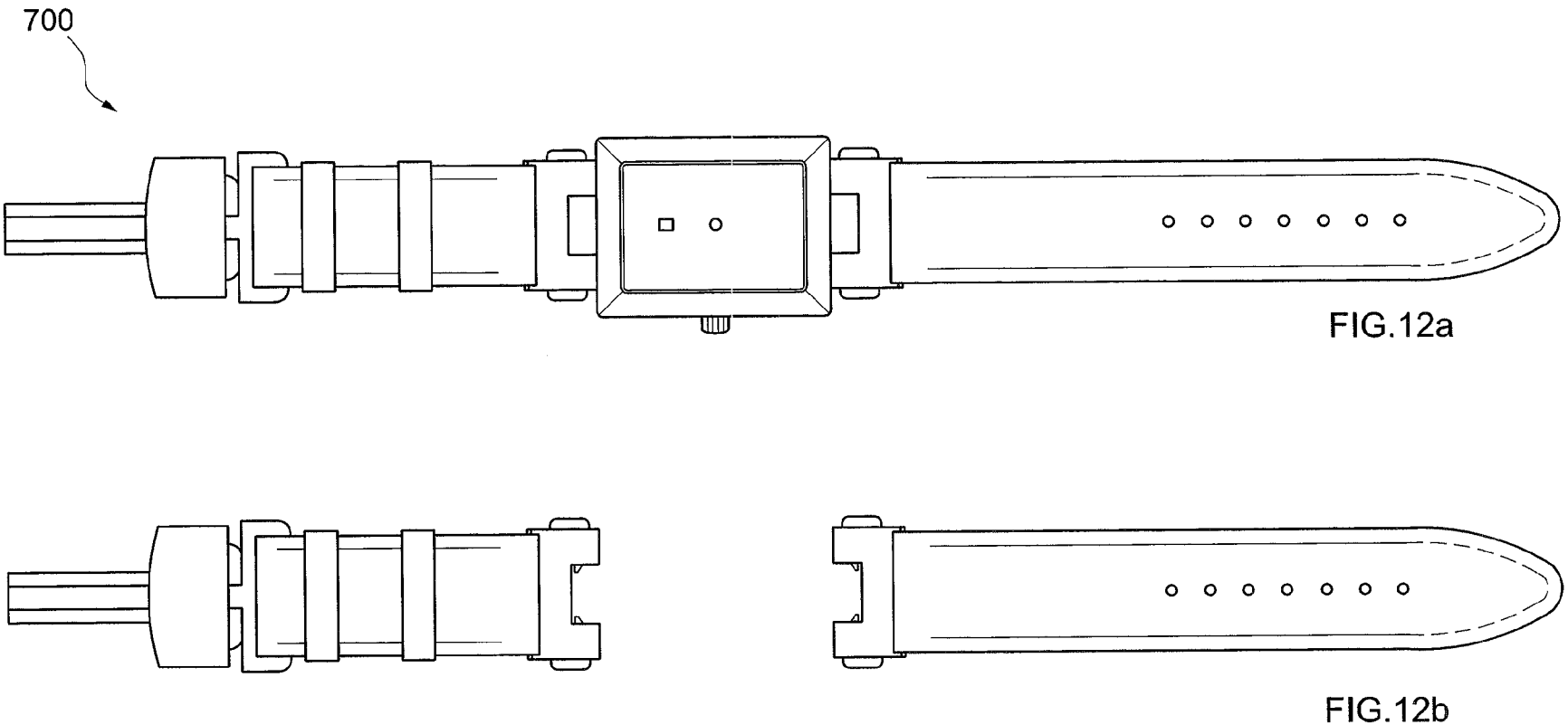
FIG. 12*a* shows a wristwatch according to a seventh embodiment of the present invention, the wristwatch comprises a number of units including a band having a plurality of links and a rectangular watchcase.
FIG. 12*b* shows components of one of the links of the wristwatch of FIG. 12*a*.

FIGS. 7*a* to 7*c* are concerned with a wristwatch 400 in accordance with a fourth embodiment of the present invention. This wristwatch 400 is generally identical to the wristwatch 300 except it has four links 402, 404, 406, 408 in its band 400. The two links 402, 404, for example, are connected together using the connection system as illustrated above.

FIGS. 8*a* to 9*b* are concerned with a wristwatch 500 in accordance with a fifth embodiment of the present invention. This wristwatch 500 is generally identical to the wristwatch 100 shown in FIG. 1*a* except the wristwatch 500 has a round watchcase 522. The connection system as shown in FIGS. 9*a* and 9*b* is identical to that shown in FIGS. 2*a* and 2*b*.

FIGS. 10*a* to 11*b* are concerned with a wristwatch 600 in accordance with a sixth embodiment of the present invention. This wristwatch 600 is generally identical to the wristwatch 100 shown in FIG. 1*a* except it has two actuators 666, 668 in each link arranged within side members 660, 662.

FIGS. 12*a* to 13*b* are concerned with a wristwatch 700 in accordance with a seventh embodiment of the present invention. This wristwatch 700 is generally identical to the wristwatch 300 shown in FIG. 5*a* except it has a rectangular watchcase. The connection system of the wristwatch 700 is also identical to that of the wristwatch 300.

Figure 14:
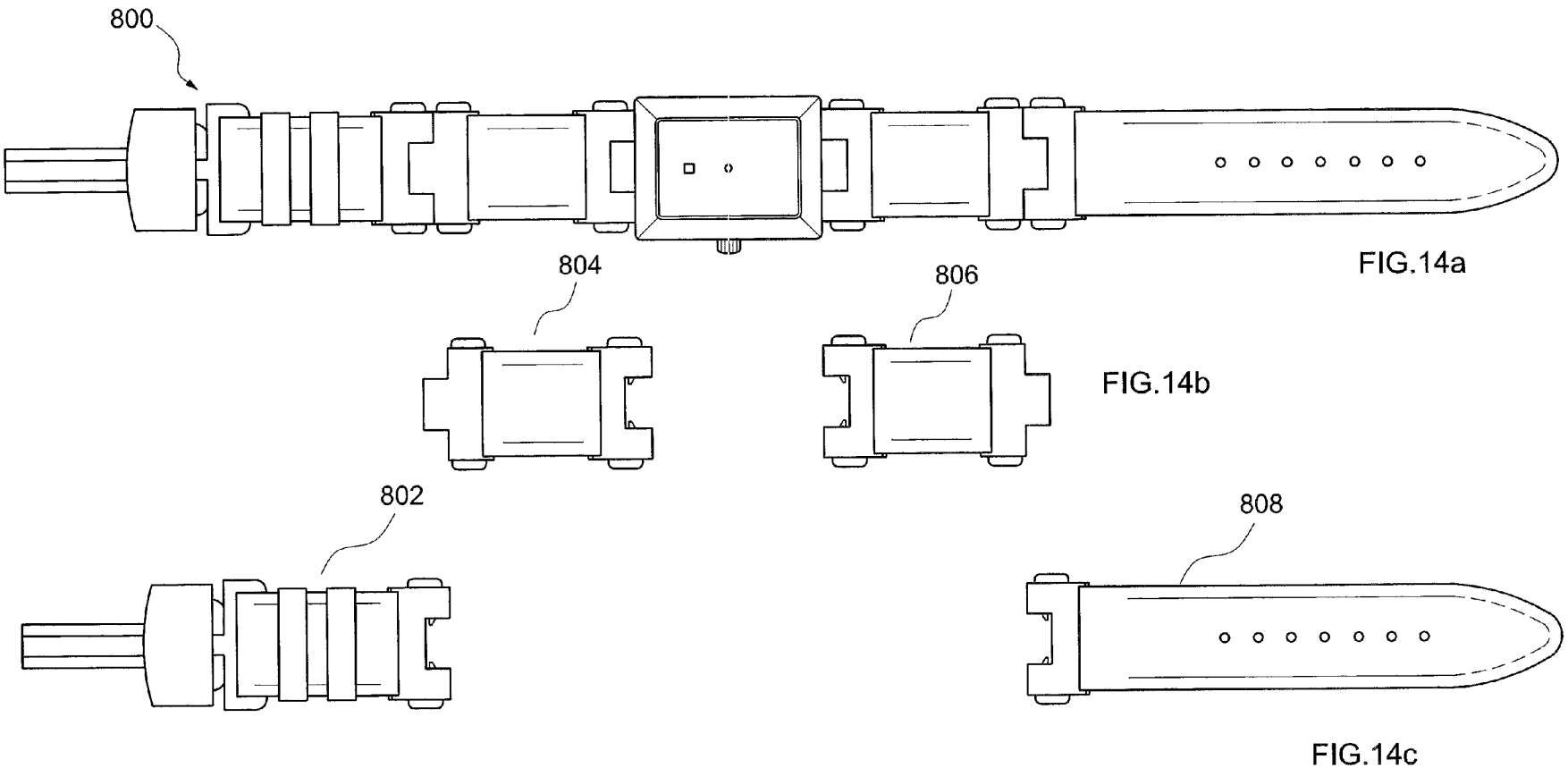
FIG. 14*a* shows a wristwatch according to an eight embodiment of the present invention, the wristwatch comprises a number of units including a band having a plurality of links and a rectangular watchcase.
FIGS. 14*b* and 14*c* show the links of the wristwatch of FIG. 14*a;*

FIGS. 14*a* to 14*c* are concerned with a wristwatch 800 in accordance with an eight embodiment of the present invention. This wristwatch 800 is generally identical to the wristwatch 700 shown in FIG. 12*a* except its band has four links 802, 804, 806, 808. Each of the links 802, 804, the links 806, 808 and the link 804 (806) and the watchcase are connected or connectable together using the connection system as illustrated above.

Figure 37:
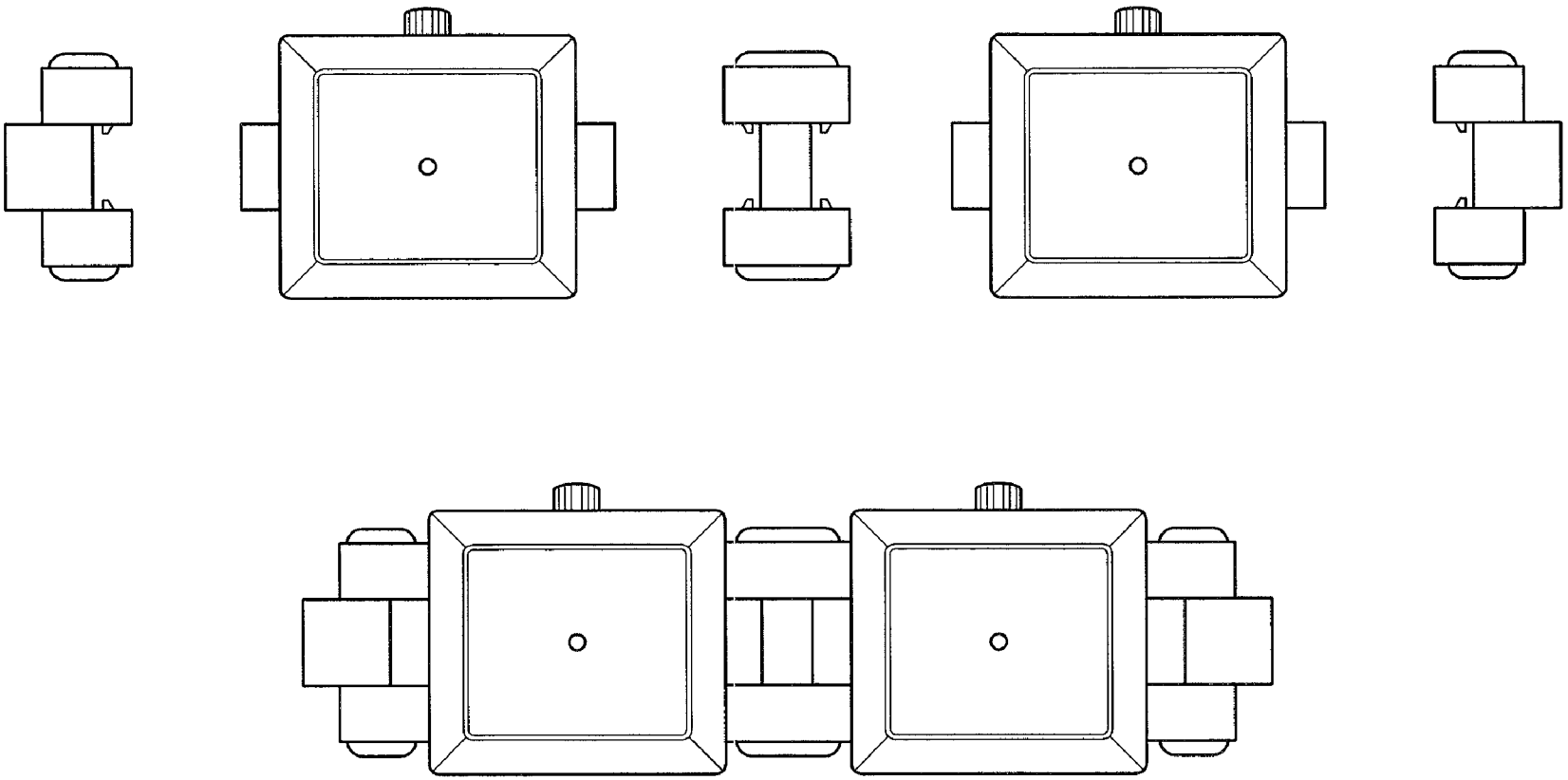
FIG. 37 shows part of a wristwatch according to a ninth embodiment of the present invention.

FIG. 37 shows part of a wristwatch in accordance with a ninth embodiment of the present invention. Unlike the wristwatch 100, this wristwatch has two watchcases that are connectable together using the same connection system as explained above. While in this embodiment the two watchcases are connectable together via a connecting link, it is envisaged that it could be modified such that the two watchcases are connected together directly without the use of any connecting link.

Figure 38:
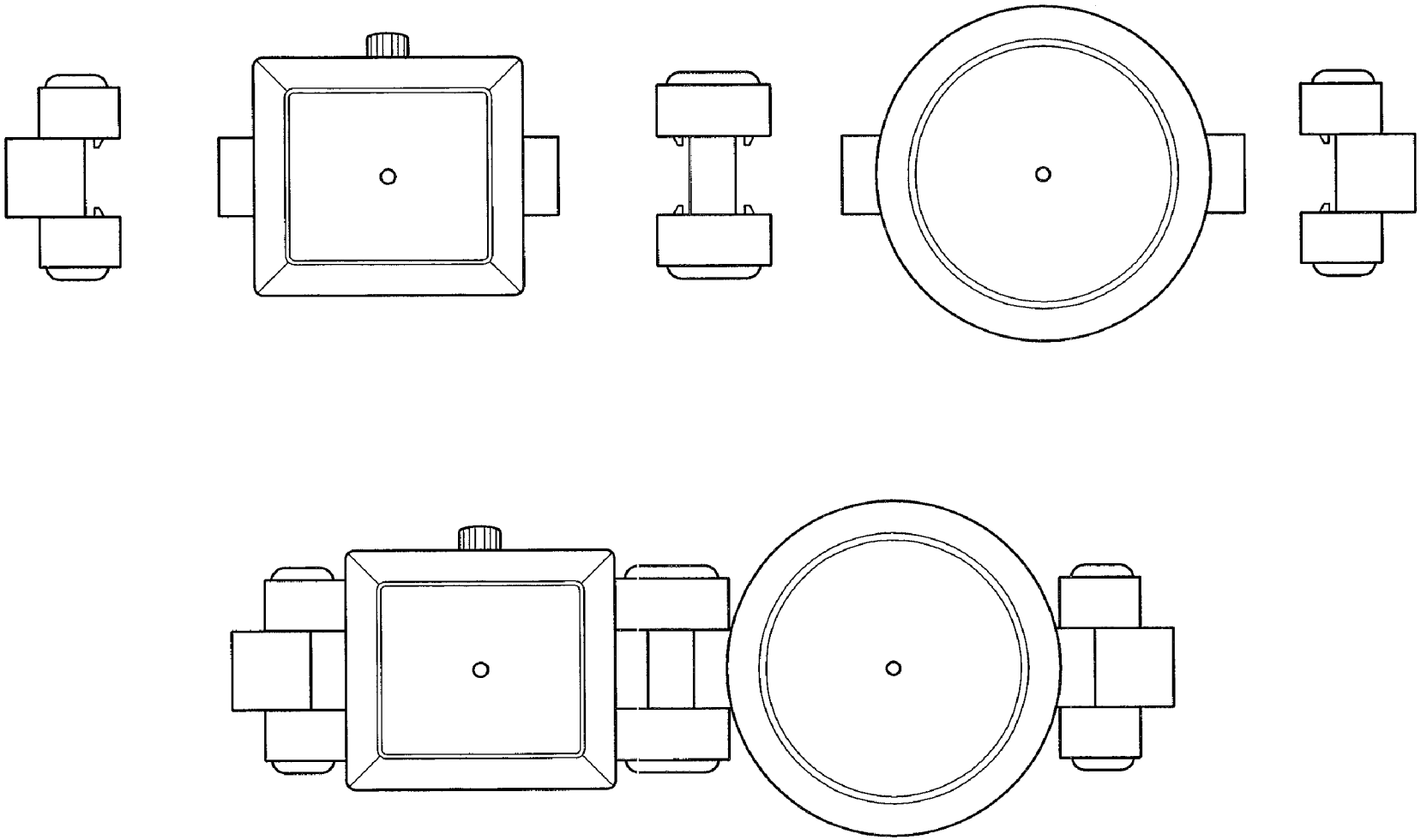
FIG. 38 shows part of a wristwatch according to a tenth embodiment of the present invention.

FIG. 38 shows part of a wristwatch in accordance with a tenth embodiment of the present invention. This embodiment is generally similar to the ninth embodiment, except one of the watchcases is rectangular in shape and the other is round in shape.

In the above first, second, fifth and sixth embodiments, the links are essentially made of stainless steel. In the other embodiments, the portion of the links connectable to an adjacent unit or a watchcase is essentially made of stainless steel while the remaining portion is made of a soft material.

Figure 15:
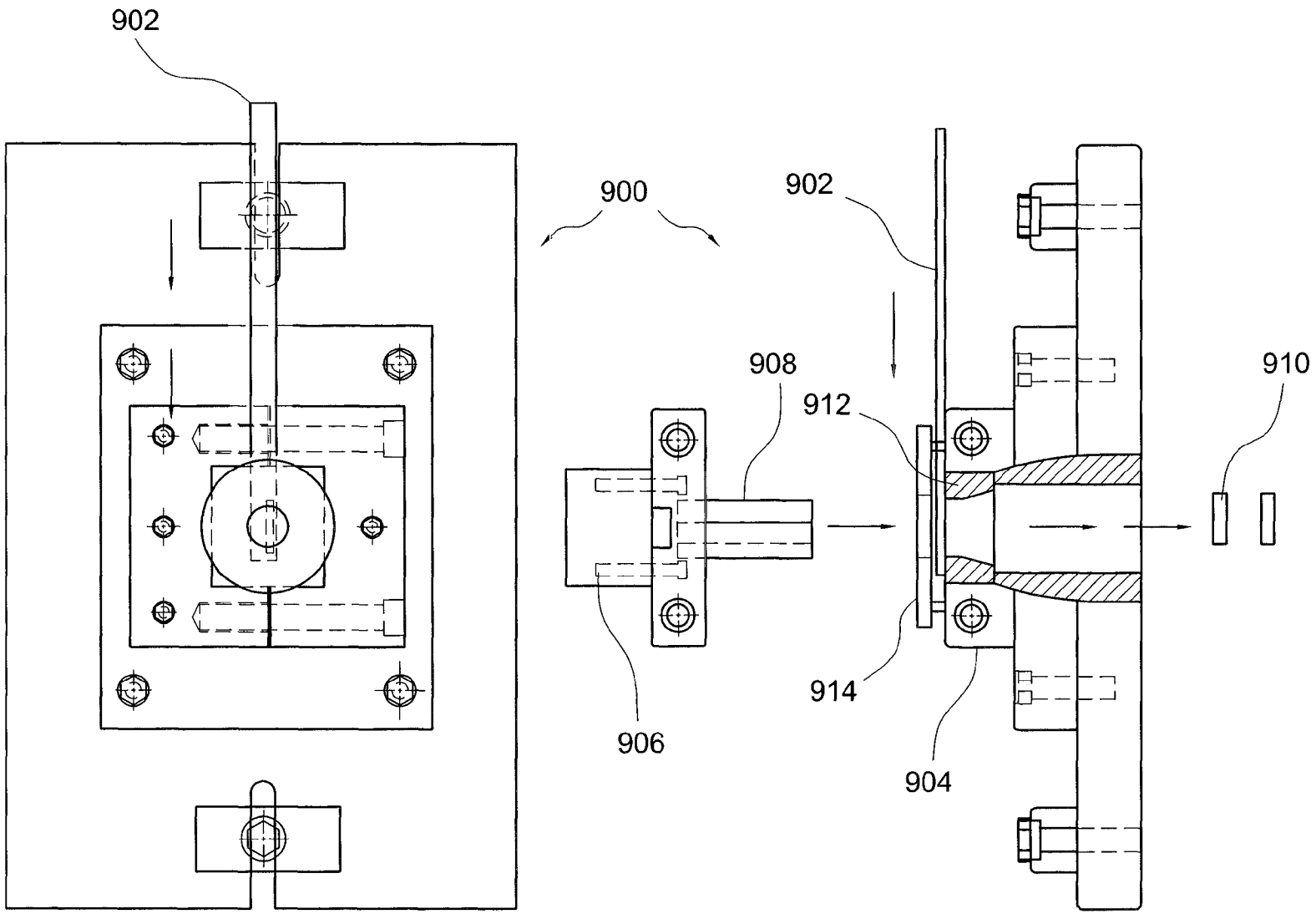
FIGS. 15 to 19 are a series of schematic diagrams illustrating production of a side member of a link of the wristband of FIG. 1.
Figure 16:
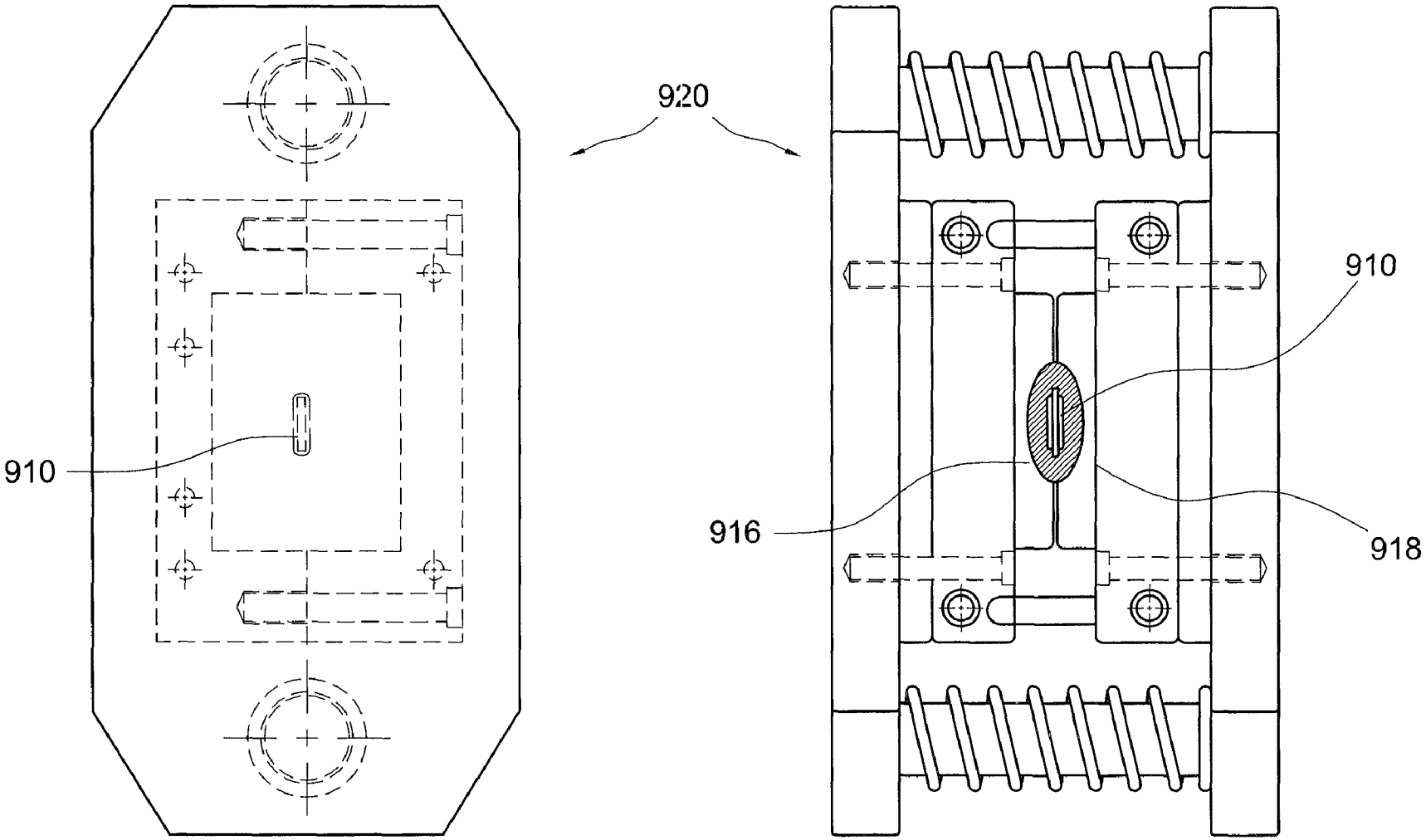
Figure 17:
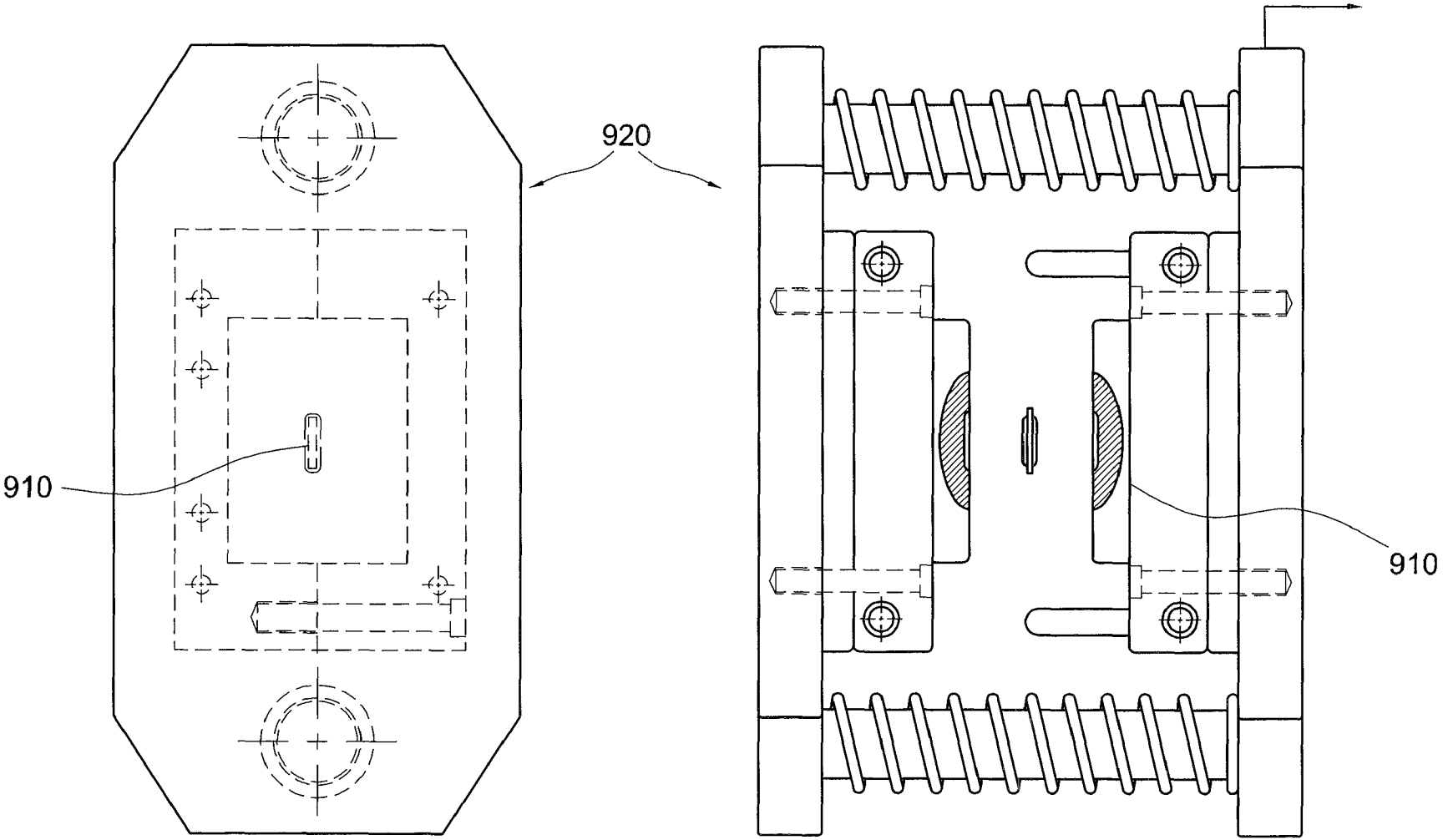
Figure 18:
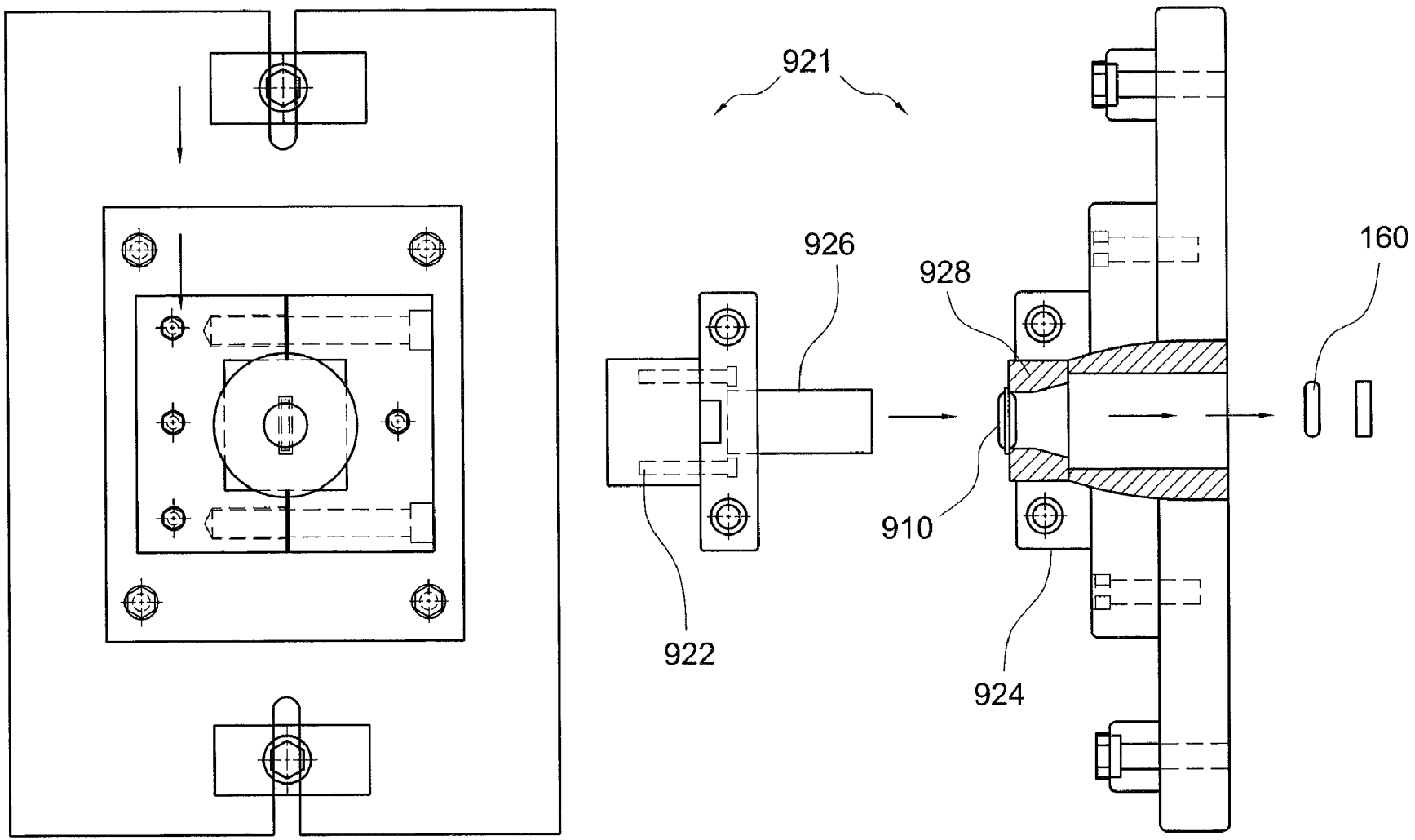
Figure 19:
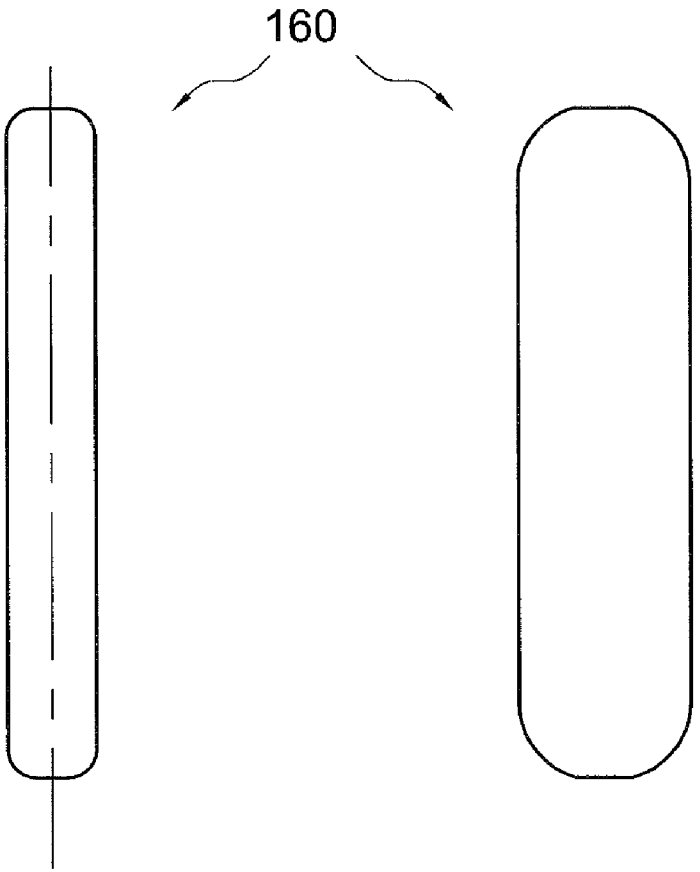
Figure 20:
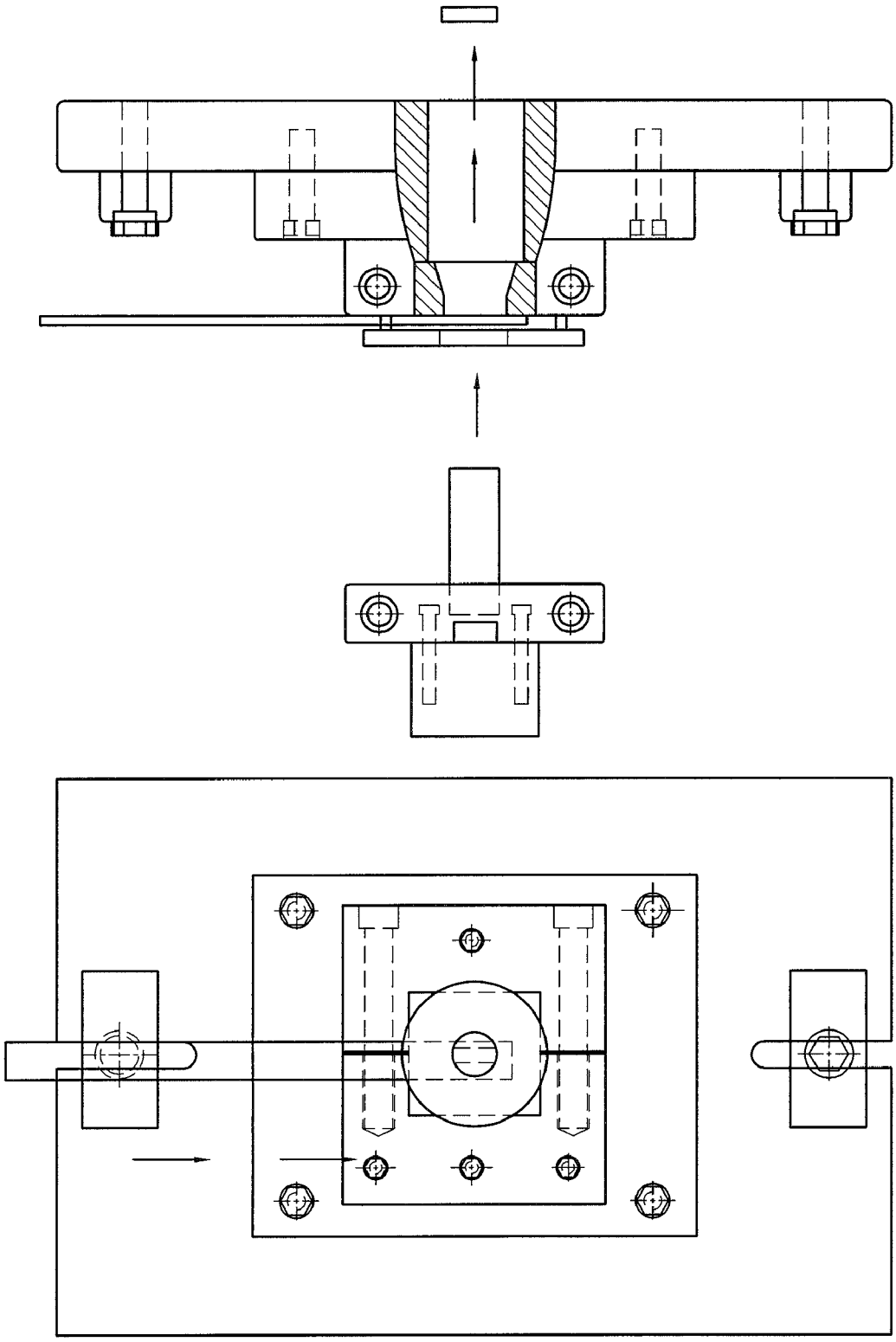
FIGS. 20 to 24 are a series of schematic diagrams illustrating production of an actuator of a link of the wristband of FIG. 1.
Figure 21:
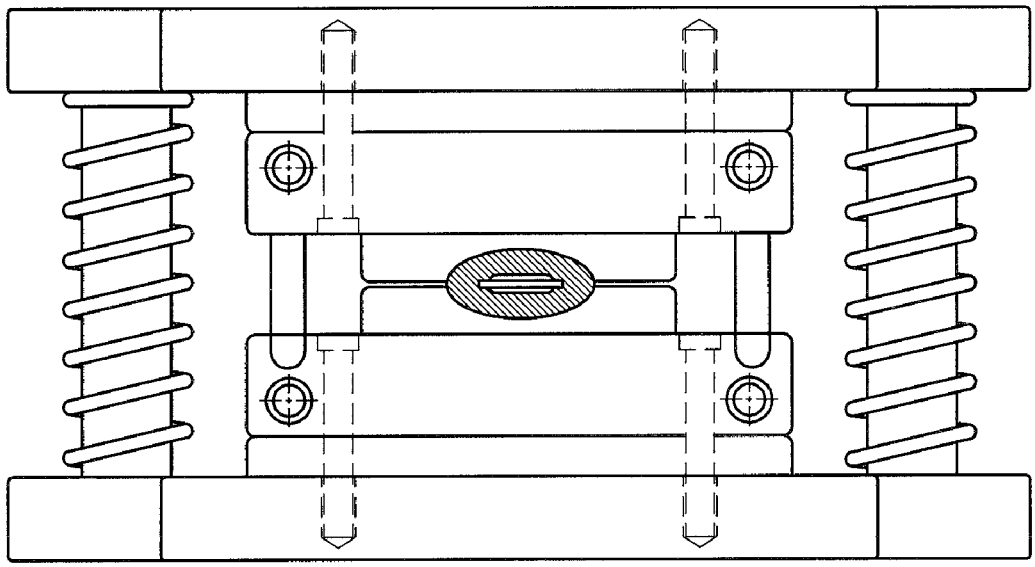
Figure 21:
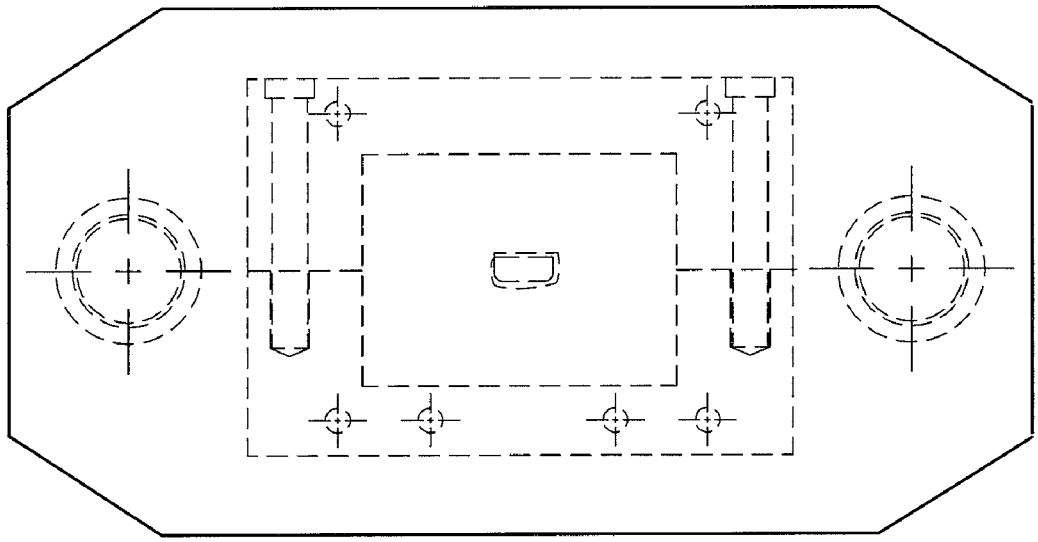
Figure 22:
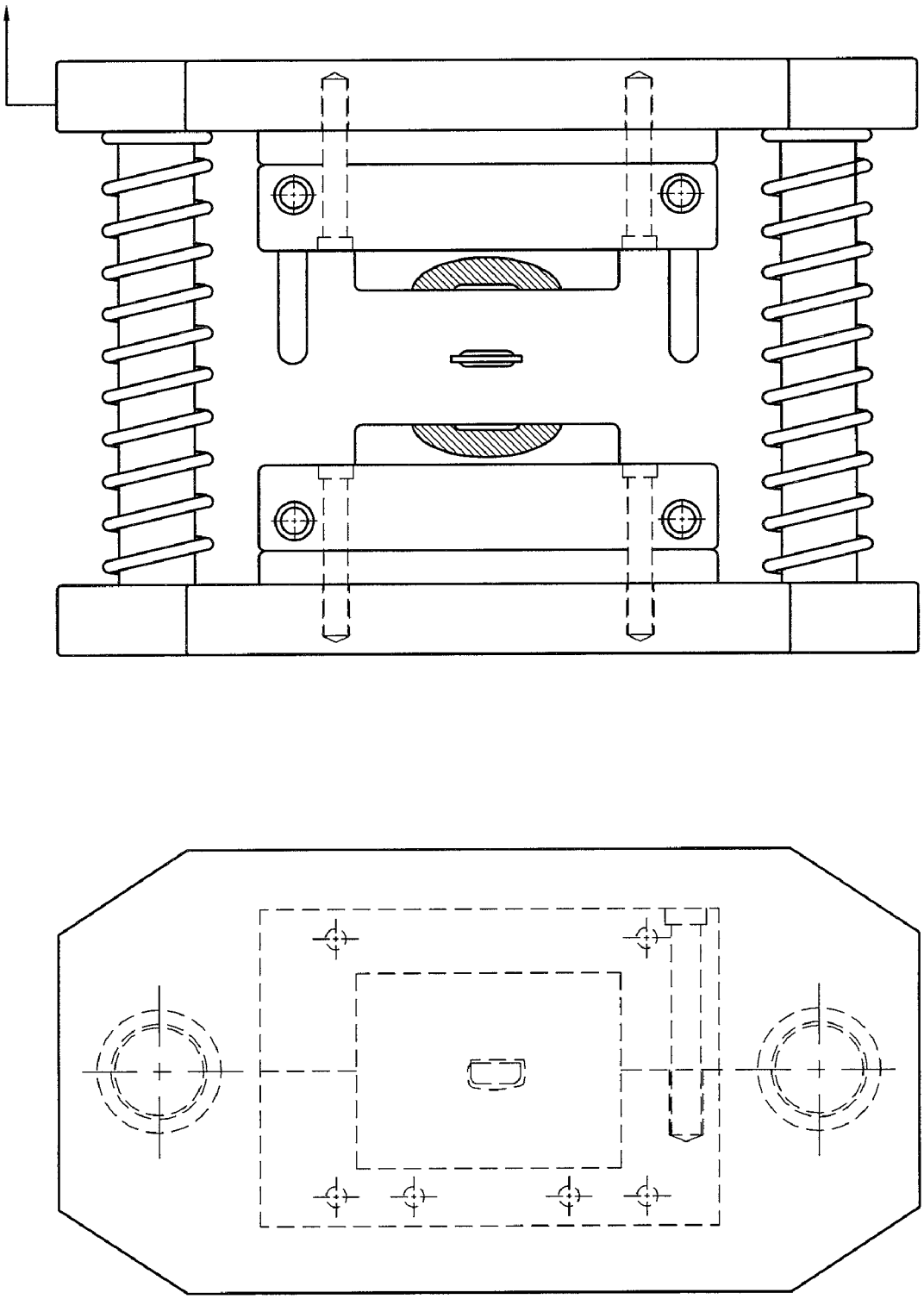
Figure 23:
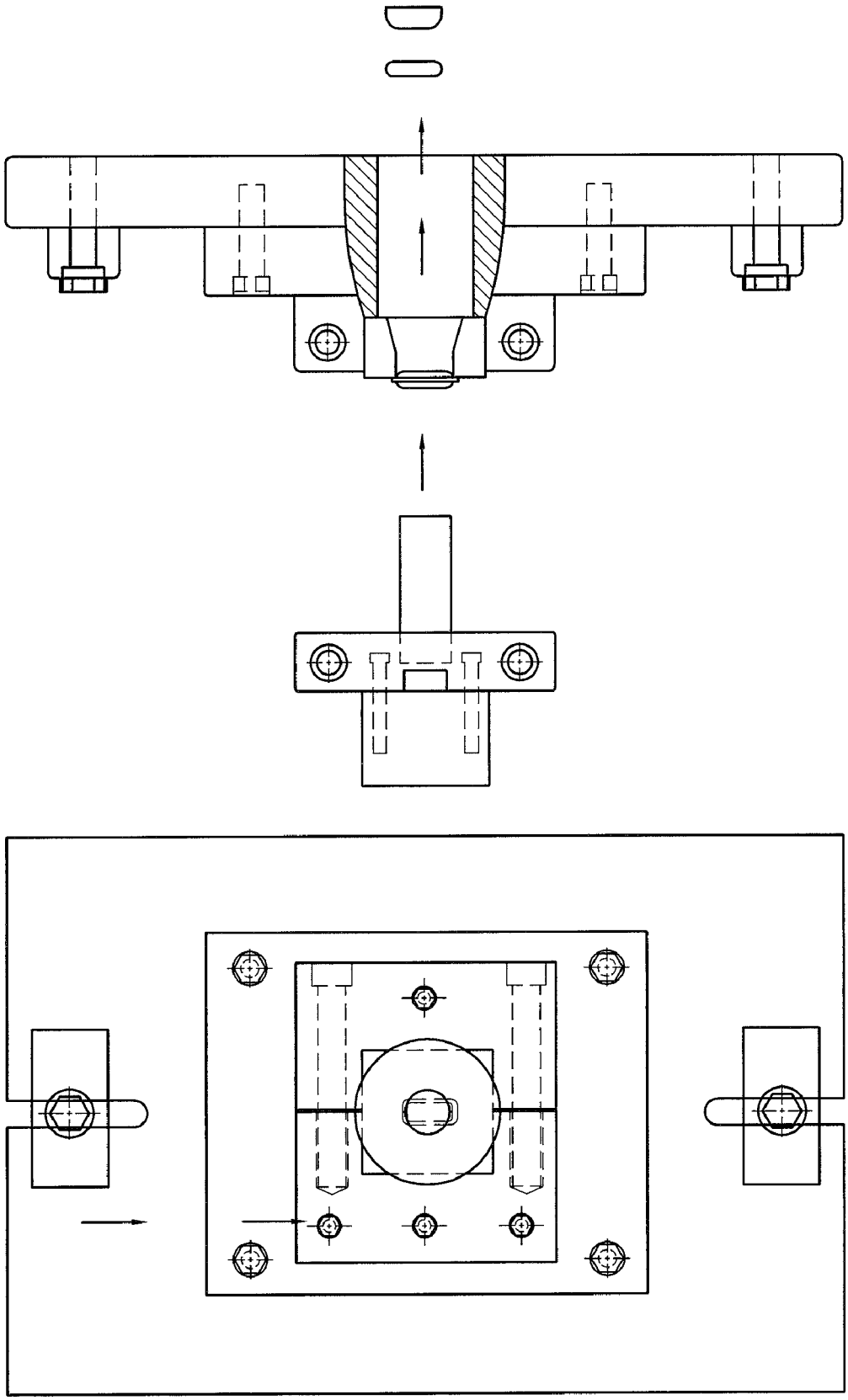

FIGS. 15 to 36 illustrate the steps of producing some of the components of the units as described above. In particular, FIGS. 15 to 19 illustrate the steps of producing a side member, e.g. the side member 160. The left side of FIG. 15 is a schematic top view of a cutting machine 900 while the right side of FIG. 15 is a schematic side view of the cutting machine 900. It is shown that a steel plate 902 which is relatively thick is passed through a lower station 904 of the cutting machine 900. The lower station 904 is provided with a mold 912 above which the steel plate 902 passes. The lower station 904 is also provided with a pressure plate 914 which together with the mold 912 sandwiches the plate 902 as it passes through the lower station 904. An upper station 906 provided with an appropriate cutter 908 is then moved downwardly towards the lower station 904 cutting a steel member 910 from the steel plate 902. The steel member 910 is then discharged from the cutting machine 900. The steel member 910 is slightly larger than the size of the side member 160 to be manufactured. As shown in FIGS. 16 and 17, the steel member 910 is then subject to molding such that it will acquire the desired shape and configuration. This is achieved by placing the steel member 910 between an upper station 916 and a lower station 918 of a molding machine 920, and the stations 916, 918 are then pressed together. The steel member 910 is then further refined by trimming off unwanted edges thereof. As shown in FIG. 18, this is done by placing the molded steel member 910 between an upper station 922 and a lower station 924 of an edge-trimming machine 921 and cutting away any unwanted edges which may exist. In particular, a suitable edge-trimming mold 928 is used. FIG. 19 shows schematic side top views of the trimmed steel member, e.g. the side member 160. Before the side member may be used, an appropriate cavity is to be produced therein. The cavity is similar to for example the cavity 194 of the link 118.

Figure 24:
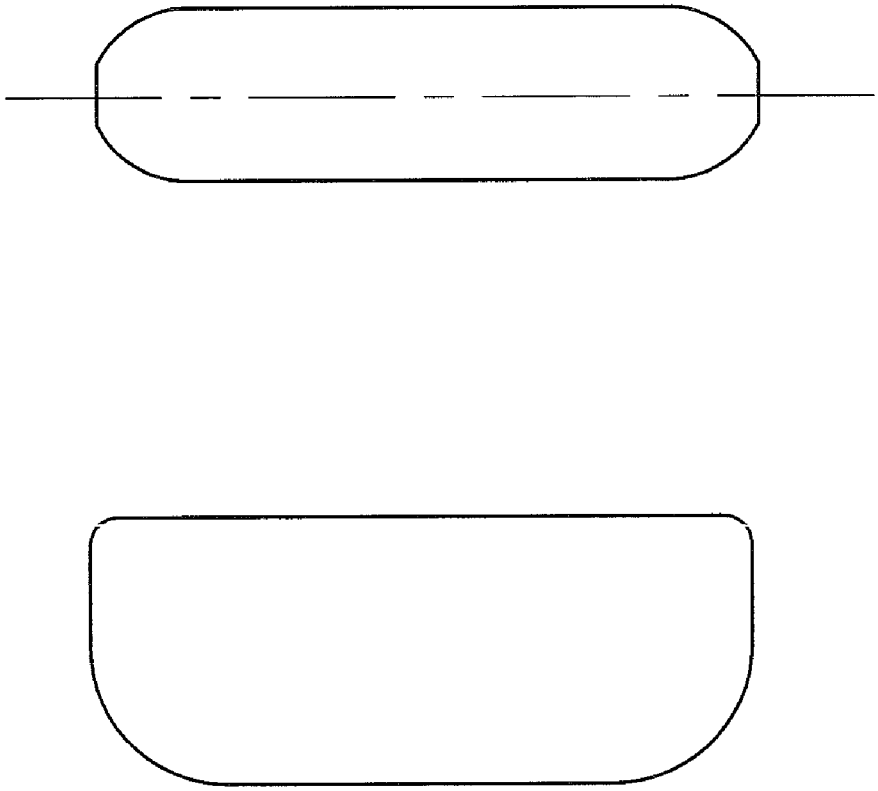

FIGS. 20 to 24 illustrate the steps for producing an actuator, e.g. the actuator 166 of the link 118. As shown in these figures, the production of the actuator is similar to the production of the side member, and description thereof is not repeated here. FIG. 24 shows schematic side top views of the actuator.

Figure 25:
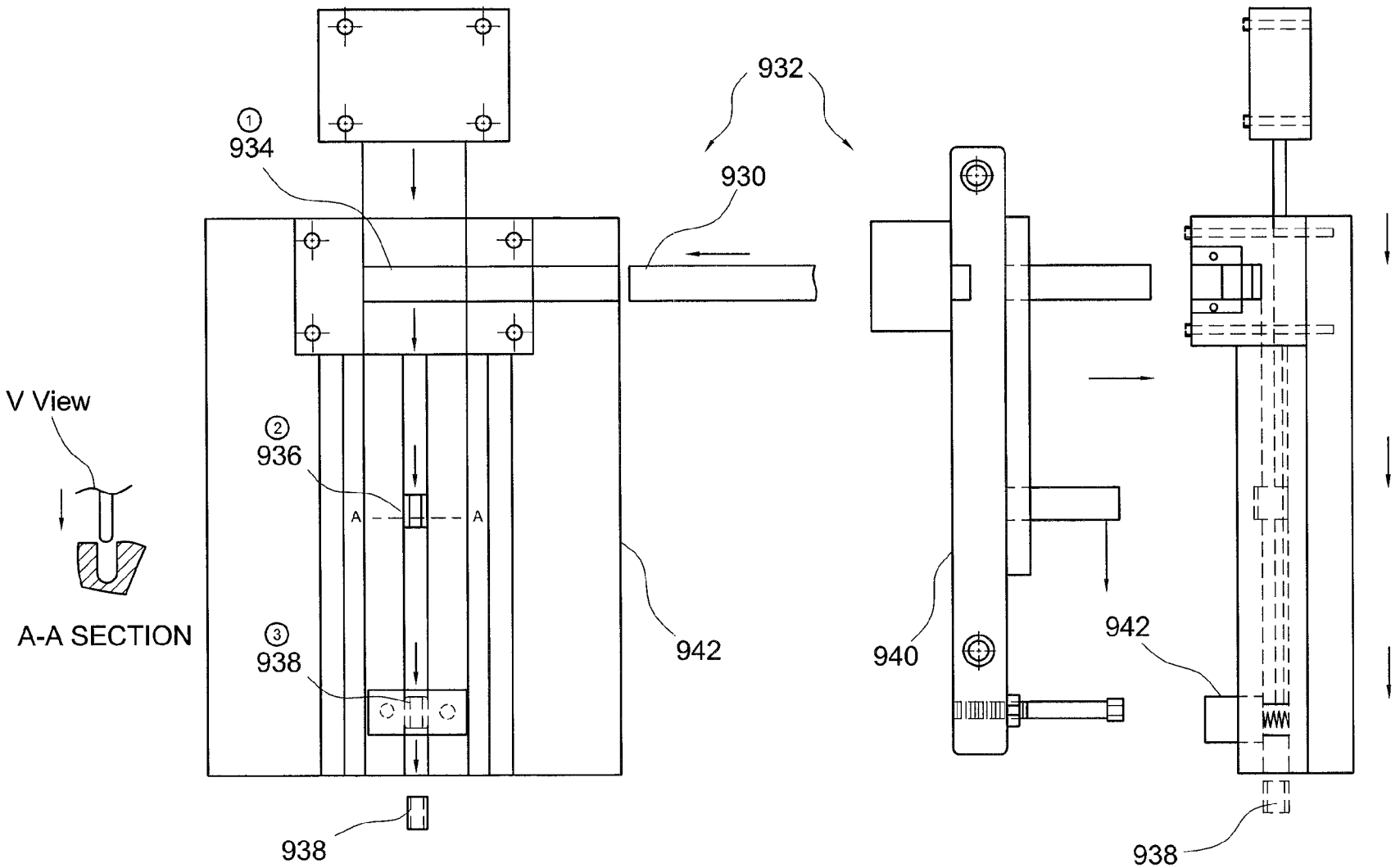
FIGS. 25 to 26 are a series of schematic diagrams illustrating production of a side member of a link from a steel sheet.
Figure 26:
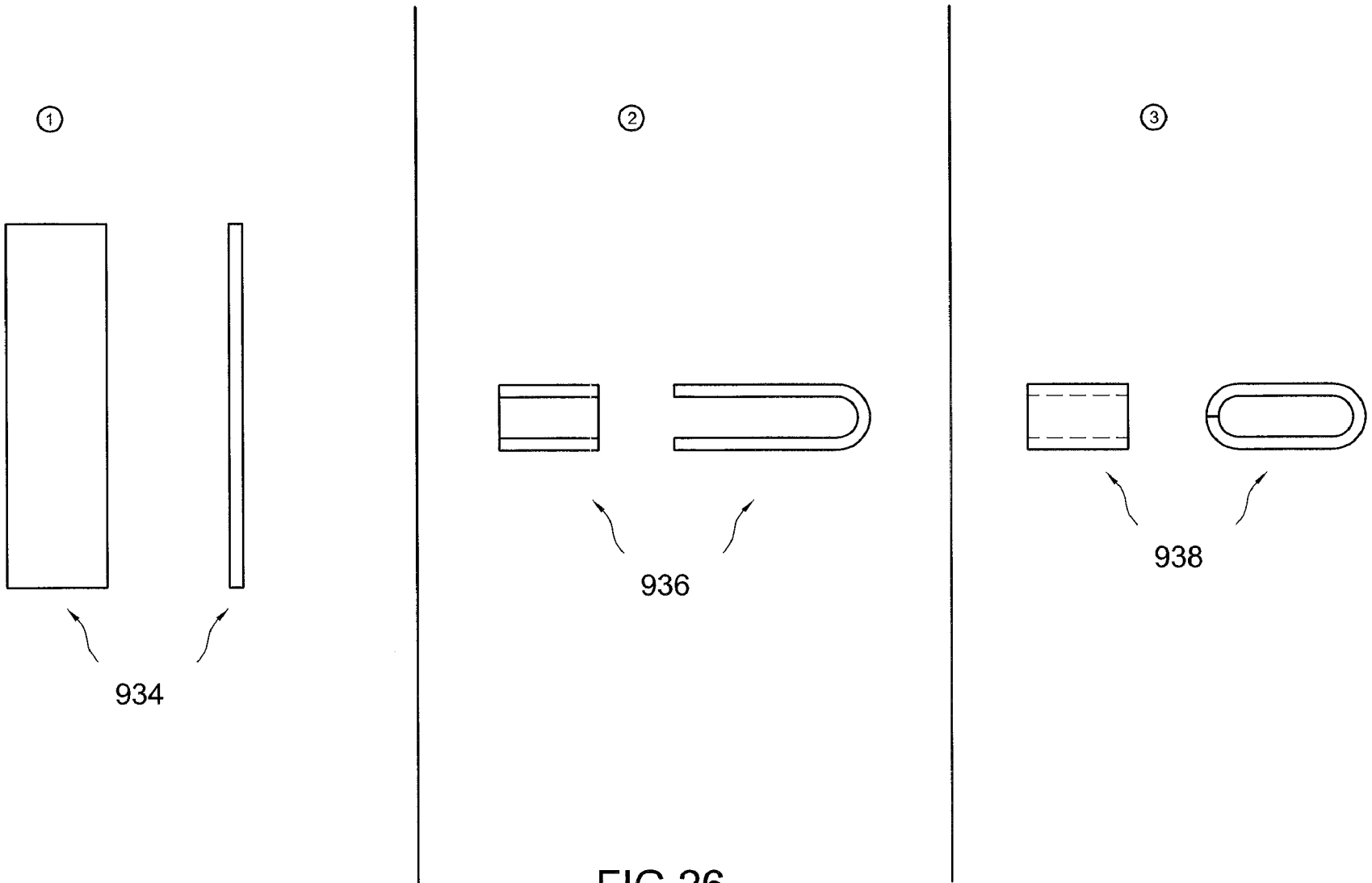
Figure 27:
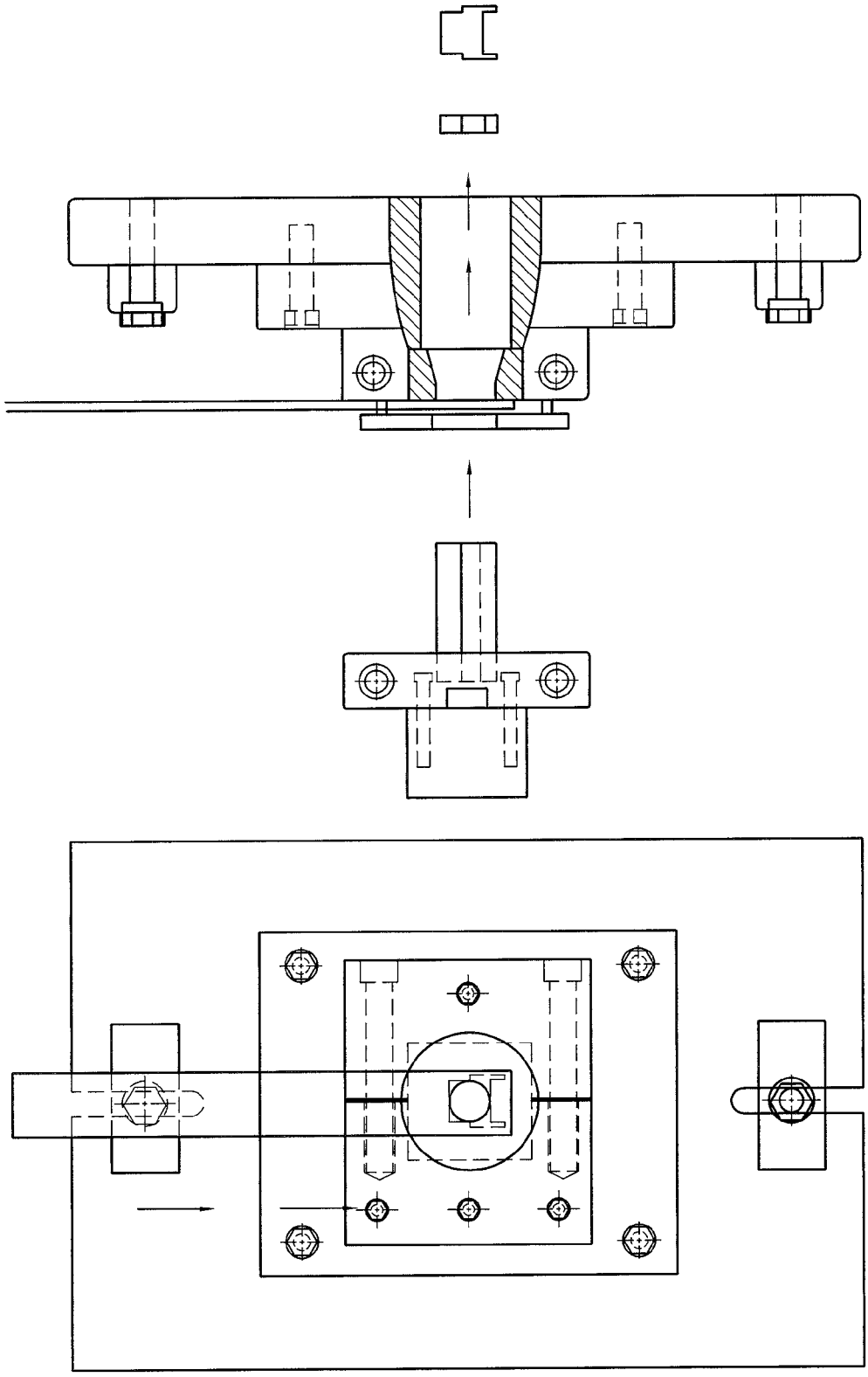
FIGS. 27 to 31 are a series of schematic diagrams illustrating production of a middle component of a link of the wristwatch of FIG. 1.
Figure 28:
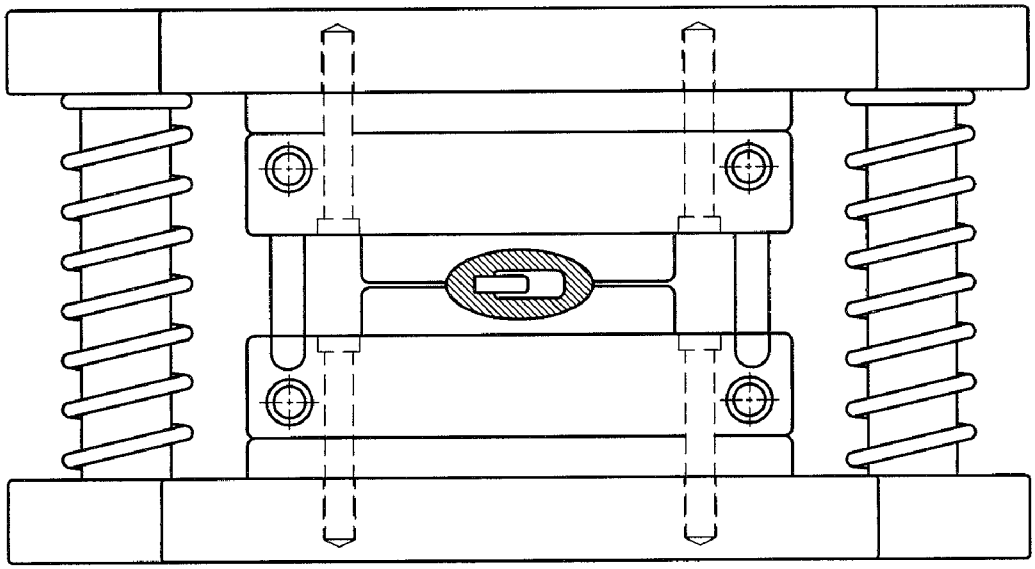
Figure 28:
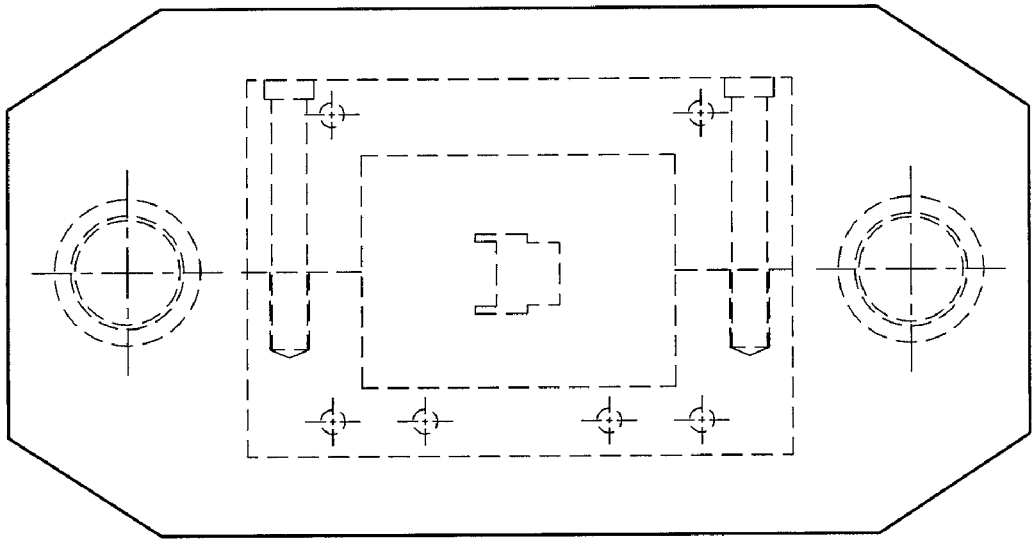
Figure 29:
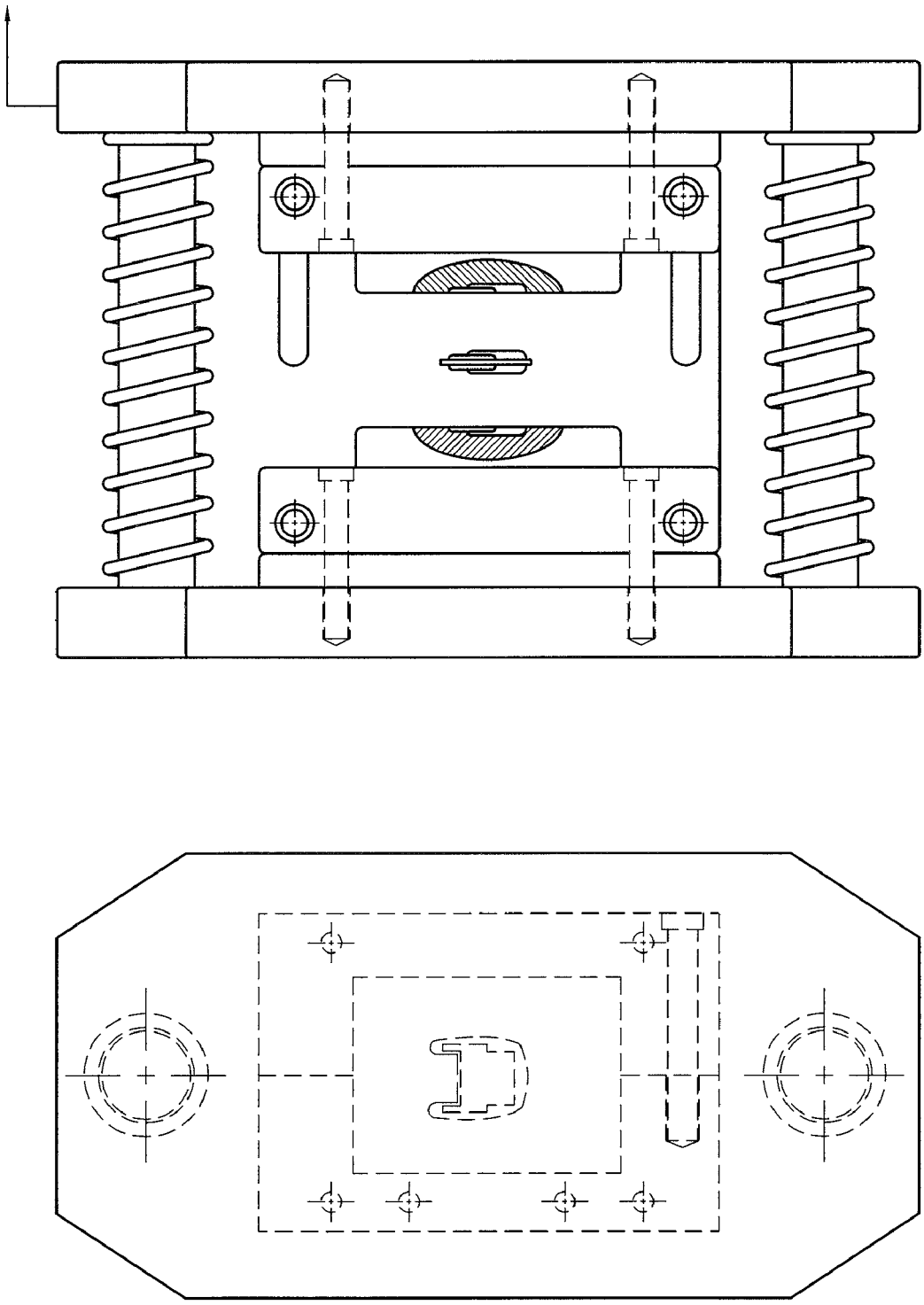
Figure 30:
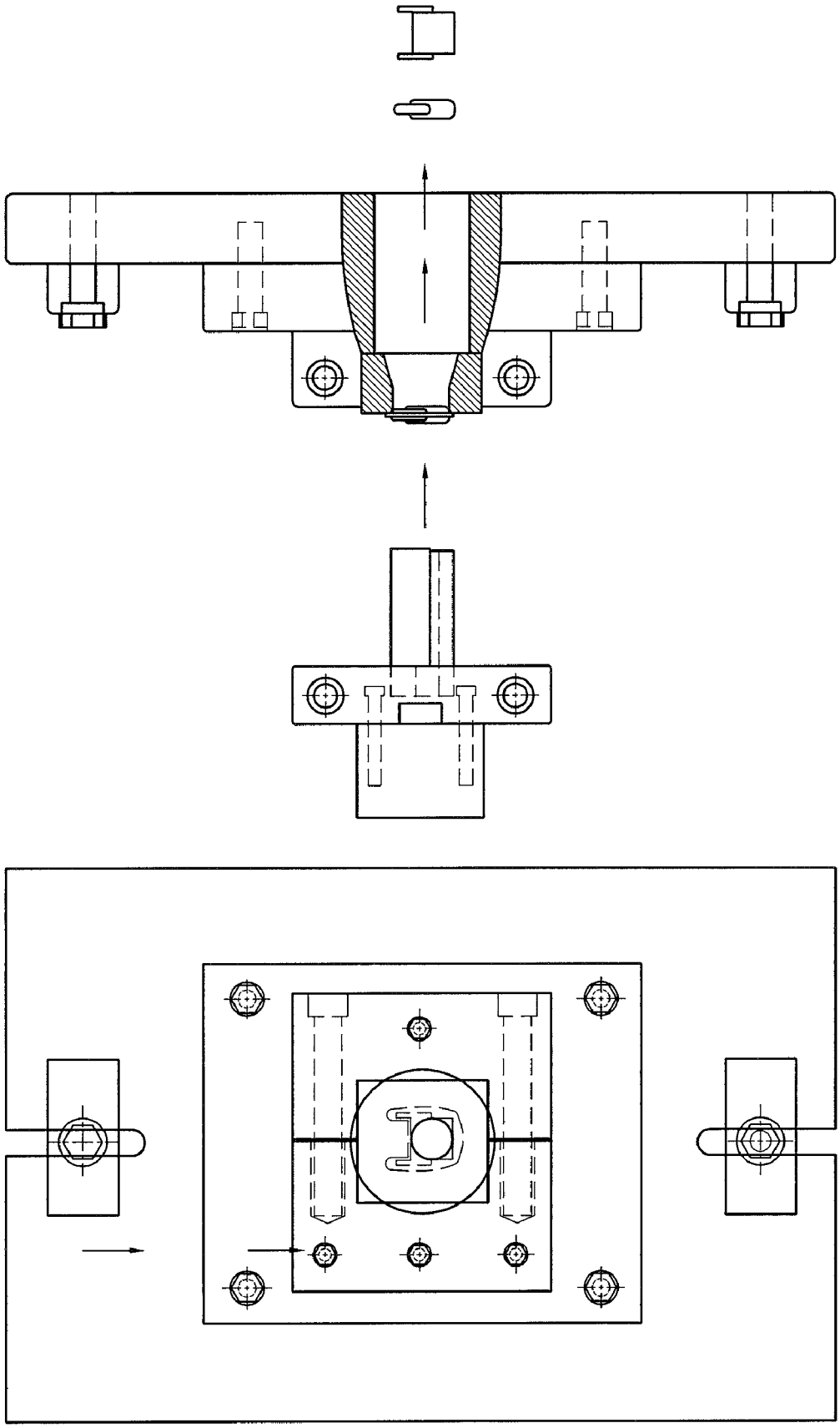

FIGS. 25 and 26 illustrate the production of a side member 938 of a link (e.g. the link 118). Unlike the production of the side member illustrated in FIGS. 15 to 36, the side member 938 is produced from a steel sheet 930. Due to the self-explanatory nature of the figures, detailed description of the steps involved is not repeated here.

Figure 31:
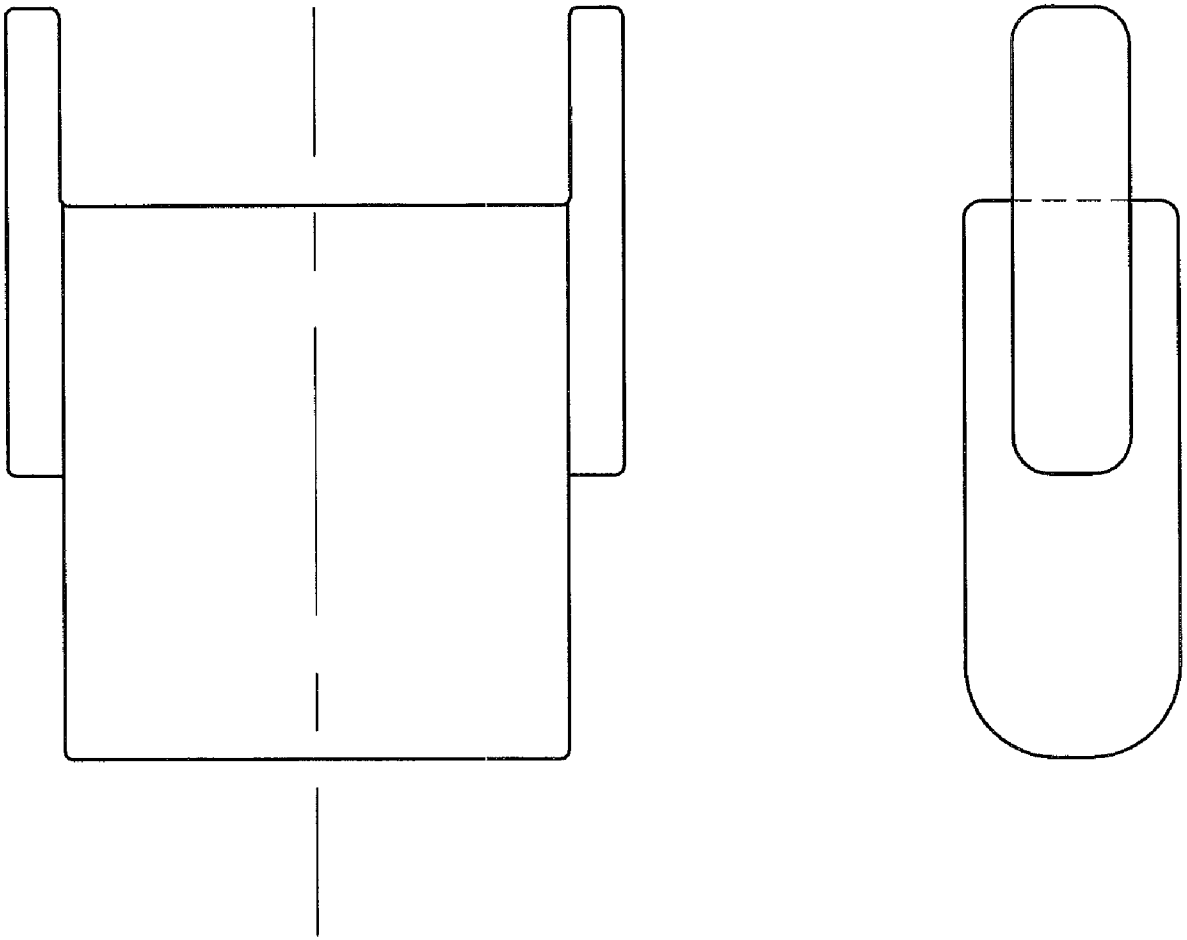

FIGS. 27 to 31 illustrate the steps for producing a middle member, e.g. the middle member 164 of the link 118. As shown in the figures, the production of the middle member is similar to the production of the side member 160, and description thereof is not repeated here. FIG. 31 shows a side view and a top view of the middle member. However, before the middle member can be assembled with other components of a link, three channels, e.g. the channels 190, 192, 193, are to be formed therein. This may be done by drilling through the middle member.

Figure 32:
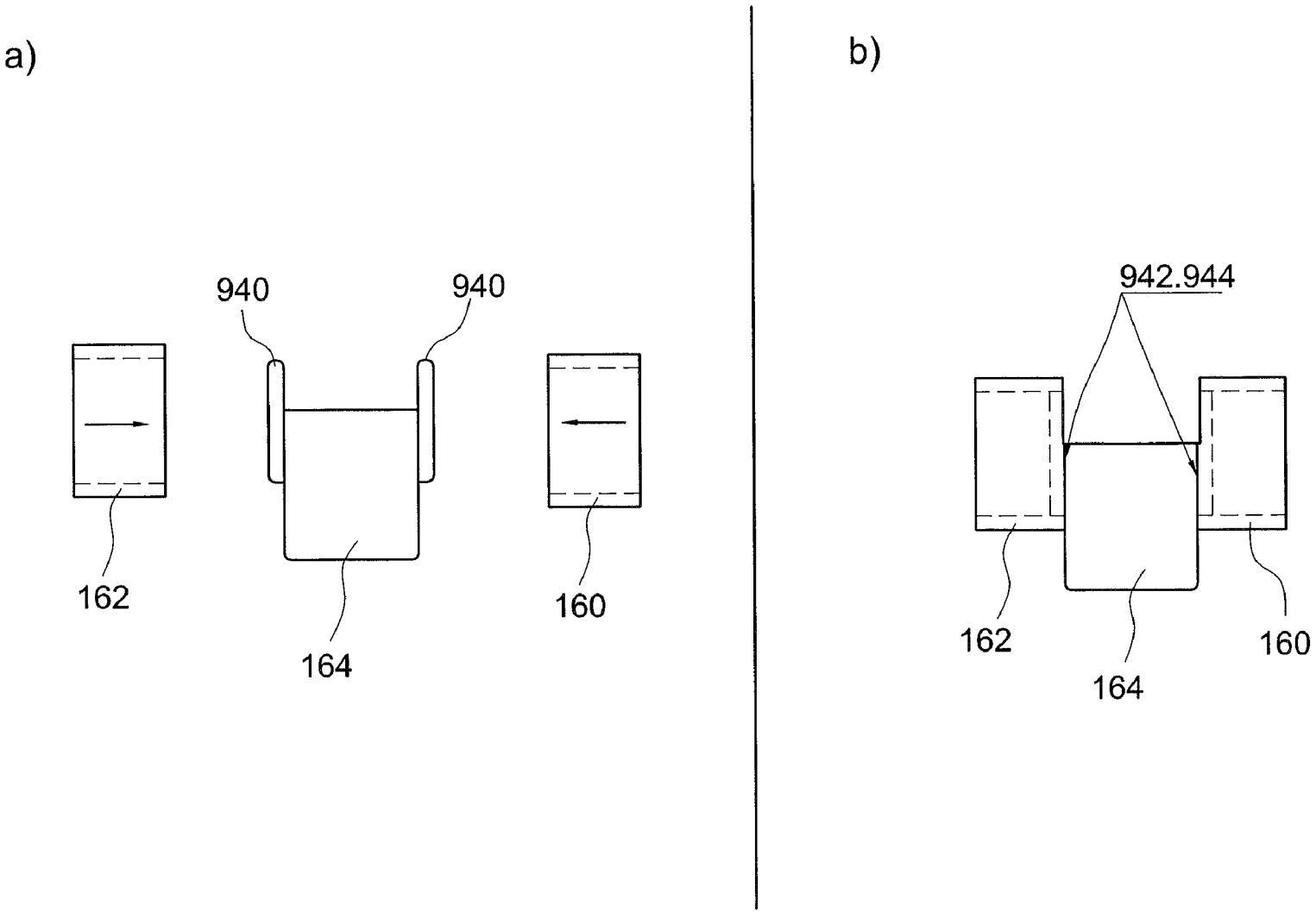
FIGS. 32 to 36 are a series of schematic diagrams illustrating assembly of components to form a link of the wristwatch of FIG. 1.
Figure 33:
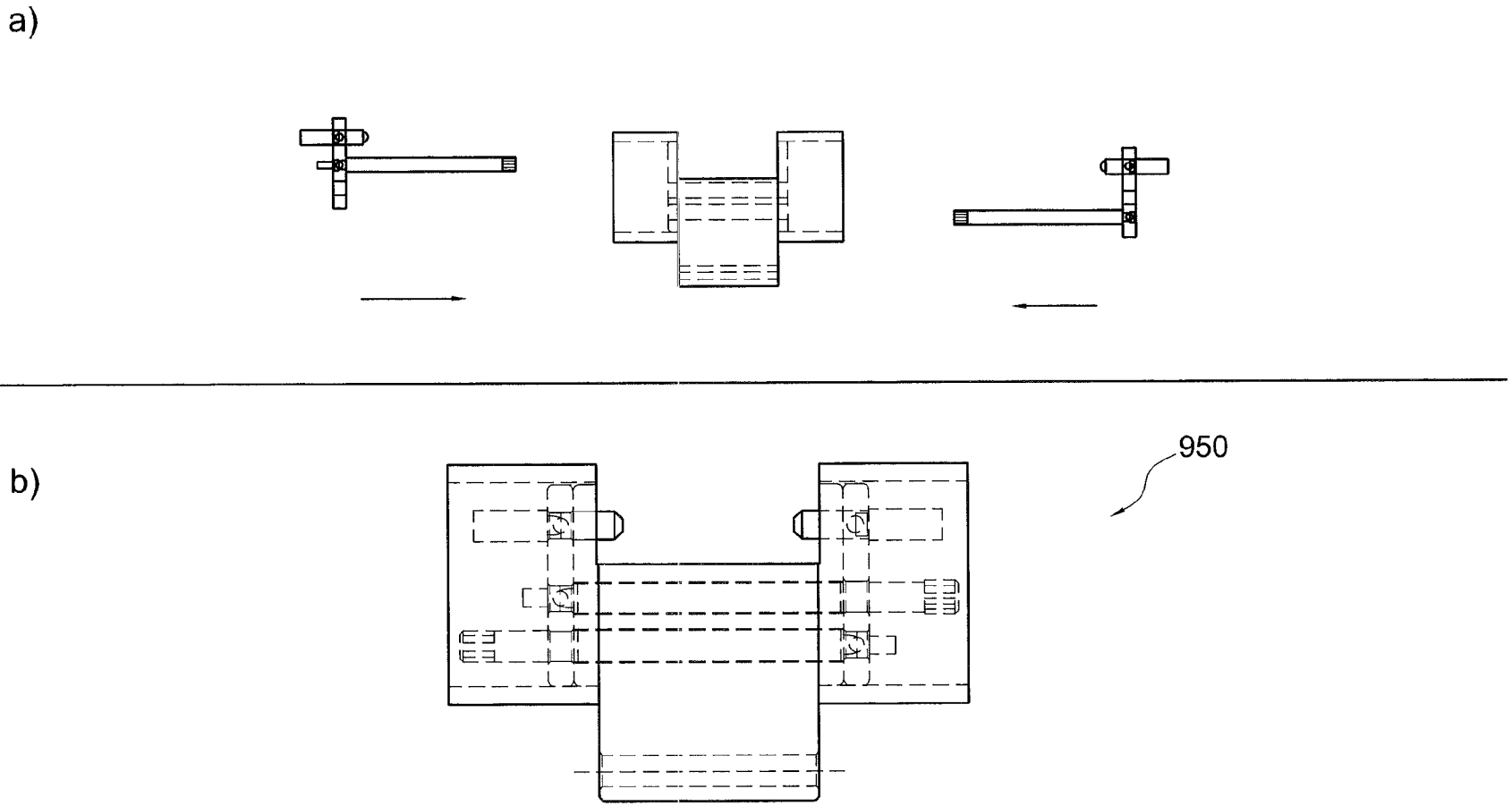
Figure 34:
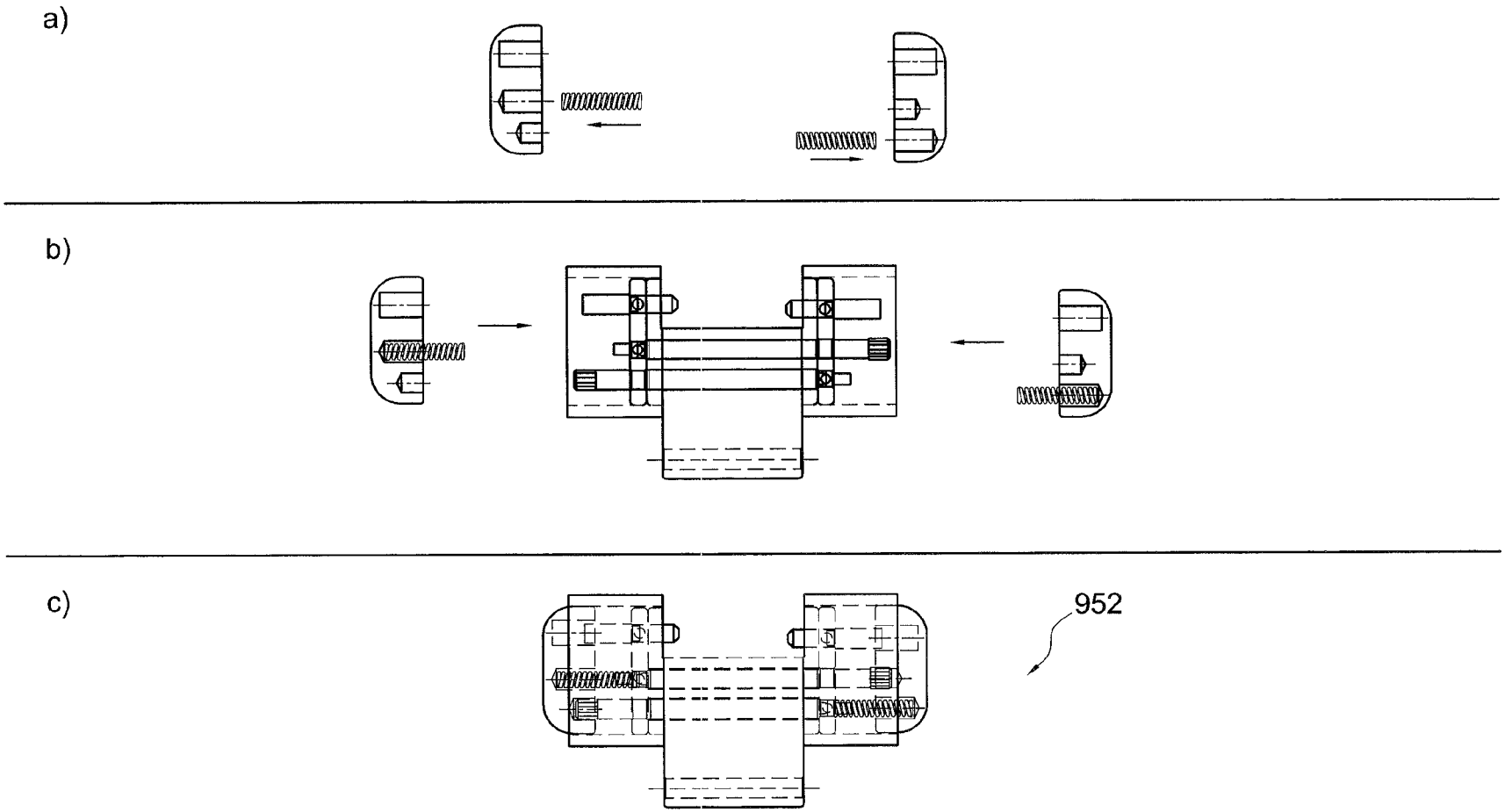
Figure 35:
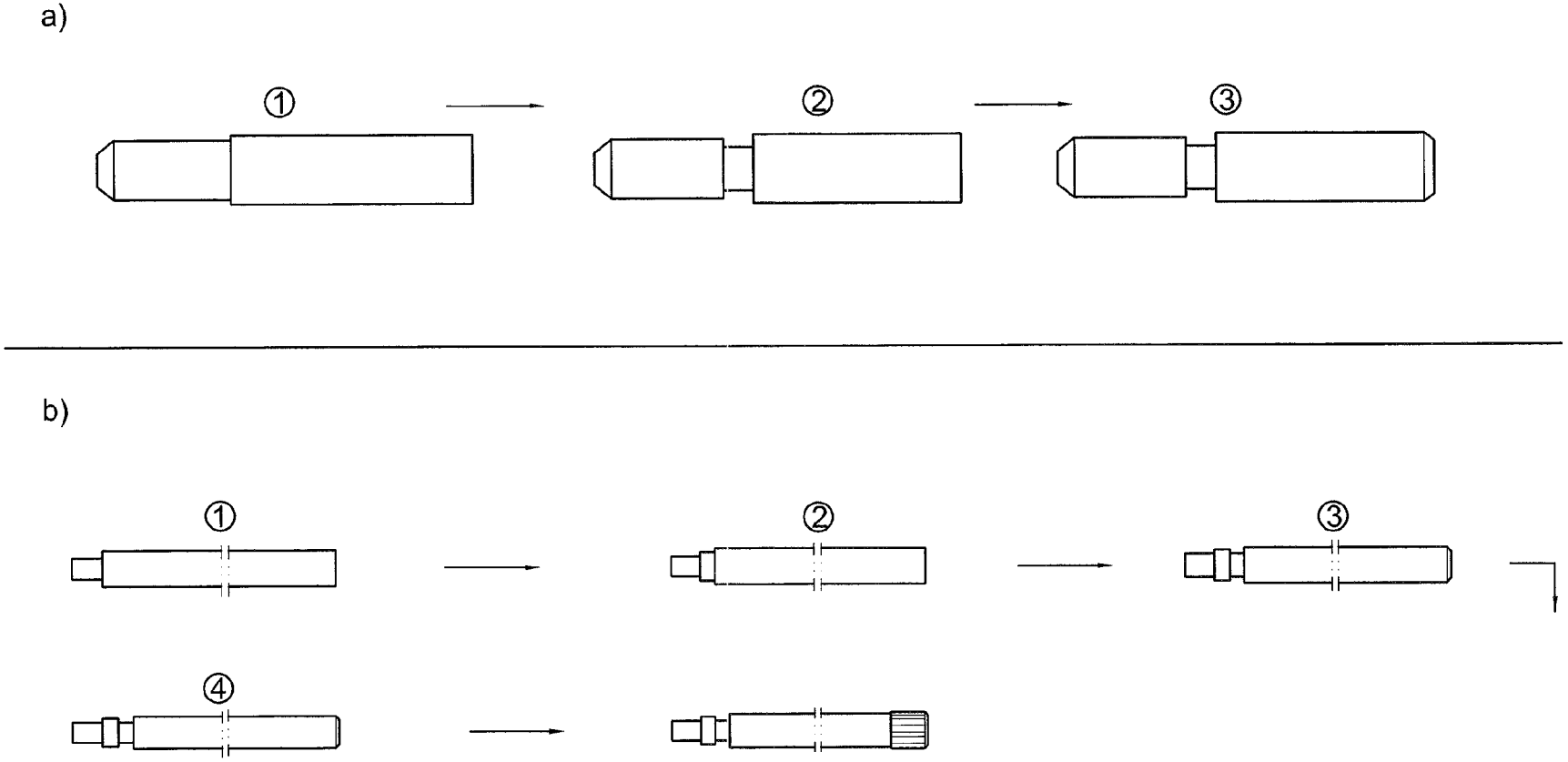
Figure 36:
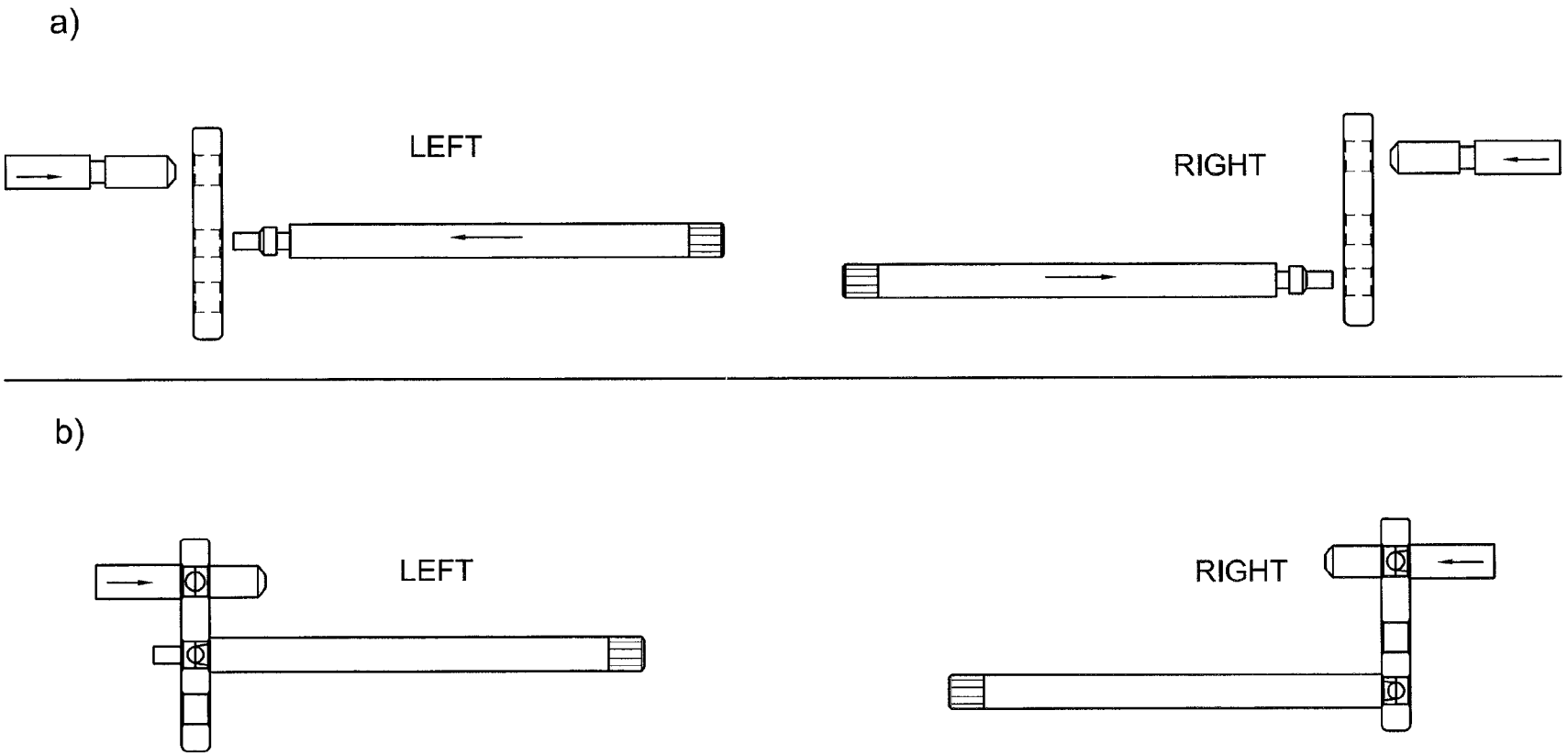

FIGS. 32*a* to 33*b* illustrate the steps of assembling the middle member (e.g. the middle member 164) with the side members (e.g. the side members 160, 162). FIG. 32*a* shows that the middle member is provided with two legs 940 on opposite sides thereof. The length of the legs 940 is about the same as the length of the cavity of the side members 160, 162 such that the legs are fittable with the cavity when the side members 160, 162 sandwich the middle member 164. After sandwiching the middle member 164 with the side members 160, 162, in order to secure them together, they may be welded together at points 942, 944. Pins (e.g. the pins 170, 172) and adapters (e.g. the adapters 182, 184) also serve as a securing means to secure the members together. In particular, as shown in FIG. 33*a*, the securing means comprises the adapter with the short pin secured to a first bore of the adapter and a long pin secured to a second or third bore of the adapter. The pins may be secured to the adapter by snap-fitting thereat. The long pins are then inserted to the first and second channels of the middle members from opposite sides via the cavity of the side members. Due to the size of the adapters they are fully receivable within the side members. It is however to be noted that the short pins in FIG. 33*a* is not identical to the pins 174, 176 in that they have circumferential tapered end while the pins 174, 176 has one tapered end facing outwardly, away from the member 118. FIG. 33*b* shows a semi-assembled link 950. To complete the production of the link, the actuators are to be fitted to the side members to cover up the cavity. This is done by firstly introducing a spring, (e.g. the spring 178, 180) to the second or third bore of the actuator, and secondly jamming the actuator together with the spring to the cavity such that it is tightly received in and remained with the side members although the actuator remains actuable on pressing thereof (see FIGS. 34*a* and *b*). As explained above, the presence of the spring biases the actuator to an outer position. FIG. 34*c* shows the assembled and operable link 952. FIG. 35*a* illustrate a series of steps for producing the short pin and the profile of the pin. In step 1 of FIG. 35*a*, an elongate metallic member is firstly prepared with an enlarged rear region and a narrower front region having a tapered front end. As shown in step 1, there is a raised edge on the member. The member is then subjected to further processing such that the portion next to the raised edge is etched forming a circumferential recess or a neck at that portion. Finally, the member is further processed by forming a circumferential tapered rear end of the member.

FIG. 35*b* shows a series of steps for producing the long pin. In step 1 of FIG. 35*b*, an elongate pin with a narrower front region is provided. The pin is then further processed by a further second and then a third step such that there is a longer narrow front region but with a slightly enlarged circumferential collar, see FIG. 35*b* step 4. The pin is then further processed such that the rear region is provided with a series of ribs running in a direction along the lateral length of the pin.

The combination of the profile of the adapter and the pins may be important for them to achieve their function such that the link is operable in accordance with its design. Referring to FIGS. 36*a* and *b*, the diameter of the front region and the rear region of the short pin is actually very slightly larger than that of the first bore of the adapter while the diameter of the neck is slightly smaller. It is envisaged that the pin is thus fittable and reliably secured to the adapter with the neck engaging the bore. To further reliably secure the pin with the adapter, after the pin is inserted at the adapter as shown in FIG. 36*b*, the region of the adapter at where the pins engage therewith may be hammered such that that region is slightly deformed and better engages with the pin.

The long pin may be secured to the adapter with the collar engaged in the (second or third) bore. Due to the slightly larger diameter of the rear region of the pin, the pin is prevented from further moving pass the adapter. However, the enlarged collar is sized to tightly fit within the bore. The pin may be further secured with the collar engaged with the bore by hammering that region of the adapter such that it is slightly deformed locking the pin at that position.

Figure 39:
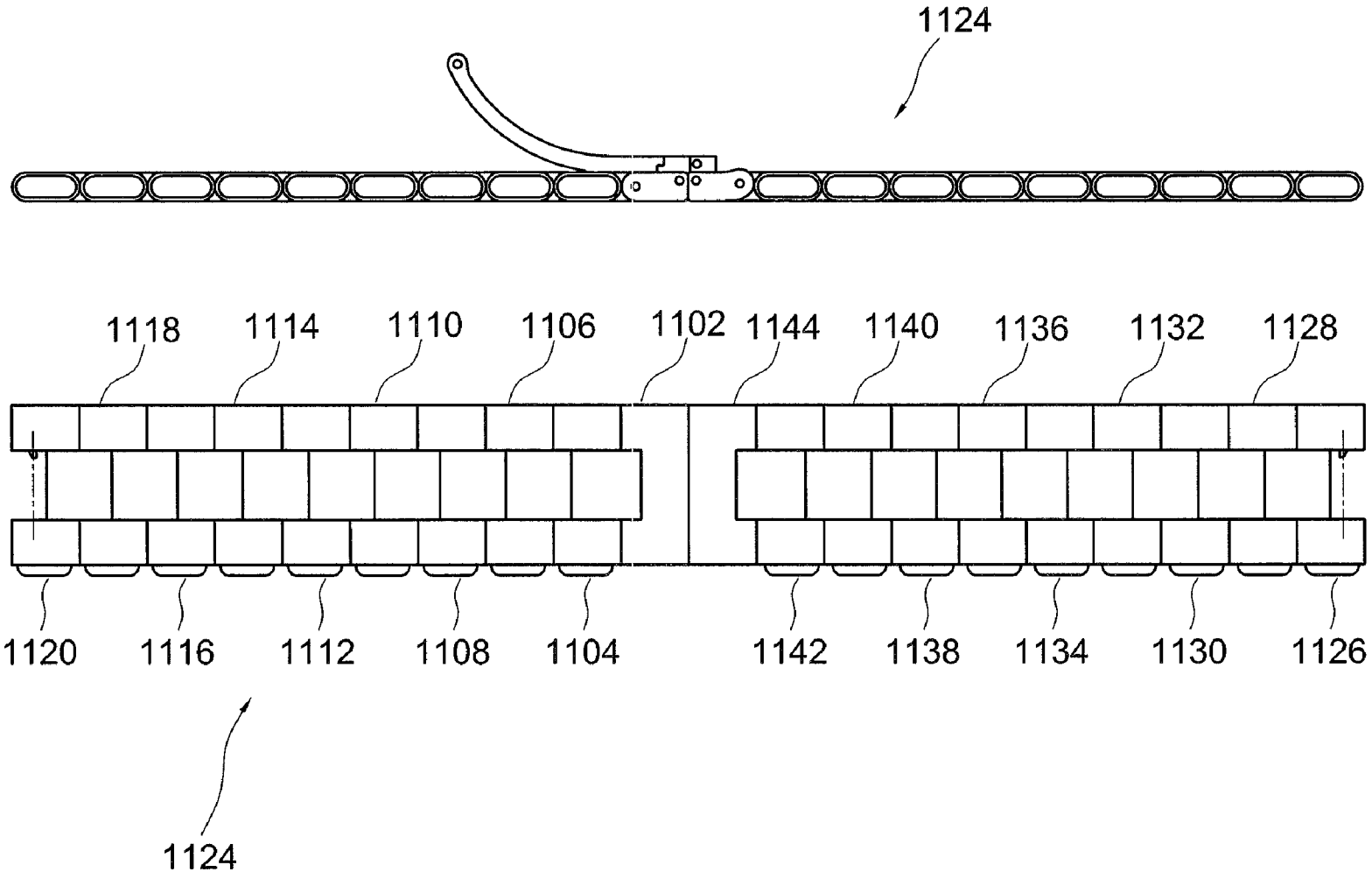
FIG. 39 shows a band for a wristwatch or the like according to an eleventh embodiment of the present invention.
Figure 40:
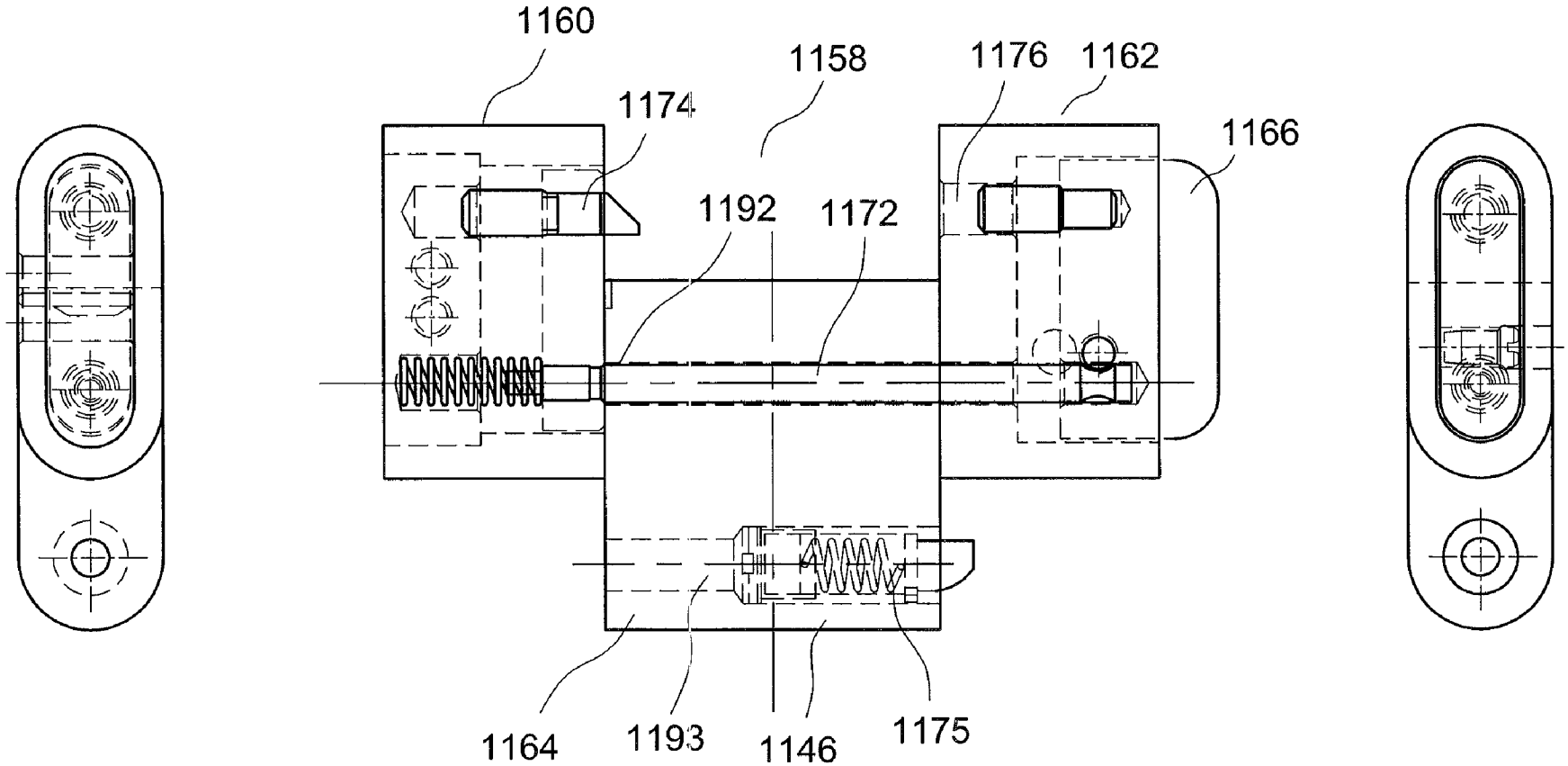
FIG. 40 includes three schematic diagrams illustrating the construction of a link of the band of FIG. 39, with an actuator provided on the right side thereof.
Figure 41:
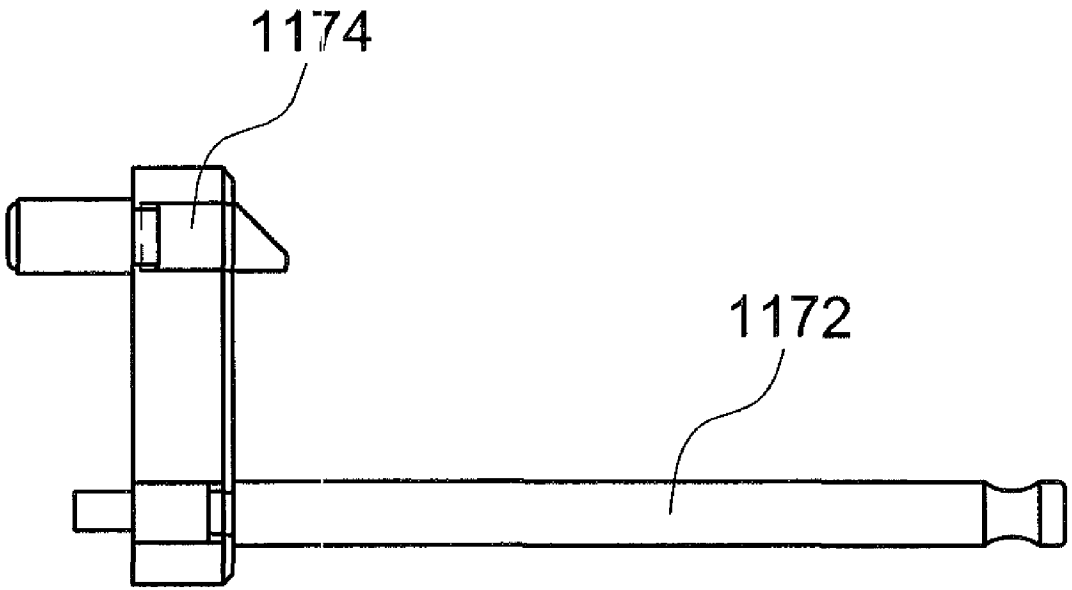
FIG. 41 shows a component of a connection mechanism of the link of FIG. 40.
Figure 42:
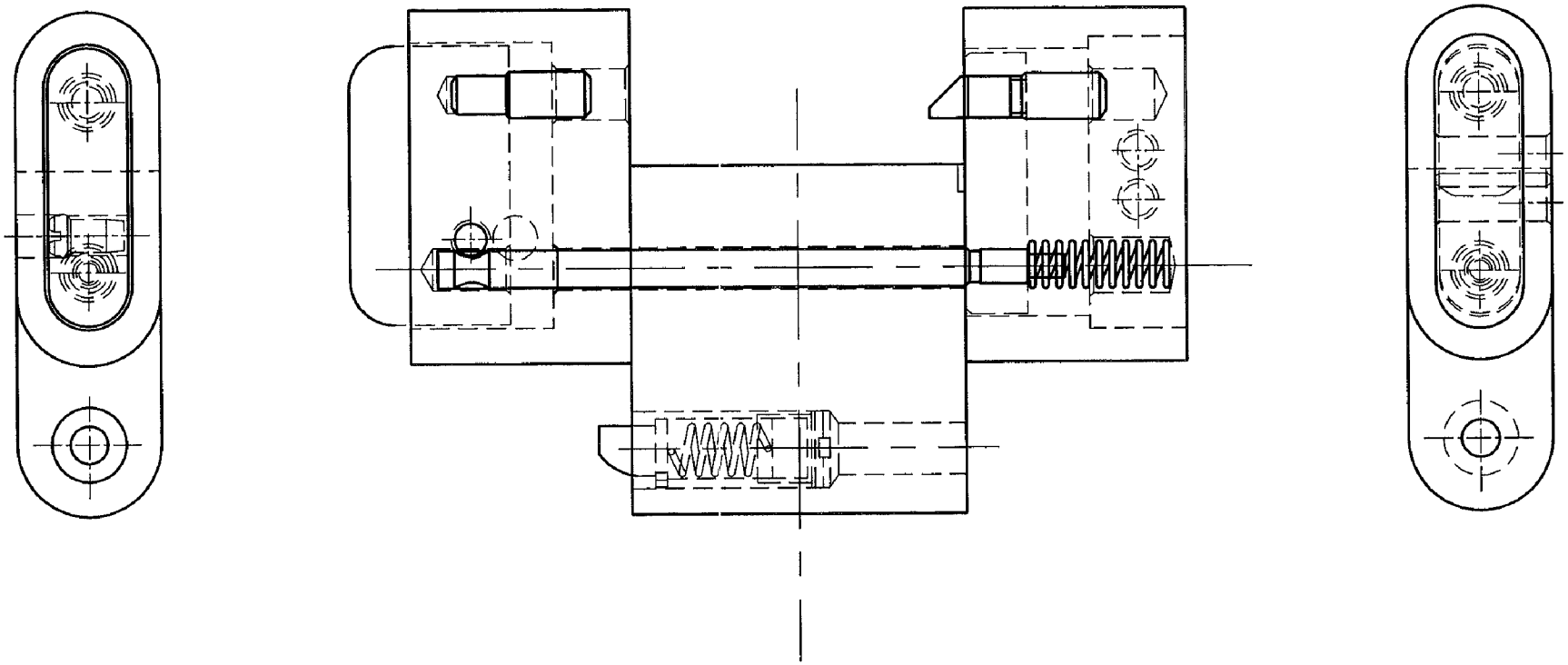
FIG. 42 is similar to FIG. 40, but with an actuator provided on the left side of the link.
Figure 43:
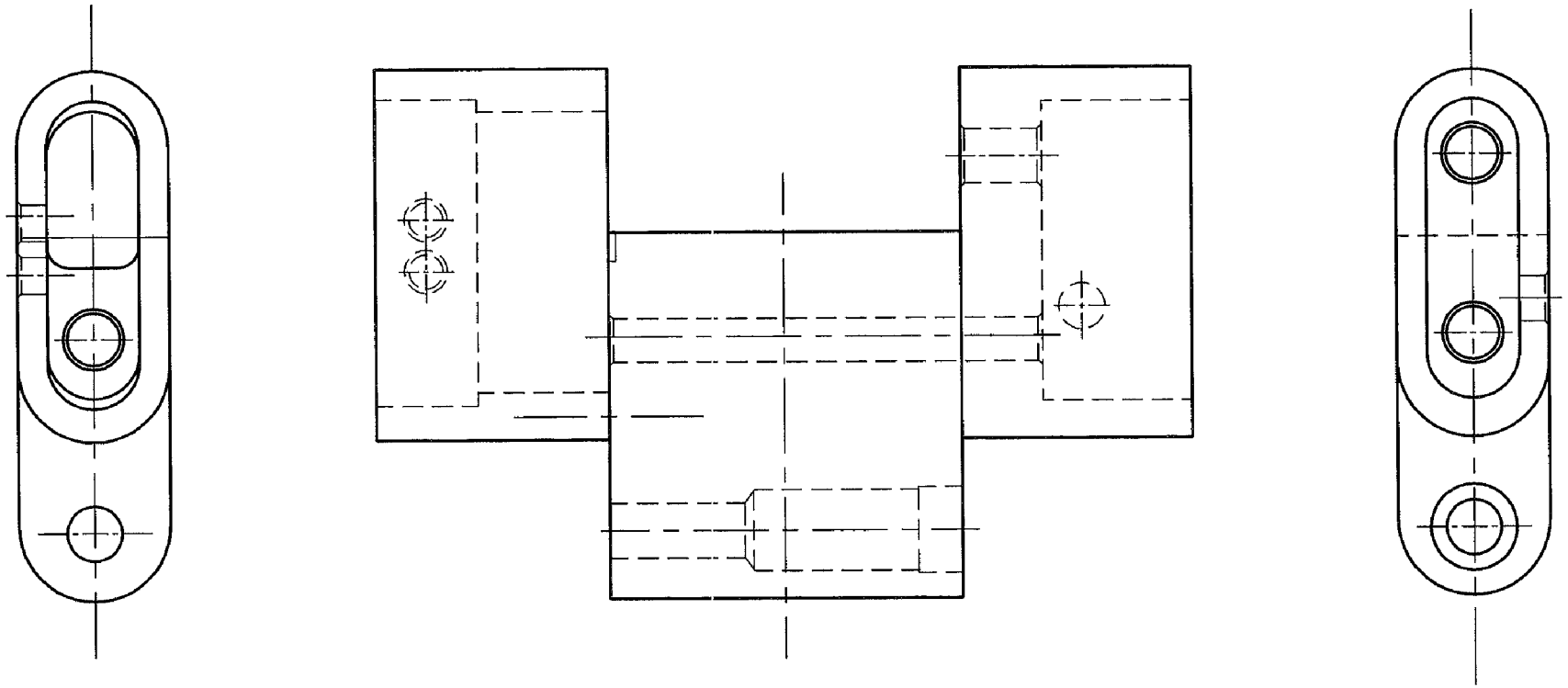
FIG. 43 illustrates the internal construction of the link of FIG. 40 but without the connection mechanism.
Figure 44:
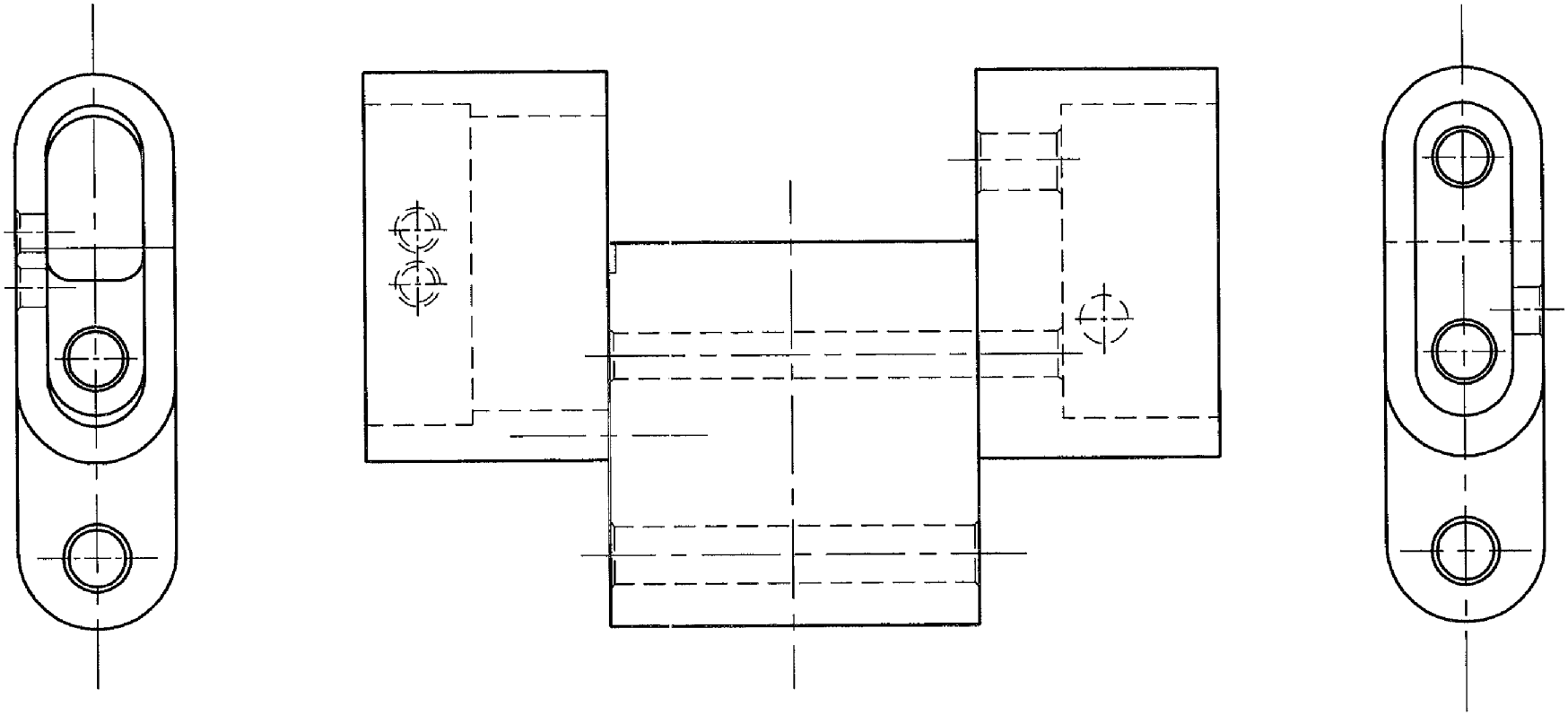
FIG. 44 illustrates a predecessor of the link of FIG. 43.
Figure 45:
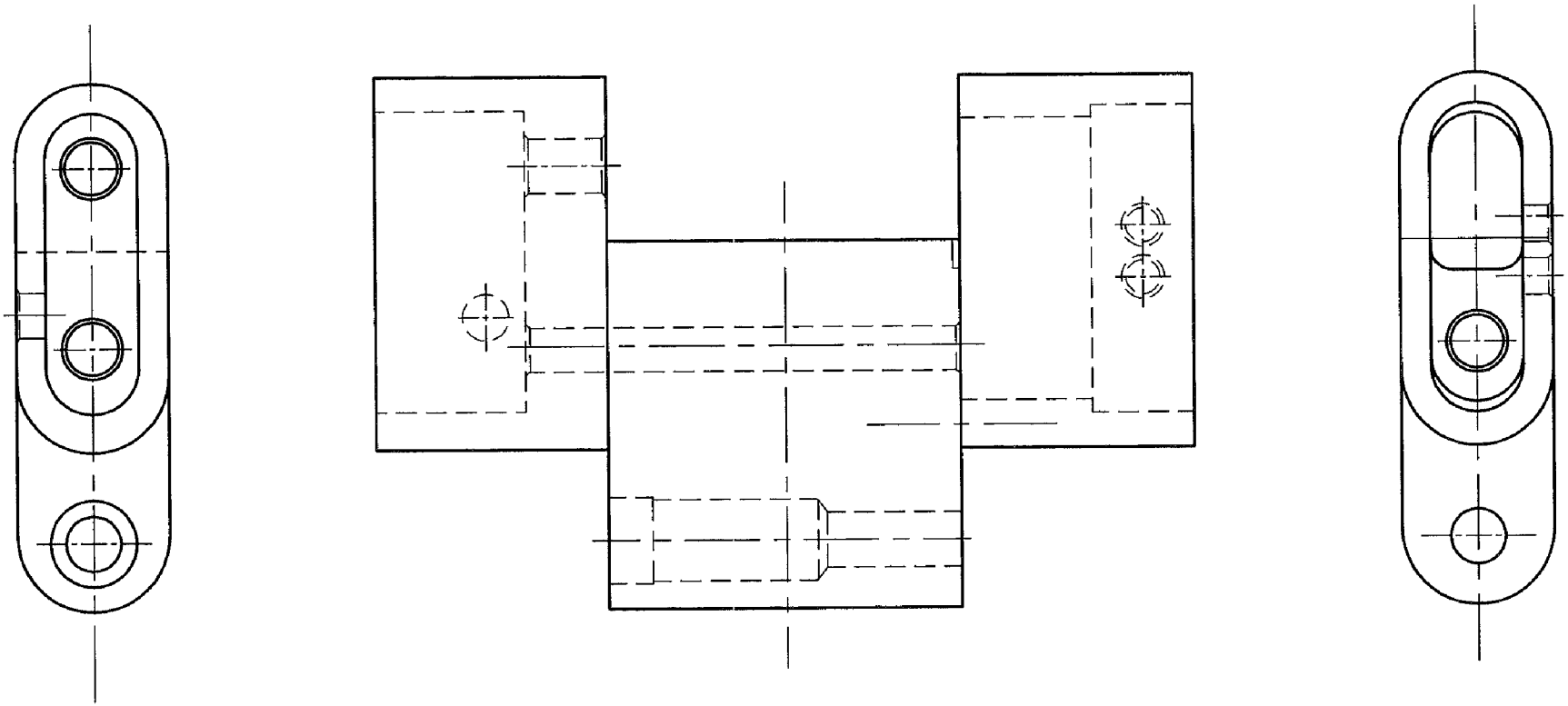
FIG. 45 illustrates the internal construction of the link of FIG. 42 but without the connection mechanism.
Figure 46:
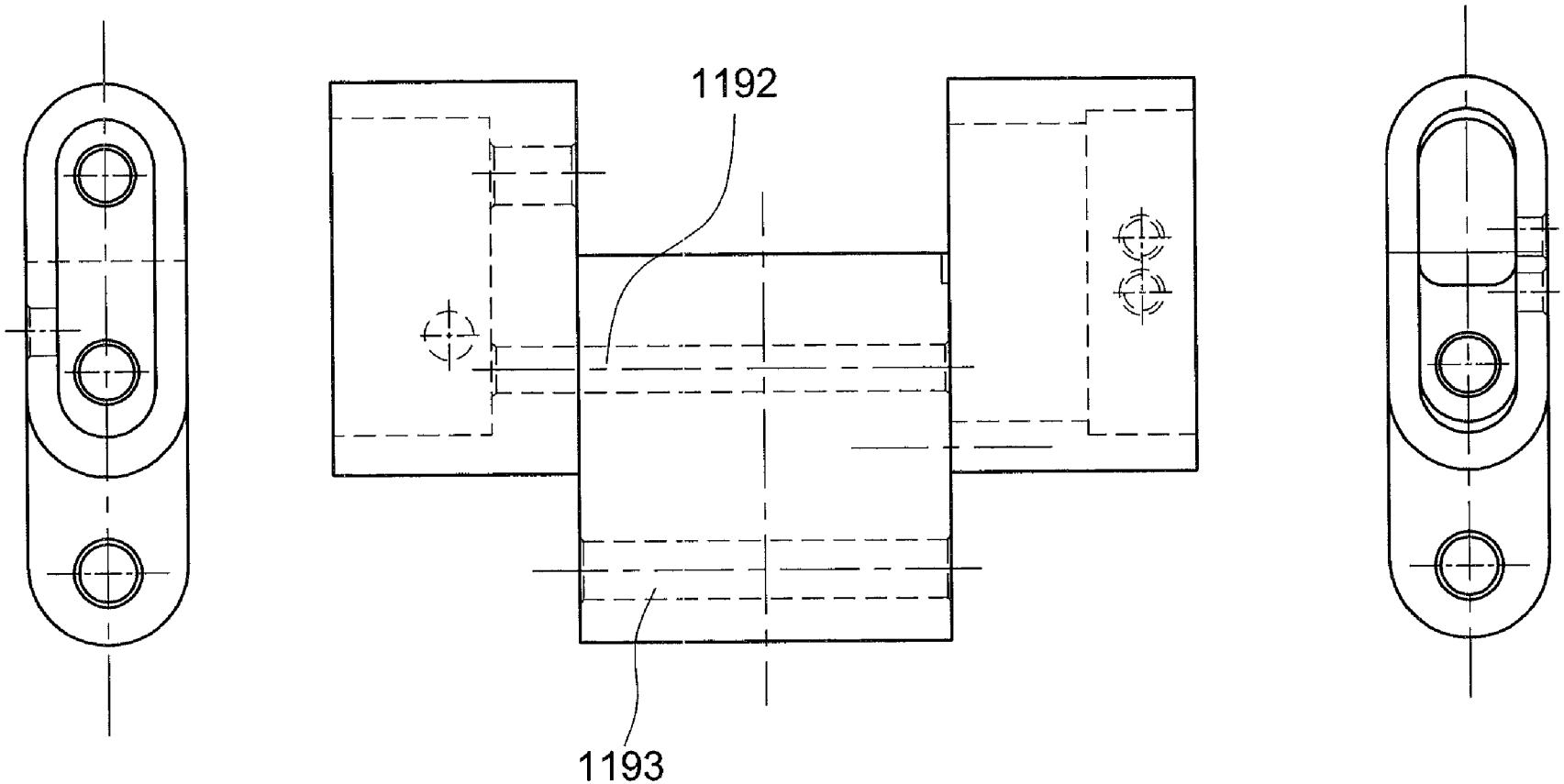
FIG. 46 illustrates a predecessor of the link of FIG. 45.
Figure 47:
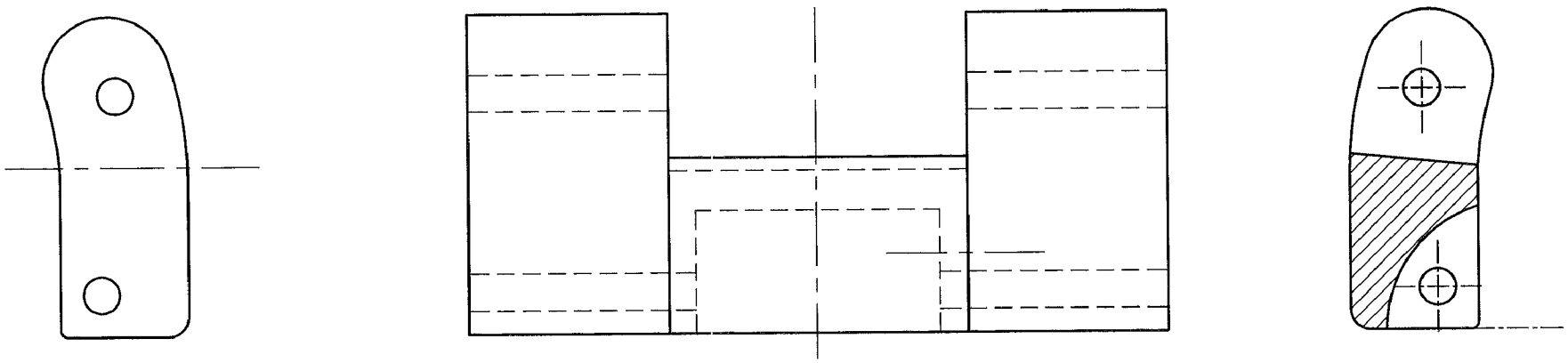
FIG. 47 shows an end link of the band of FIG. 39.
Figure 48:
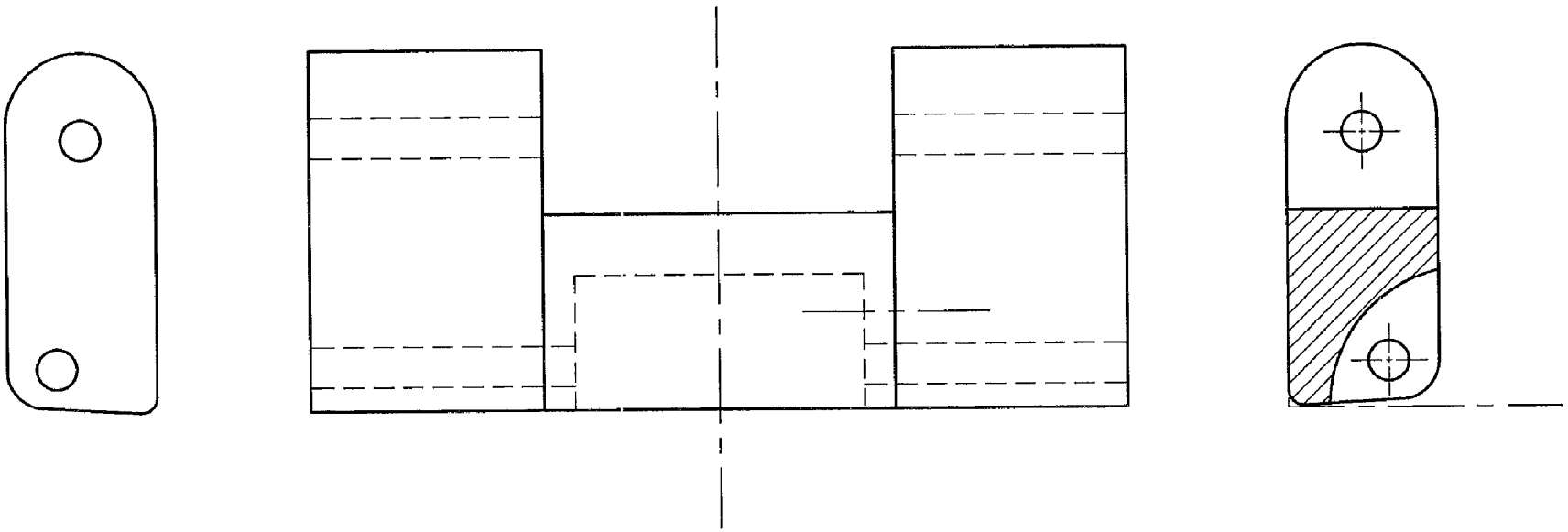
FIG. 48 shows an alternate end link of the band of FIG. 39.
Figure 49:
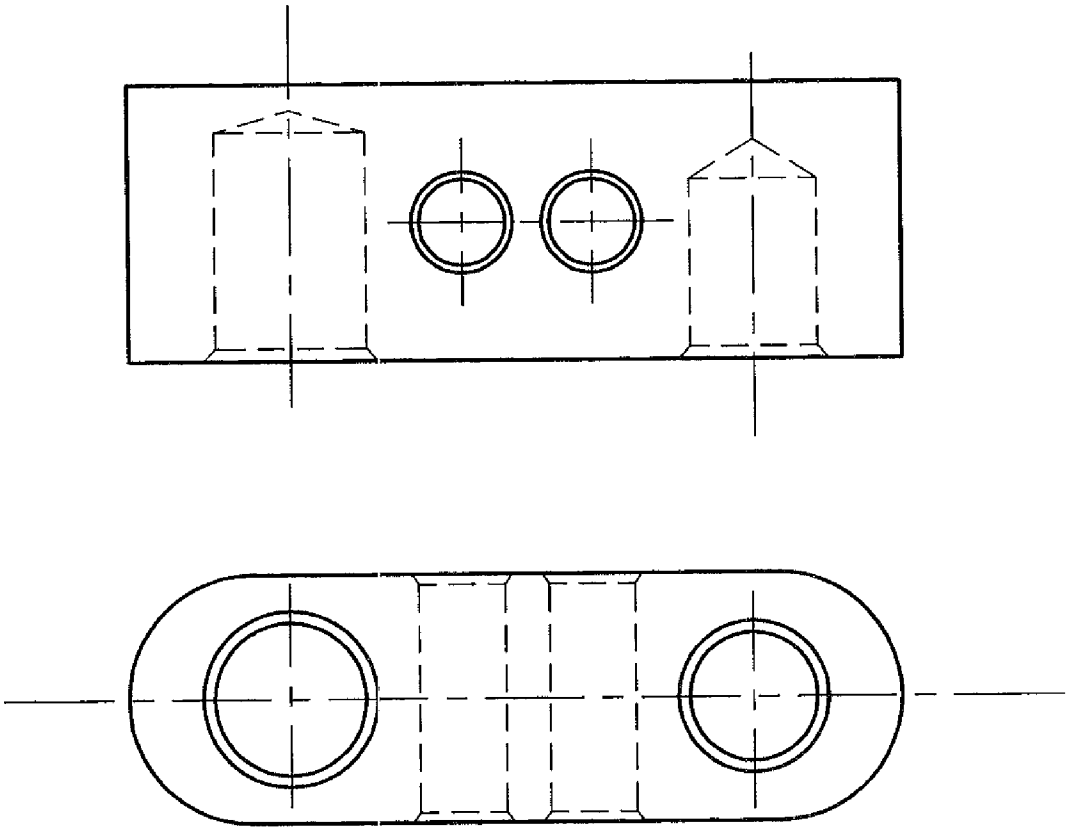
FIG. 49 and FIG. 52 show two components for use in the left side member of the link of FIG. 40 or the right side member of the link of FIG. 42.
Figure 51:
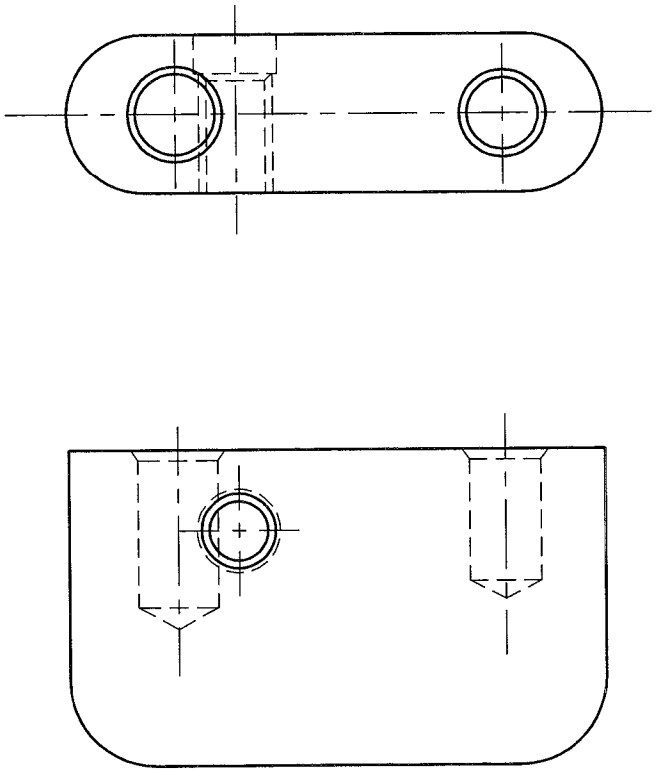
Figure 50:
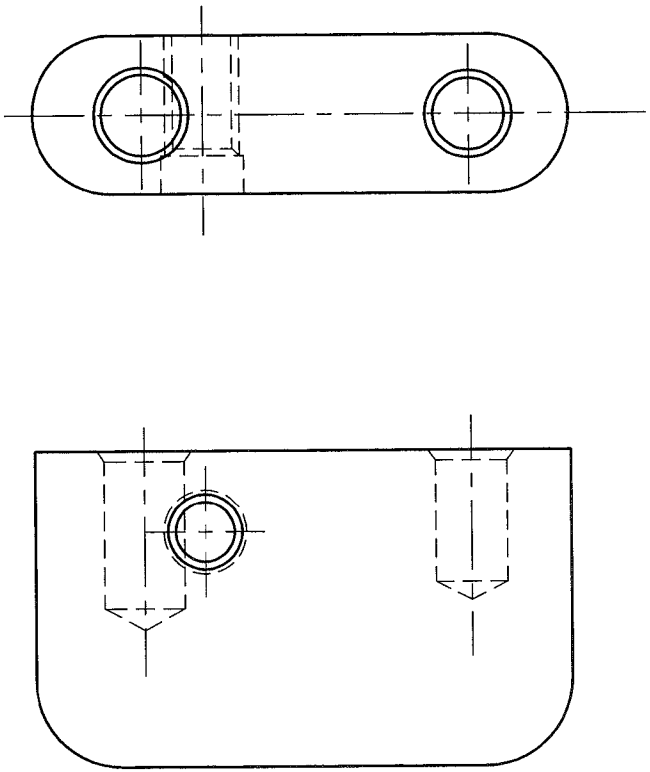
Figure 52:
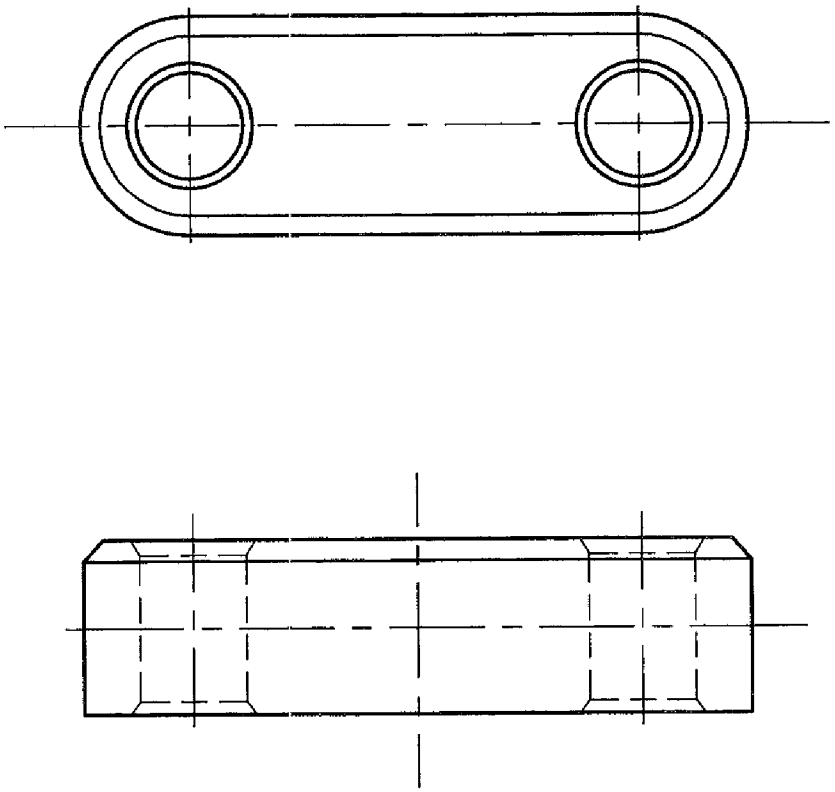
Figure 53:
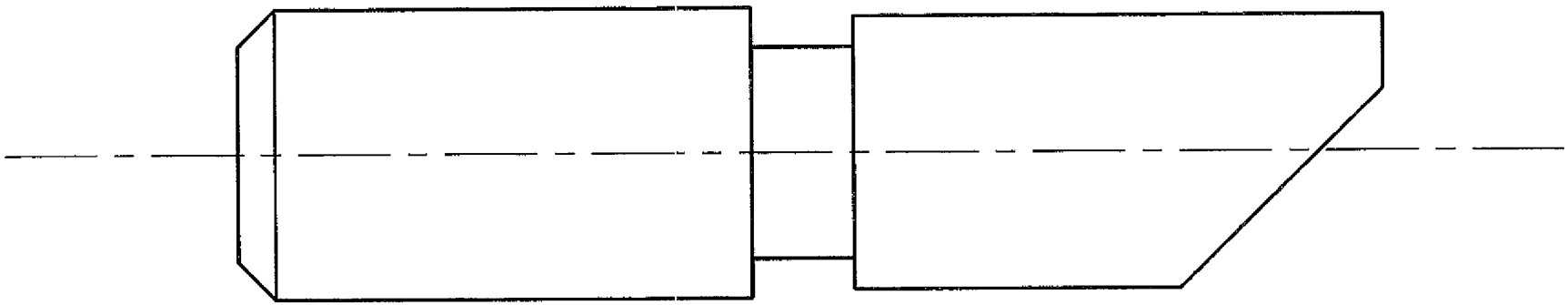
FIG. 53 is a short pin member for use in the left side member of the link of FIG. 40 or in the right side member of the link of FIG. 42.
Figure 54:
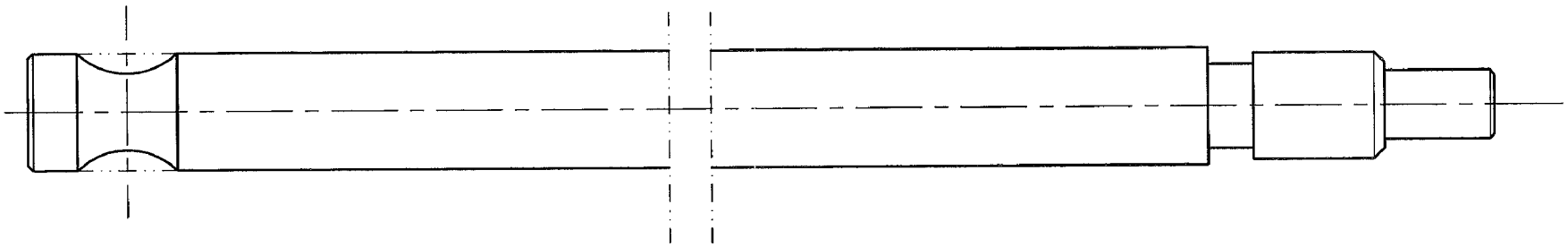
FIG. 54 is a long pin member for use in the link of FIG. 40 or FIG. 42.
Figure 55:
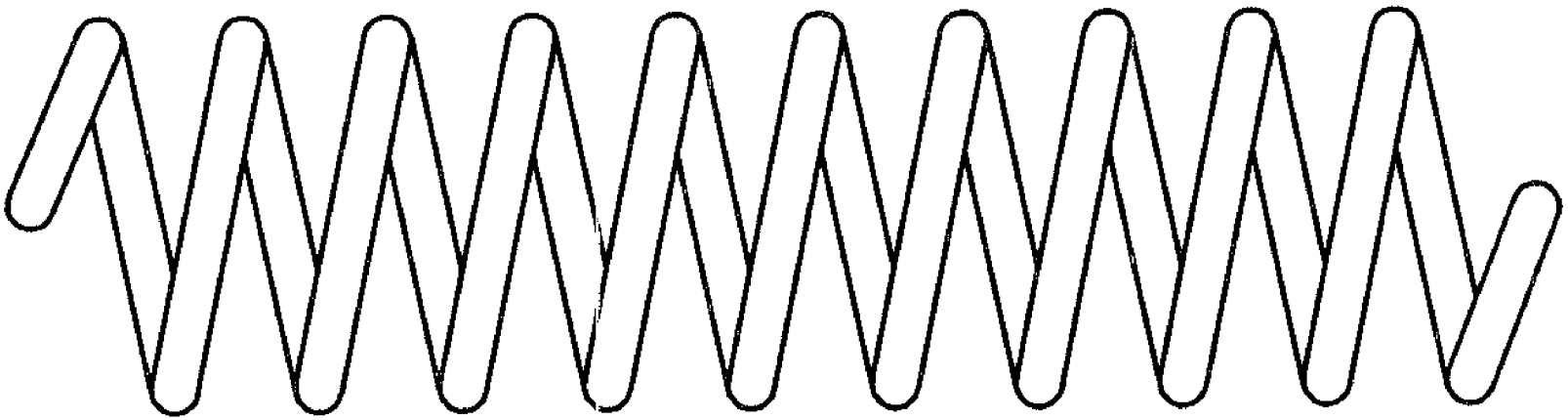
FIG. 55 is a spring for use in the connection mechanism of the band.
Figure 56:
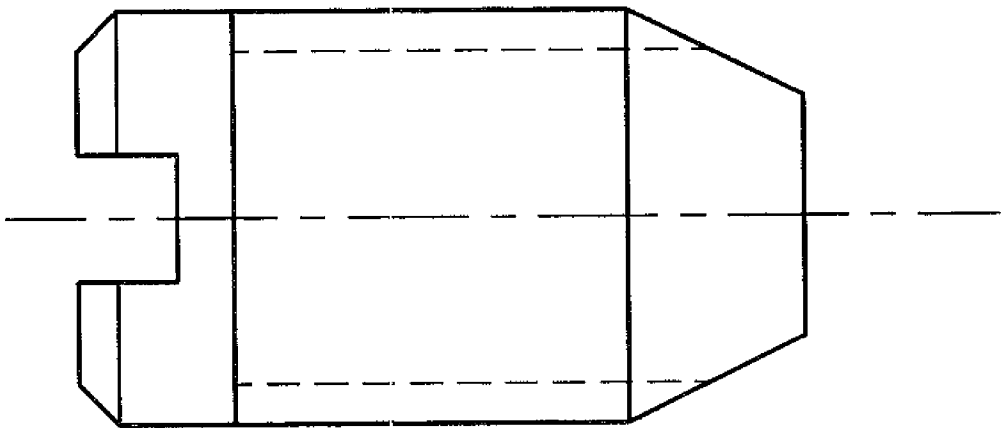
FIG. 56 shows a rivet resembling the rivet 186, 188 of FIG. 2.
Figure 57:
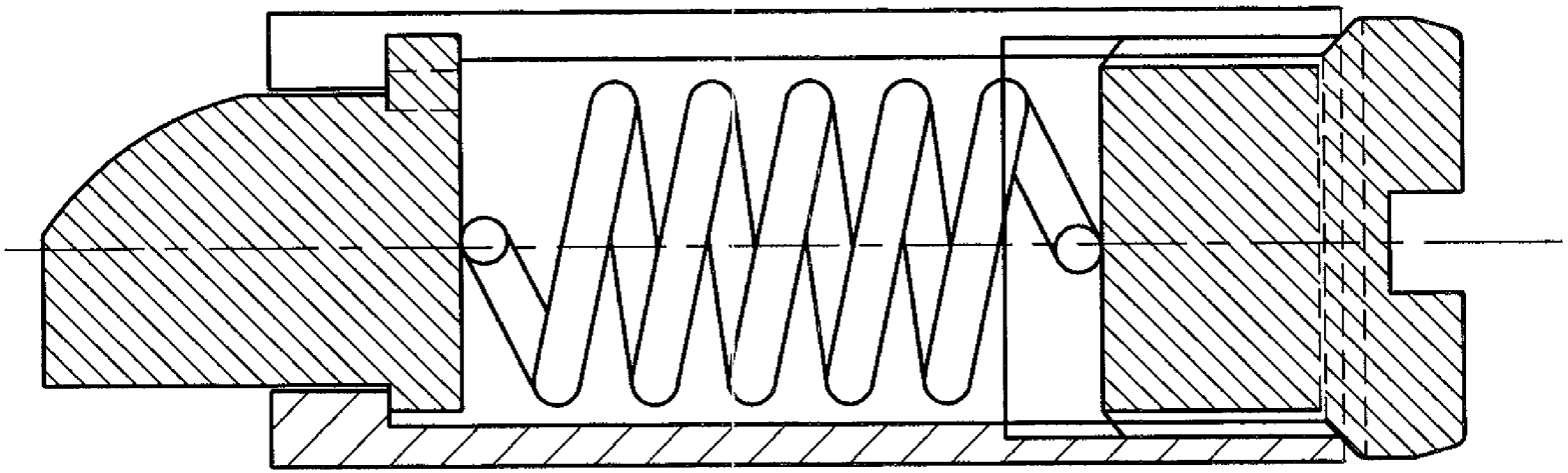
FIG. 57 is a protrusion means for use in a middle member of the link of FIG. 40 or FIG. 42.
Figure 58:
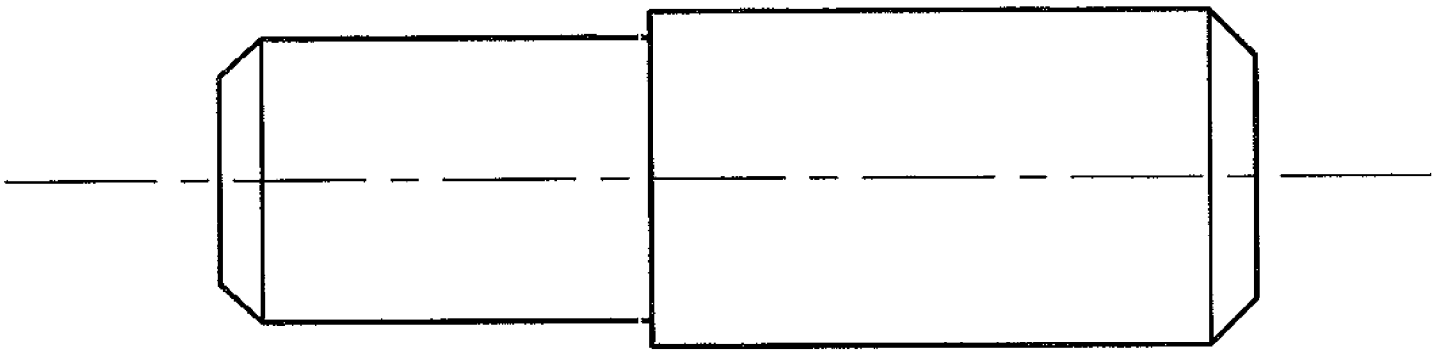
FIG. 58 is a component for use in a right side member of the link of FIG. 40 or the left side member of the link of FIG. 42.
Figure 59:
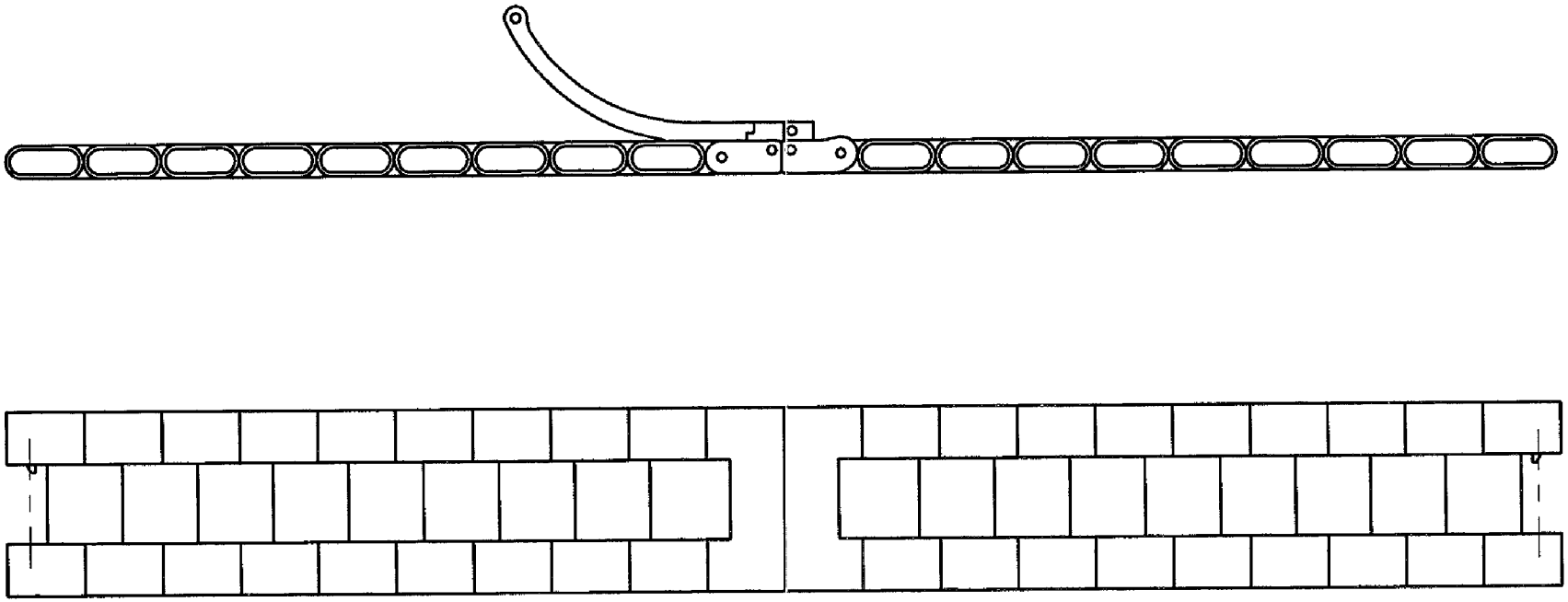
FIGS. 59 to 78 shows a band for a wristwatch or the like and components thereof according to a twelfth embodiment of the present invention.
Figure 60:
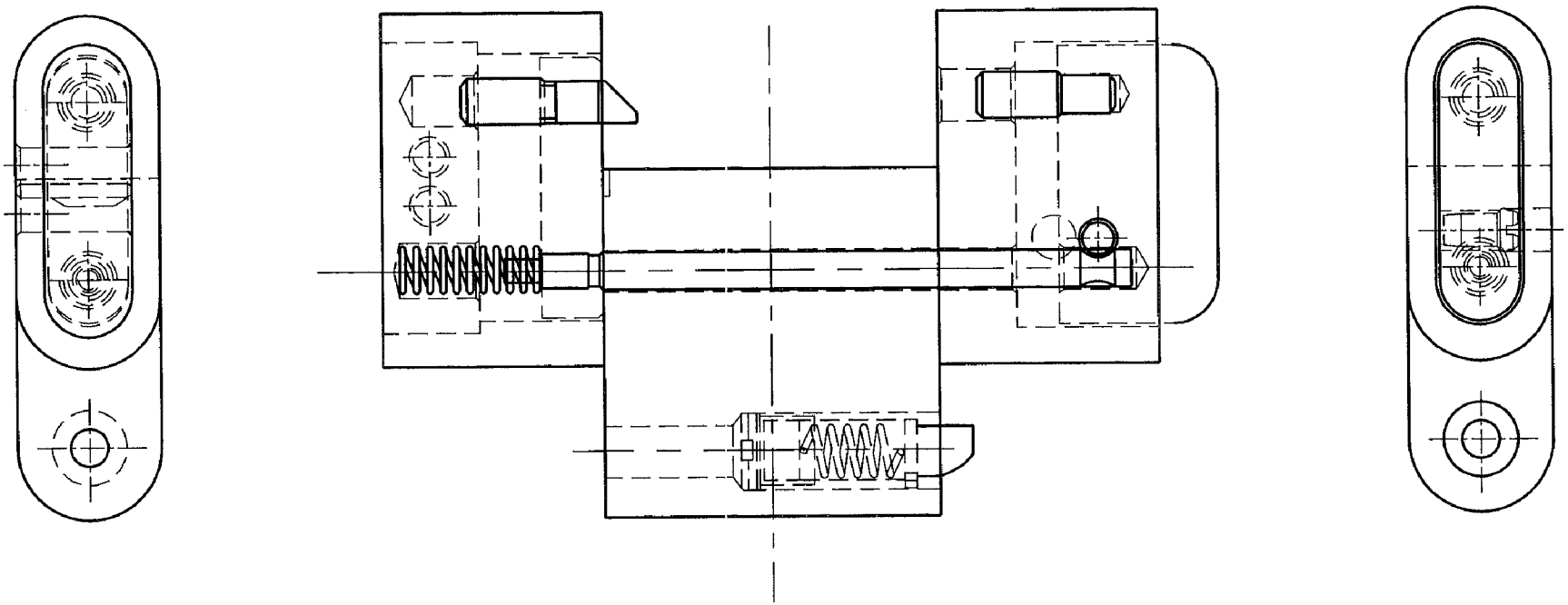
Figure 61:
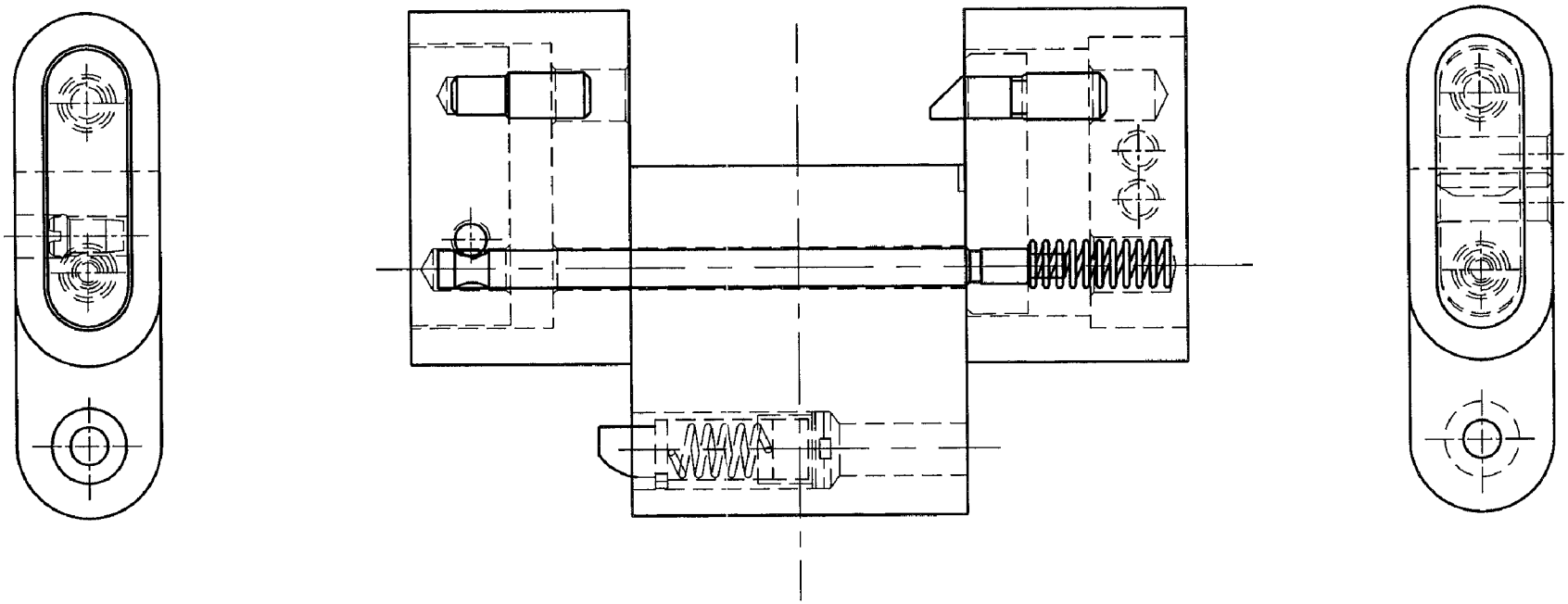
Figure 62:
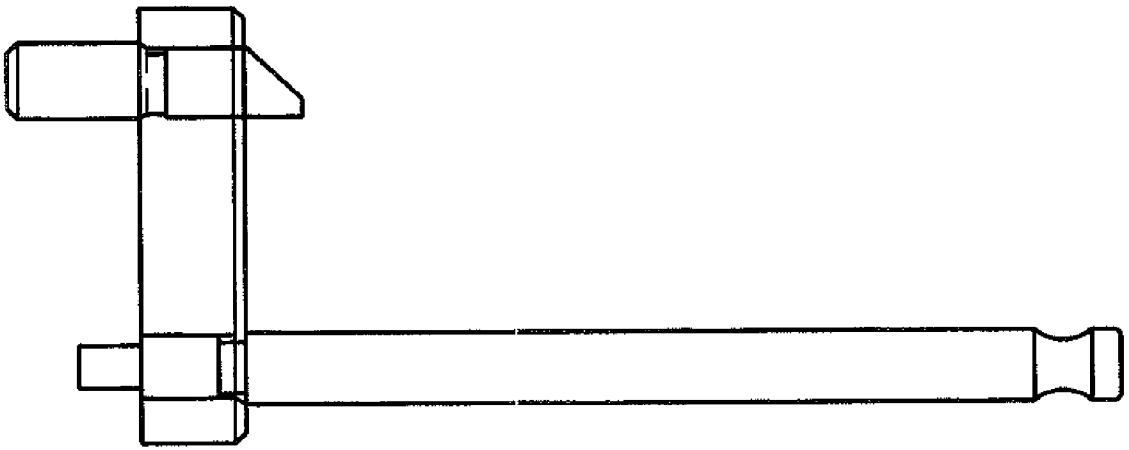
Figure 63:
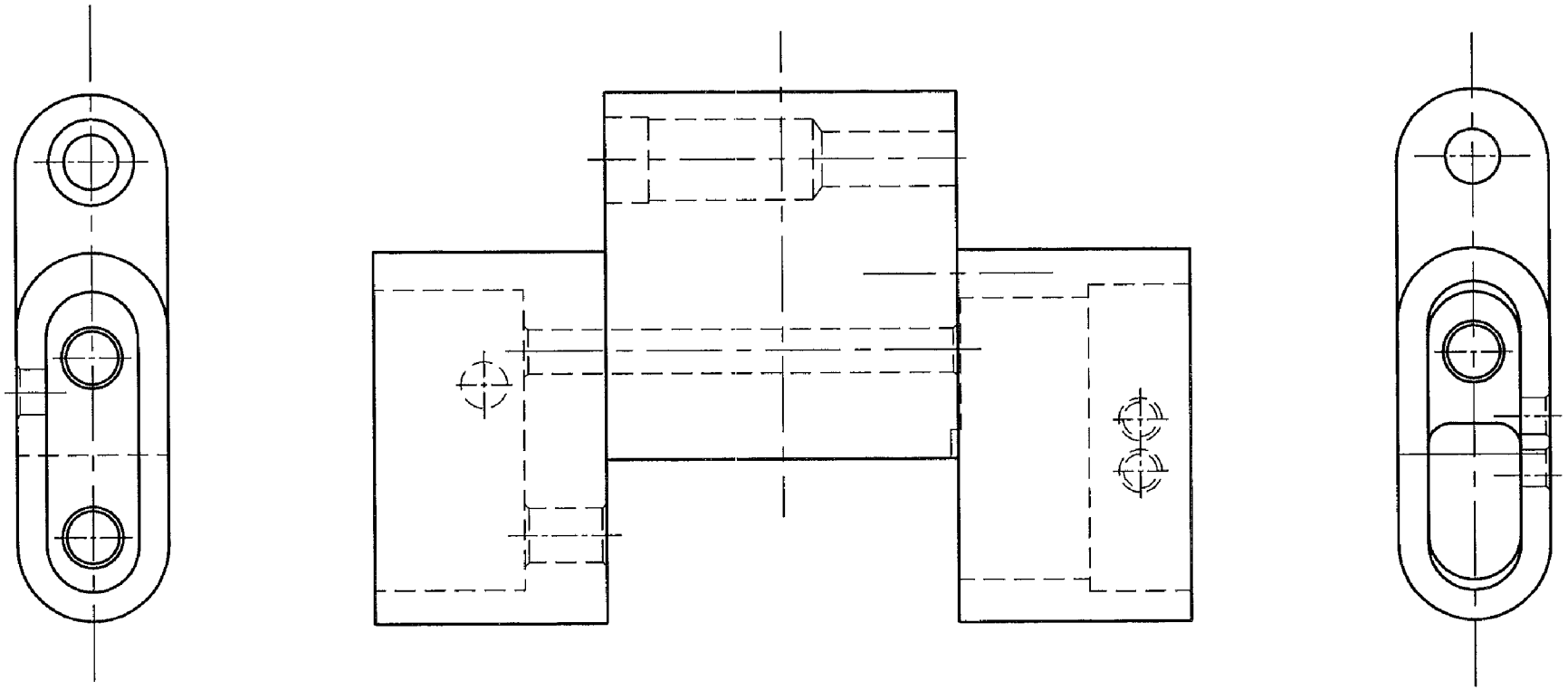
Figure 64:
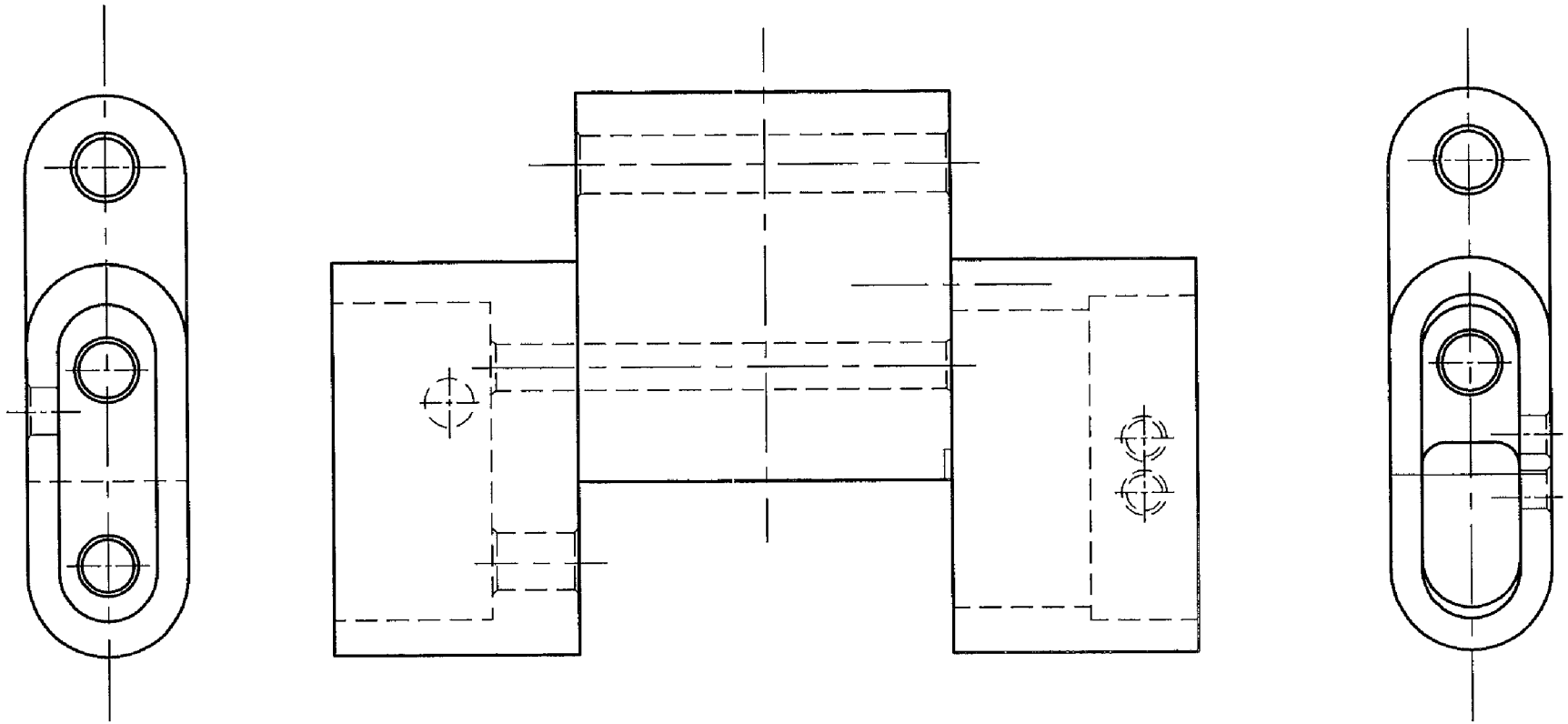
Figure 65:
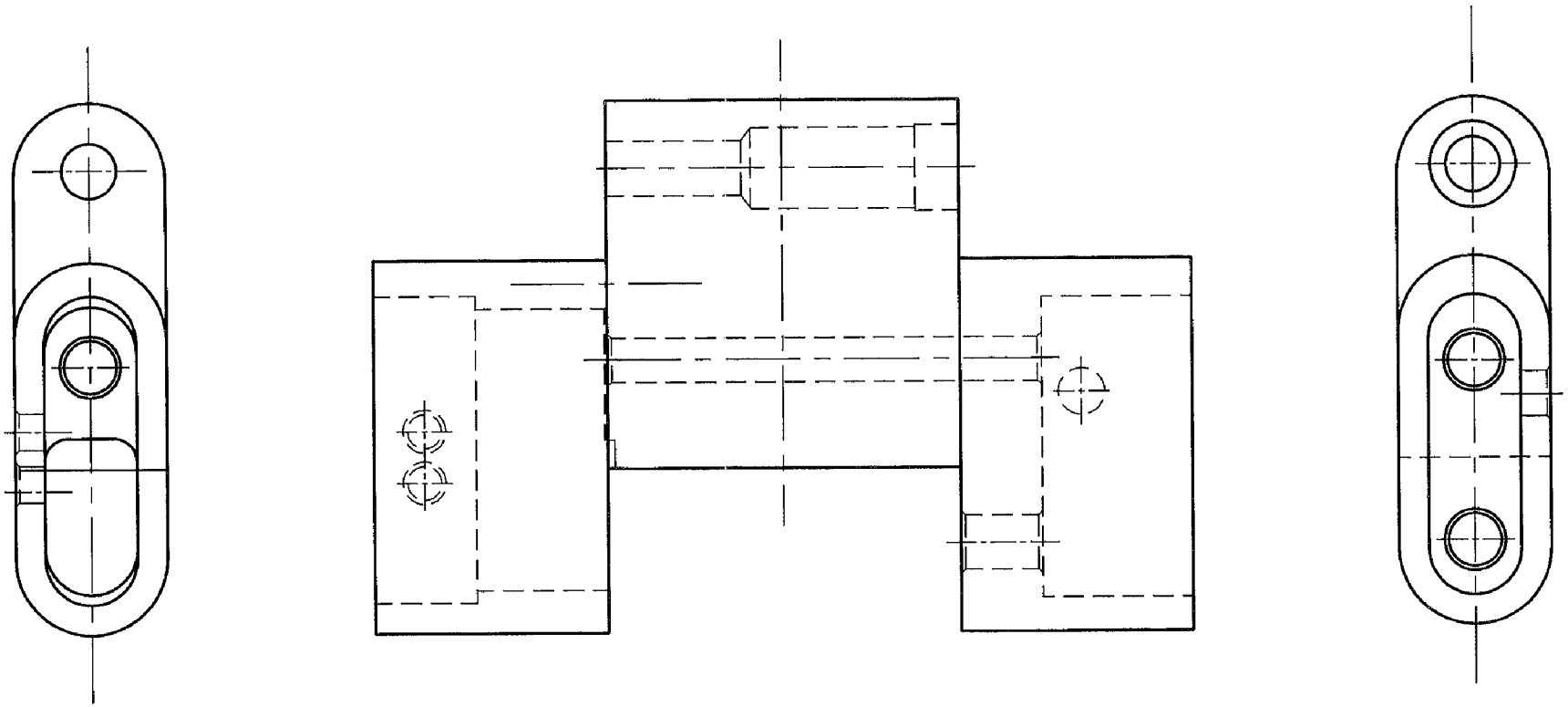
Figure 66:
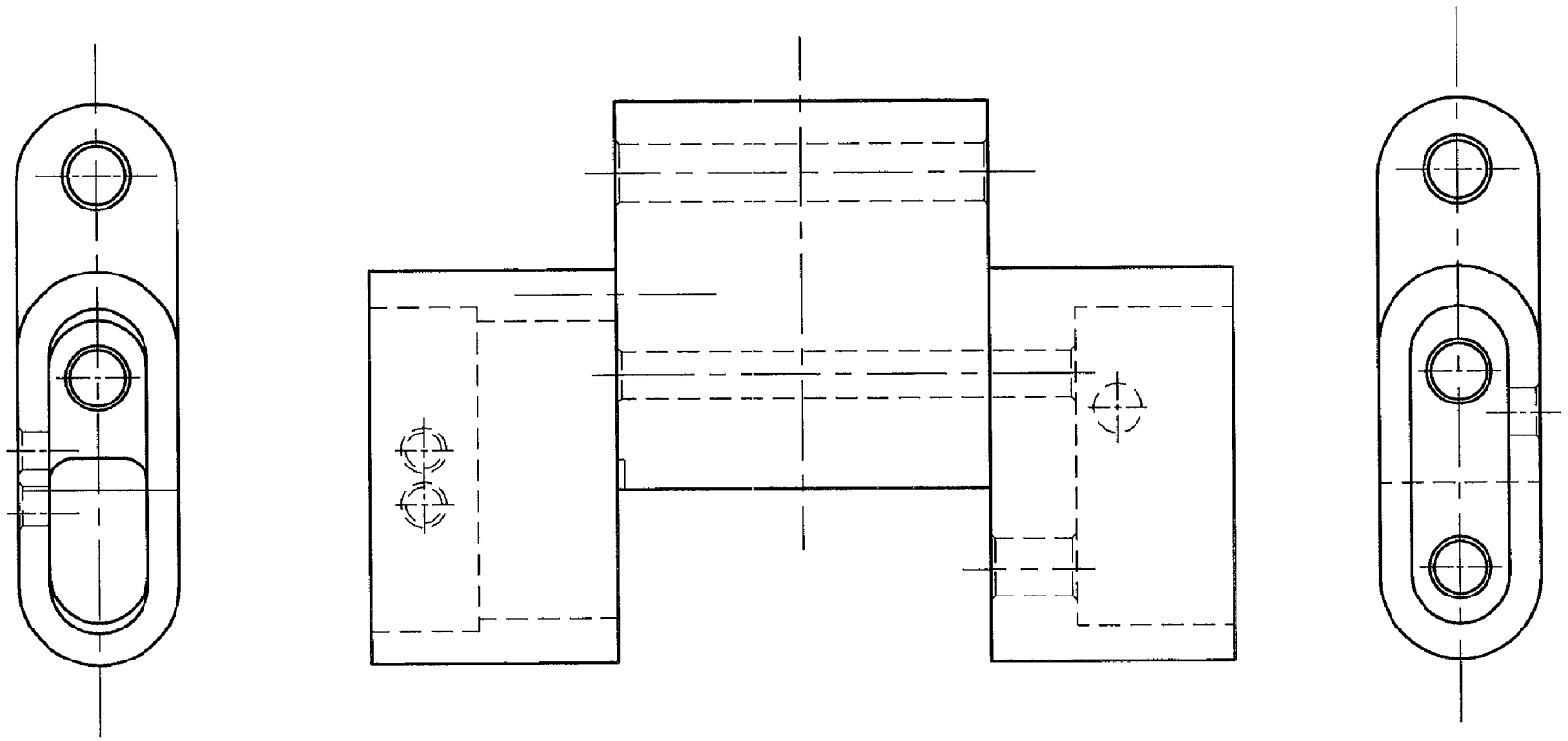
Figure 67:
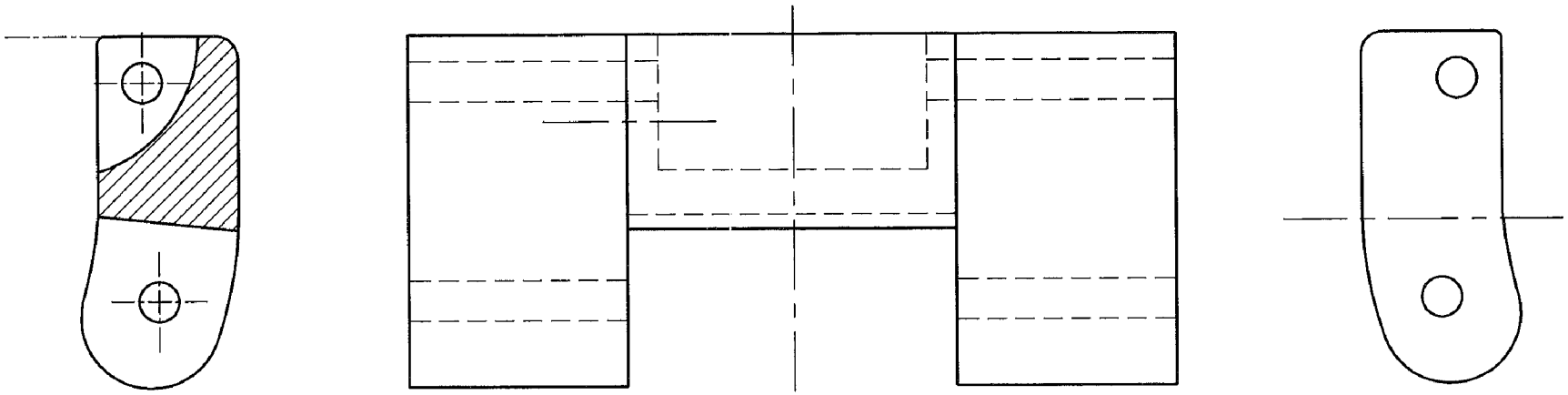
Figure 68:
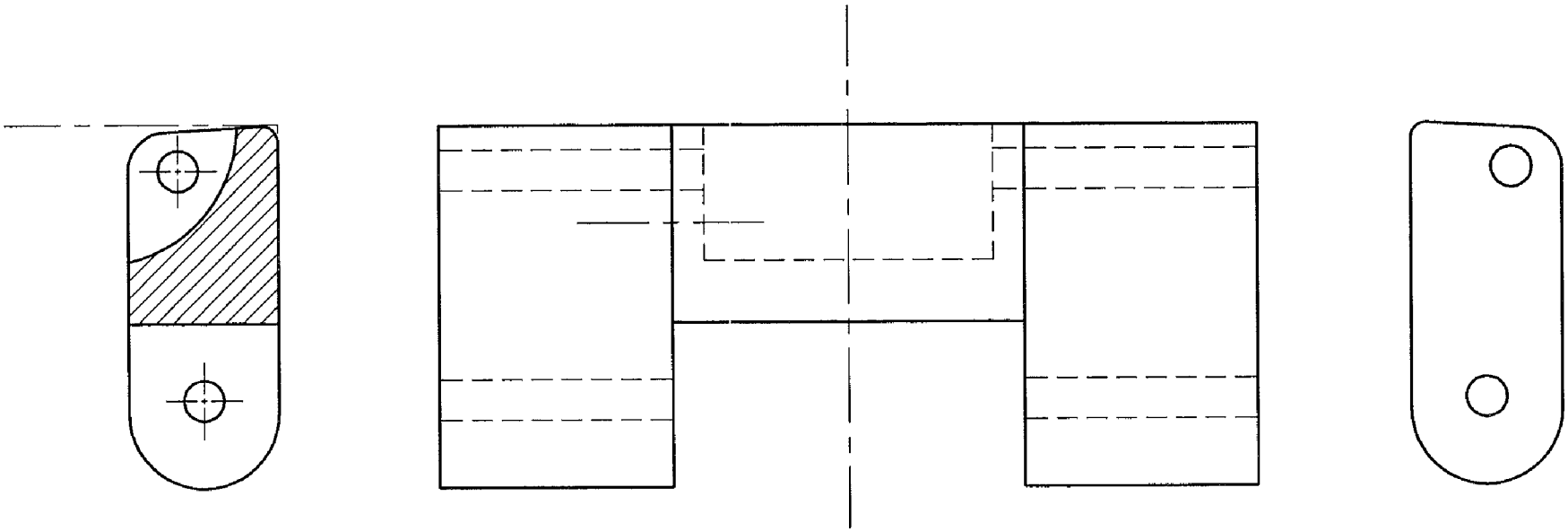
Figure 69:
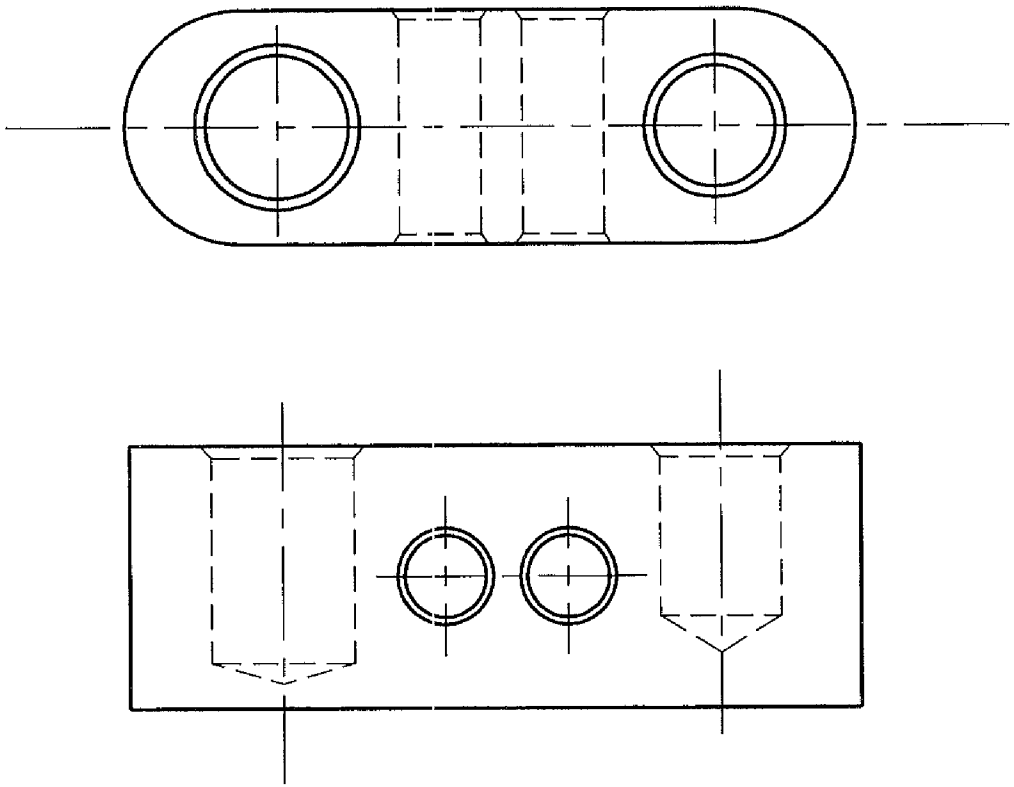
Figure 71:
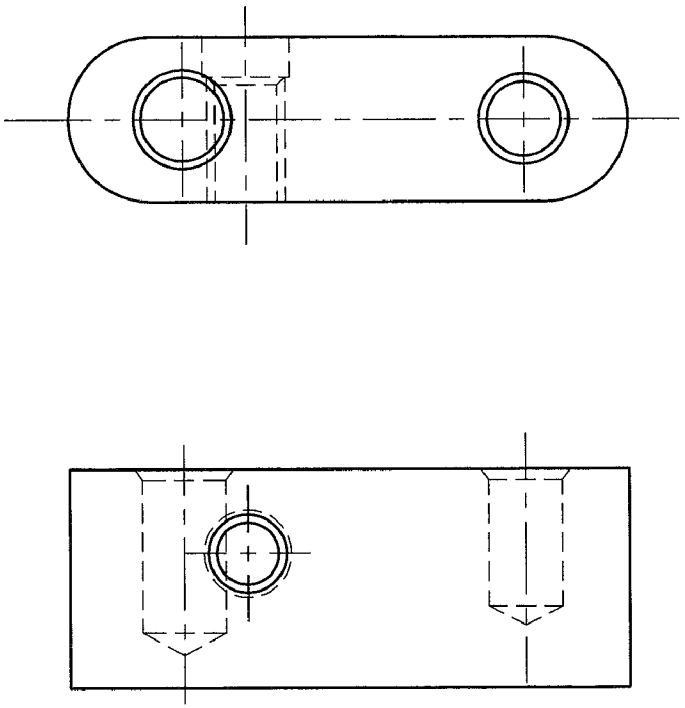
Figure 70:
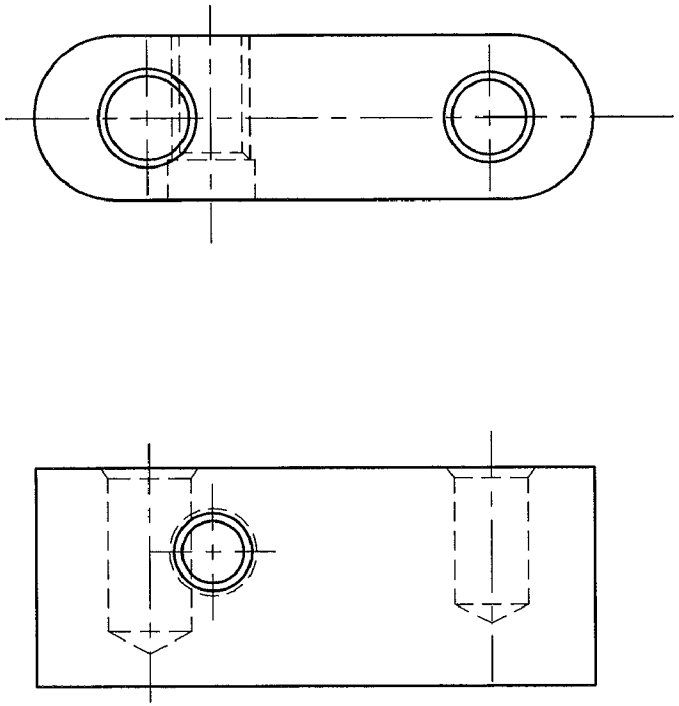
Figure 72:
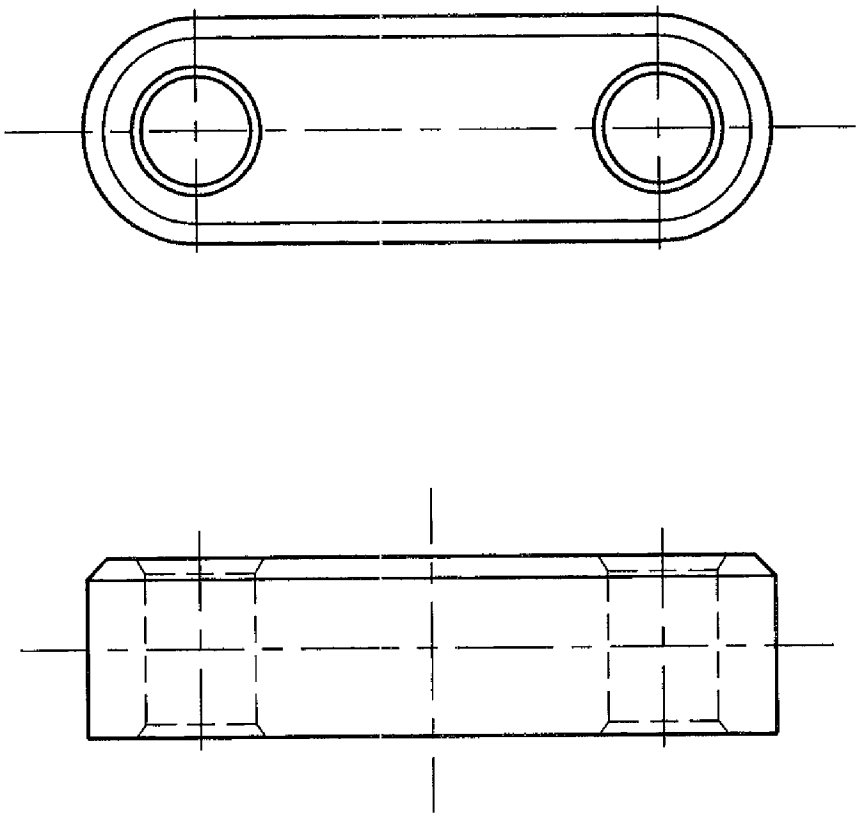
Figure 73:
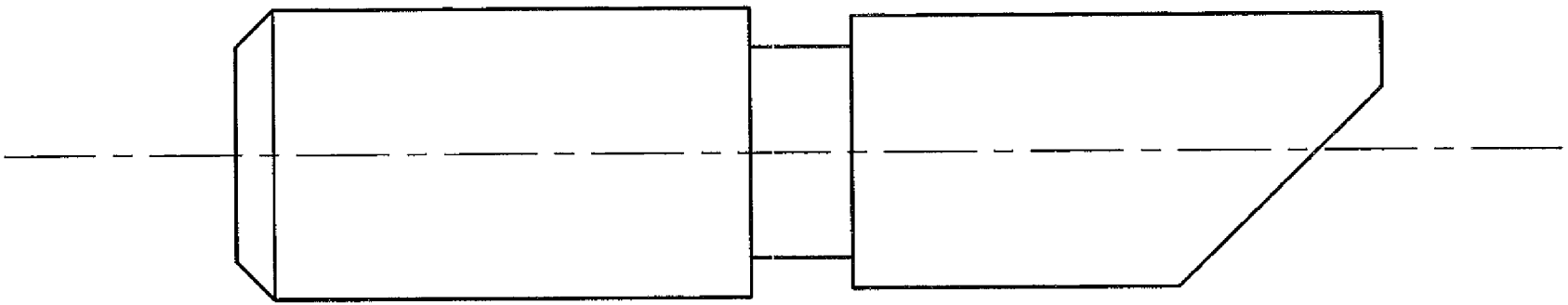
Figure 74:
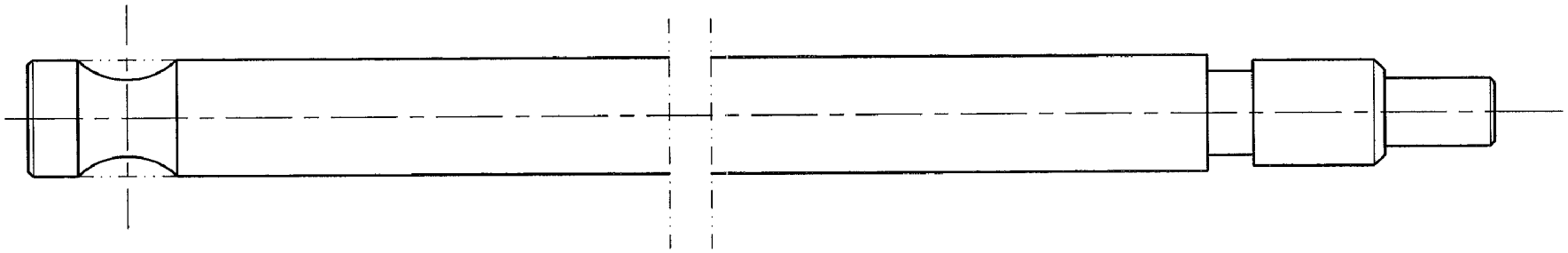
Figure 75:
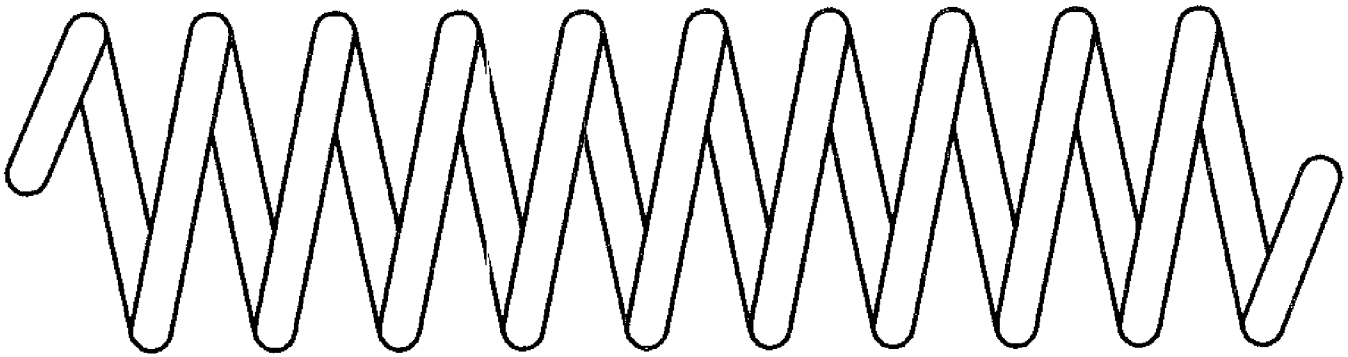
Figure 76:
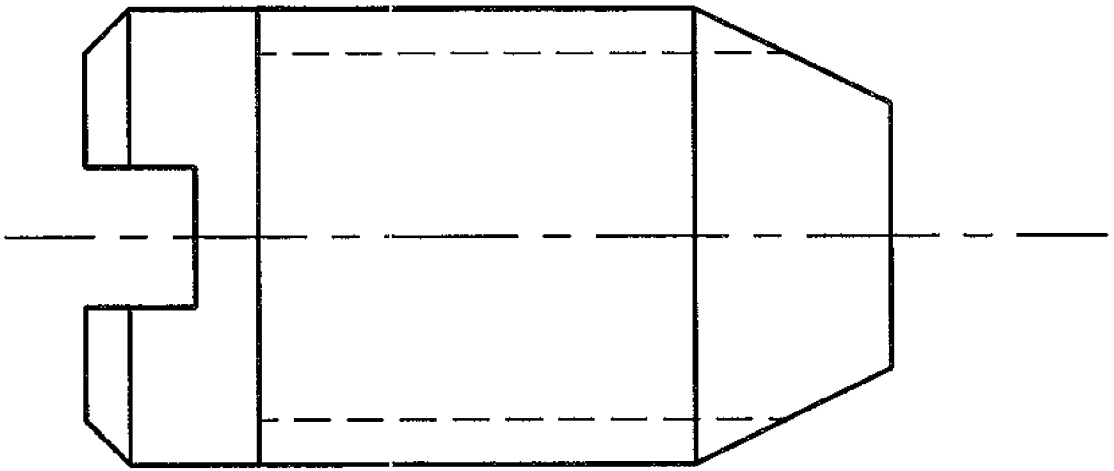
Figure 77:
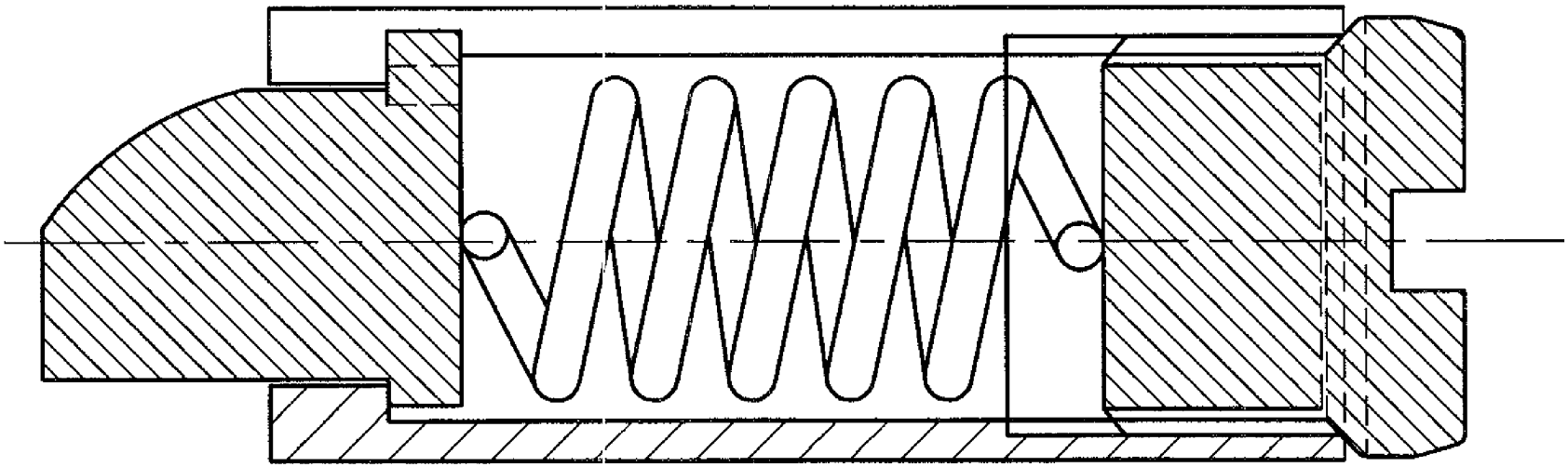
Figure 78:
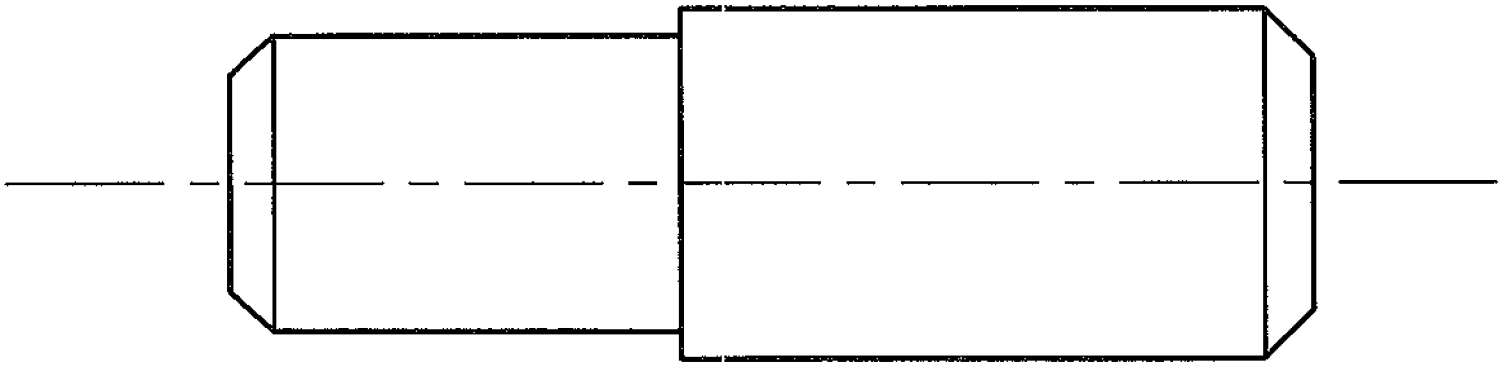

FIGS. 39 to 58 are concerned with a band 1124 for a wristwatch or the like in accordance with an eleventh embodiment of the present invention. FIG. 39 illustrates the band 1124, the appearance of which is generally similar to that of the band 124 in FIG. 1. The band 1124 likewise comprises a plurality of discrete units 1102, 1104, 1106, 1108, 1110, 1112, 1114, 1116, 1118, 1120, 1126, 1128, 1130, 1132, 1134, 1136, 1138, 1140, 1142, 1144, acting as inter-connectable links. In particular, each of these links has a protrusion 1146 receivable in a complementary recess 1158 of an adjacent link (see FIGS. 39 and 40). The link likewise has a left side member 1160, a right side member 1162 and a middle member 1164. However, the band 1124 in FIG. 39 is different in terms of the construction of its connection system. Referring to specifically FIG. 40, it is shown that there is only one actuator 1166 on the right side member 1162 and there is no actuator on the left side member 1160. Further, while in the first embodiment the middle member 164 of the link 118 of the band 124 (see FIG. 2) has three cylindrical channels 190, 192, 193 going through the center thereof only two such channels 1192, 1193 are provided in the middle member 1164 (e.g. see FIG. 40 and FIG. 46). Further, while in the link 118 two long pins 170, 172 are required, in the link in FIG. 40 only one long pin 1172 is required. Further, while in the first embodiment the two short pins 174, 176 extend from the left side member 162 and the right side member 160 for engagement with the opposite end recesses of the channel 193 of the adjacent link, only one short pin 1174 is provided in the left side member 1160 for engagement with a corresponding left end recess of the channel 1193 of the adjacent link connected thereto. The pin 1174 is retractable on depression or actuation of the actuator arranged on the other side of the link (for disengagement with the (upper) adjacent link) and is biased to protrude and engage with the left end recess and thus locked with the adjacent link connected thereto. Yet further, in this embodiment there is provided with a further short pin 1175 protruding from one (the right) end the channel 1193. This short pin also has a tapered end which is receivable within a recess 1176 of the right side member of the adjacent link. The short pin 1175 is retractable when the tapered end is pressed but is biased towards an outer position by a spring for engagement with the adjacent link positioned therebelow. It is envisaged that when three consecutive links are being connected together, the short pin 1174 from the side member 1160 and the short pin 1175 of the middle member 1164 engage with the end recess of the channel 1193 of the (upper) adjacent link on one side thereof and the recess 1176 of the side member 1162 of the (lower) adjacent link on the other side thereof, respectively. Due to the self-explanatory nature of FIGS. 39 to 58, the construction thereof is not repeated here.

FIGS. 59 to 78 are concerned with a band for use in a wristwatch or the like in accordance with a twelfth embodiment of the present invention. These figures generally correspond to FIGS. 39 to 58. However, unlike in the eleventh embodiment in which the actuators are protruded from the side members of the links, actuators in this embodiment are fully resided within side members of their links. The construction of band is otherwise generally similar and is not repeated here.

It is envisaged that an alternative band may be made in accordance with the present invention in which each link in the band is provided with only one actuator. More specifically, one side of the band is provided with the actuators on alternate links and the other side of the band is also provided with the actuators on alternate links.

It is to be noted that while as explained above various of the components of the link is firstly made by cutting a steel member from a steel plate, these components may be produced by using a sheet of relatively thin material (e.g. steel sheet or coil) and forming the sheet into for example the side members. The advantage of using steel sheet instead of steel plate is that the resultant components are relatively light. However, the use of steel plate is preferable in that the resultant components are relatively more durable and sturdy.

It is envisaged that a watchcase may actually be made of two independent sub-units securable together by a connection system as explained above. One of the sub-units may include an analog timepiece while the other sub-unit may include a digital timepiece. Depending on which of the sub-units are desired, a user may easily include or remove one or both of the sub-units in a wristwatch.

The invention claimed is:

1. A band wearable by a user connectable or connected to a watchcase or a decorative item, comprising a plurality of separable units and releasable connection means for releasably connecting at least some of said units together to form said band, or for releasably connecting one of said units to a watchcase or a decorative item, a length of said band being user adjustable by adding or removing one or more of said units forming said band, wherein:

a. a first of two adjacent units is provided with a protrusion and a second of said two adjacent units or a watchcase or a decorative item, is provided with a complementary recess defined between a first side member and a second side member and sized and shaped to accommodate said protrusion such that said protrusion is positionable between said first side member and said second side member, and wherein, b. said releasable connection means comprising first and second operable means manually actuable or depressible by a finger of a user so as to be movable relative to the first and second side members respectively, and two connection members movable into the first and second side members respectively, wherein movement of the first operable means in a first direction brings about movement of the second connection member in the first direction to a retracted position in the second side member, and movement of the second operable means in a second direction opposite to the first direction brings about movement of the first connection member in the second direction to a retracted position in the first side member, such that pushing of both operable means towards each other causes both connection members to move relatively away from each other to their respective retracted positions thereby releasing two adjacent units from each other whereby the length of said band is then adjusted by adding thereto or removing therefrom one or more said units.

2. A band as claimed in claim 1 wherein said releasable connection means is operable without the use of any tool.

3. A band as claimed in claim 1 wherein said operable means has at least one actuator.

4. A band as claimed in claim 1 wherein each connection member comprises two actuators residing on opposite sides of said adjacent units and on actuation of said actuators said adjacent units are dis-connectable from each other.

5. A band as claimed in claim 1 wherein at least part of said releasable connection means protrudes from said units.

6. A band as claimed in claim 3 wherein a part of said at least one actuator is arranged within said units.

7. A band as claimed in claim 4 wherein part of said actuators is arranged within said units.

8. A band as claimed in claim 1 wherein each connection member is in the form of a pin.

9. A band as claimed in claim 1 wherein said releasable connection means comprises spring means for biasing each connection member to a default locked position.

10. A band as claimed in claim 1 wherein said two units of said adjacent units are movable towards each other on a horizontal plane when connecting or engaging with each other.

11. A band as claimed in claim 1 wherein one or more of said units are re-positionable, re-orientable and/or reversible within said band.

12. A band as claimed in claim 1 wherein said units or parts thereof are formed by stamping on a relatively thick metal plate.

13. A band as claimed in claim 1 wherein said units or parts thereof are in the form of a coil or tubular structure.

14. A band as claimed in claim 1 wherein said units are identical or different in size, shape, length, material and/or color.

15. A band as claimed in claim 1 wherein at least one of said units is provided with an upwardly facing surface and a downwardly facing surface, said surfaces carry different decorating patterns or objects.

16. A band as claimed in claim 1 wherein at least one of said units or a part thereof is made of a metallic material.

17. A band as claimed in claim 1 wherein said band is a watch wristband or a ring band.

18. A watch comprising a watchcase connected to a band as claimed in claim 1.

19. A watchcase comprising at least two adjacent separable sub-units and means for releasably connecting said adjacent sub-units together to form said watchcase, wherein:

a. a first of said adjacent sub-units is provided with a protrusion and a second of said two adjacent sub-units is provided with a complementary recess defined between a first side member and a second side member and sized and shaped to accommodate said protrusion such that said protrusion is positionable between said first side member and a second side member, and b. said releasable connection means comprising first and second operable means manually actuable or depressible by a finger of a user so as to be movable relative to the first and second side members respectively, and two connection members movable into the first and second side members respectively, wherein movement of the first operable means in a first direction brings about movement of the second connection member in the first direction to a retracted position in the second side member, and movement of the second operable means in a second direction opposite to the first direction brings about movement of the first connection member in the second direction to a retracted position in the first side member, such that pushing of both operable means towards each other causes both connection members to move relatively away from each other to their respective retracted positions thereby releasing said two units from each other.

20. A watch comprising a watchcase as claimed in claim 19 wherein said watchcase is connected to a band as claimed in claim 1.

21. A watch as claimed in claim 20 wherein at least one of said sub-units of said watchcase is re-positionable, re-orientable and/or reversible within said watch.

* * * * *